US007123858B2

(12) United States Patent
Saito et al.

(10) Patent No.: US 7,123,858 B2
(45) **Date of Patent: *Oct. 17, 2006**

(54) TWO-STATION TYPE COLOR IMAGE FORMING APPARATUS WITH SEPARATELY REPLACEABLE COMPONENTS

(75) Inventors: Masanori Saito, Tokyo (JP); Nobuyuki Yanagawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/171,227

(22) Filed: Jul. 1, 2005

(65) Prior Publication Data

US 2005/0244187 A1 Nov. 3, 2005

Related U.S. Application Data

(60) Division of application No. 10/889,152, filed on Jul. 13, 2004, now abandoned, which is a continuation of application No. 10/293,334, filed on Nov. 14, 2002, now Pat. No. 6,832,061.

(30) Foreign Application Priority Data

Nov. 14, 2001 (JP) ..... 2001-349414
Jan. 17, 2002 (JP) ..... 2002-008359

(51) Int. Cl.
*G03G 15/00* (2006.01)

(52) U.S. Cl. ..... 399/116

(58) Field of Classification Search ..... 399/113, 399/116, 117

See application file for complete search history.

(56) References Cited

U.S. PATENT DOCUMENTS

| | | | | |
|---|---|---|---|---|
| 4,647,961 | A | 3/1987 | Kammoto et al. | |
| 4,841,358 | A | 6/1989 | Kammoto et al. | |
| 4,876,572 | A | 10/1989 | Nagatsuna | |
| 4,968,997 | A | 11/1990 | Saitoh et al. | |
| 5,105,221 | A | 4/1992 | Takahashi et al. | |
| 5,194,959 | A | 3/1993 | Kaneko et al. | |
| 5,266,998 | A | 11/1993 | Lee | |
| 5,404,206 | A | 4/1995 | Andoh et al. | |
| 6,157,797 | A | 12/2000 | Saito et al. | |
| 6,215,974 | B1 | 4/2001 | Katoh et al. | |
| 6,256,461 | B1 | 7/2001 | Takeyama et al. | |
| 6,292,641 | B1 | 9/2001 | Takeyama et al. | |
| 6,308,027 | B1 | 10/2001 | Obu et al. | |
| 6,546,217 | B1 * | 4/2003 | Okabe et al. | 399/113 |
| 6,549,737 | B1 | 4/2003 | Sano et al. | |
| 6,674,982 | B1 * | 1/2004 | Saitoh et al. | 399/117 |
| 6,832,061 | B1 * | 12/2004 | Saito et al. | 399/113 |

* cited by examiner

*Primary Examiner*—William J. Royer
(74) *Attorney, Agent, or Firm*—Oblon, Spivak, McClelland, Maier & Neustadt, P.C.

(57) ABSTRACT

A two-station type color image forming apparatus of the present invention includes intermediate members configured to support only a developing device or the developing device and image forming means other than an image carrier. The intermediate members are selectively locked to or unlocked from the body of the image forming apparatus. Members constituting the image forming means each can be simply replaced alone in accordance with its life.

6 Claims, 46 Drawing Sheets

TWO-STATION TYPE COLOR IMAGE FORMING APPARATUS WITH SEPARATELY REPLACEABLE COMPONENTS

This application is a divisional application of application Ser. No. 10/889,152 filed Jul. 13, 2004 now abandoned, which is the continuation application of application Ser. No. 10/293,334 filed Nov. 14, 2002 (now U.S. Pat. No. 6,832,061), the entire contents of which are incorporated herein by reference. This application also claims the benefit of priority from the prior Japanese Patent Application 2001-349414, filed on Nov. 14, 2001, and Japanese Patent Application 2002-008359, filed on Jan. 17, 2002.

BACKGROUND OF THE INVENTION

1. Field of the Invention

The present invention relates to a two-station type color image forming apparatus applicable to, e.g., a copier, a printer or a facsimile apparatus and more particularly to a method of assembling a two-station type color image forming apparatus and an image carrier unit.

2. Description of the Background Art

In an image forming apparatus, a photoconductive drum or image carrier and at least one of a developing device, a charger and a cleaning device may be constructed into a single process cartridge removable from the body of the apparatus, as taught in Japanese Patent Laid-Open Publication No. 2000-72733 by way of example. The process cartridge allows the user of the apparatus to easily perform replacement and maintenance without relying on a service person. However, in the case where the process cartridge includes the drum and image forming means, the process cartridge must be bodily replaced when only the drum or only part of the image forming means should be replaced.

In the process cartridge, the drum and a cleaning case rotatably supporting the drum are constructed integrally with each other. Also, process means for forming an image on the drum are mounted on the cleaning case. The process means include a charge roller or charger for uniformly charging the drum and a cleaning blade and a cleaning roller for removing toner left on the drum after the transfer of a toner image to a sheet or recording medium. Such process means are arranged around the drum.

The process cartridge is removably mounted to the apparatus body and is replaceable when the life of the drum ends or when the cleaning case is filled up with waste toner.

On the other hand, Japanese Patent Laid-Open Publication Nos. 10-177286 and 11-295952, for example, each disclose a two-station type recording system in which a developing device, a writing device and drive means are mounted to an apparatus body via common mount members at each of two image stations and accurately positioned relative to each other. In this type of recording system, the developing device defines a reference position for all of image forming process devices to be mounted.

The drum or drum unit is not mounted to the apparatus body, but is mounted to the developing device. More specifically, because the drum or the drum unit is positioned relative to only the developing device or developing unit, the former is subsidiary to the latter. Further, the drum or the drum unit is removable from the developing device, which is, in turn, removable from the apparatus body. In addition, the drum, charging means and cleaning means are constructed integrally with each other.

There is an increasing demand for a printer, copier or similar image forming apparatus having advanced configurations that, in turn, make loads on an image forming device heavier during image formation. A series of studies and experiments showed that the advanced configurations desired on the market tend to increase loads on, among various image forming means, the drum, as will be described hereinafter.

First, it is necessary to reduce the size of an image forming device in order to meet the increasing demand for small-size office automation equipment. However, if the size or diameter of the drum is reduced, then the drum is more exhausted for a single print under given conditions. For example, if the diameter of the drum is reduced from 130 mm to 40 mm, then the drum must rotate three times more for a given image size. It follows that the drum suffers from various kinds of exhaustion including electric exhaustion ascribable to, e.g., the discharge of a charger and mechanical exhaustion ascribable to a blade included in a cleaning section three times more.

While a certain degree of size reduction has already been implemented with, e.g., a developing device, the drum has not been reduced in size like the developing device. Reducing the size of the drum, however, increases loads on the drum and thereby reduces the life of the drum.

Second, the ratio of photographic images and graphic documents to the entire documents to be dealt with by users is increasing today, so that image quality as high as one achievable with silver halide type of photography is desired. While such high image quality may typically be implemented by high resolution, high resolution is not attainable with electrophotography unless a photoconductive layer formed on the drum is made thin. For example, in a photoconductive layer chargeable to negative polarity, a charge carrier generated in a CGL (Charge Carrier Generation Layer) by exposure is propagated to the surface of the photoconductive layer via a CTL (Charge Carrier Transport Layer), forming a latent image on the photoconductive layer. At this instant, if the CTL is thick, then the carrier must be propagated over a long distance and therefore separates due to electric repulsion. This prevents a latent image faithful to image data from being formed on the photoconductive layer, i.e., prevents dots from being faithfully formed at expected positions. This problem arises not only when resolution is increased from 600 dpi (dots per inch) to 1,200 dpi, but also when higher image quality is desired with resolution being maintained at, e.g., 600 dpi.

To obviate the degradation of image quality mentioned above, it is necessary to reduce the thickness of the photoconductive layer for thereby reducing the distance over which the charge carrier is propagated. However, the photoconductive layer is shaved off by the cleaning blade or otherwise exhausted every time an image is formed thereon. The life of the photoconductive layer therefore becomes shorter as its thickness decreases.

Third, a color image, which is increasing on the market because it renders information easy to understand, differs from a black-and-white or text image in that in many cases a photographic image or a graphic image occupies the major area of a sheet. In addition, the background of a color image is often a solid image. As a result, the image forming area for a single image formation increases and aggravates the exhaustion of the image forming device including the drum.

An image forming apparatus of the type including a revolver made up of a plurality of developing sections is also extensively used on the market because it needs a minimum of parts and can form a color image at relatively low cost. However, this type of image forming apparatus causes the developing sections to form respective images on a photoconductive drum, so that the drum is exhausted several times more than the individual developing section. In this manner, the current trend to color image formation reduces the life of the drum also.

The demands for smaller configuration, higher image quality and color image formation described above will make the life of the drum shorter in the future relative to the life of the other image forming devices. More specifically, the life of the drum tends to decrease relatively because researches and experiments are under way for enhancing not only the durability and life of the drum, but also those of the other developing devices. This brings about unbalance between the drum and the other image forming means mounted on the process cartridge.

More specifically, the problem with the process cartridge heretofore pointed out is that the process cartridge must be bodily replaced when the life of image forming means shorter than the lives of the image forming means ends. This problem is becoming more serious with the decreasing life of the drum, i.e., the image forming means longer in life than the drum must be replaced together with the drum whose life is shortest. Discarding or recycling the image forming means still usable would aggravate economic loads on the user, waste of time and labor necessary for collection, and have adverse influence on the environment.

To solve the above problems, Japanese Patent Laid-Open Publication No. 2000-298315 proposes an image forming apparatus, an image carrier unit and so forth configured such that, among various structural elements constituting image forming means, a structural element whose life is shortest is replaced before the others. Although a developing device included in this image forming apparatus can be replaced by the user, gears and other drive members associated with the developing device are bare and apt to smear or hurt the user's hand and bring about trouble in the drive members. Moreover, the user cannot replace the revolver type developing device that is rotatable for switching color.

SUMMARY OF THE INVENTION

It is an object of the present invention to provide a two-station type color image forming apparatus capable of solving the problems discussed above, a method of assembling the same, and an image carrier unit.

In accordance with the present invention, an image forming apparatus includes image forming devices that include at least a developing device and an image carrier. An intermediate member is capable of supporting only the developing device or the developing device and image forming devices other than the image carrier. The intermediate member is lockable to the body of the apparatus.

Also, in accordance with the present invention, in a method of assembling an image forming apparatus, an intermediate member supporting a developing device is mounted to the body of the apparatus, then a cleaning device is mounted to the intermediate member, and then an image carrier is mounted to the intermediate member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, a color image forming apparatus taught in Japanese Patent Laid-Open Publication No. 10-177286 mentioned earlier will be described first. Part of the apparatus disclosed in this document and included in the present invention also will be described with reference to FIG. 1.

Figure 1:
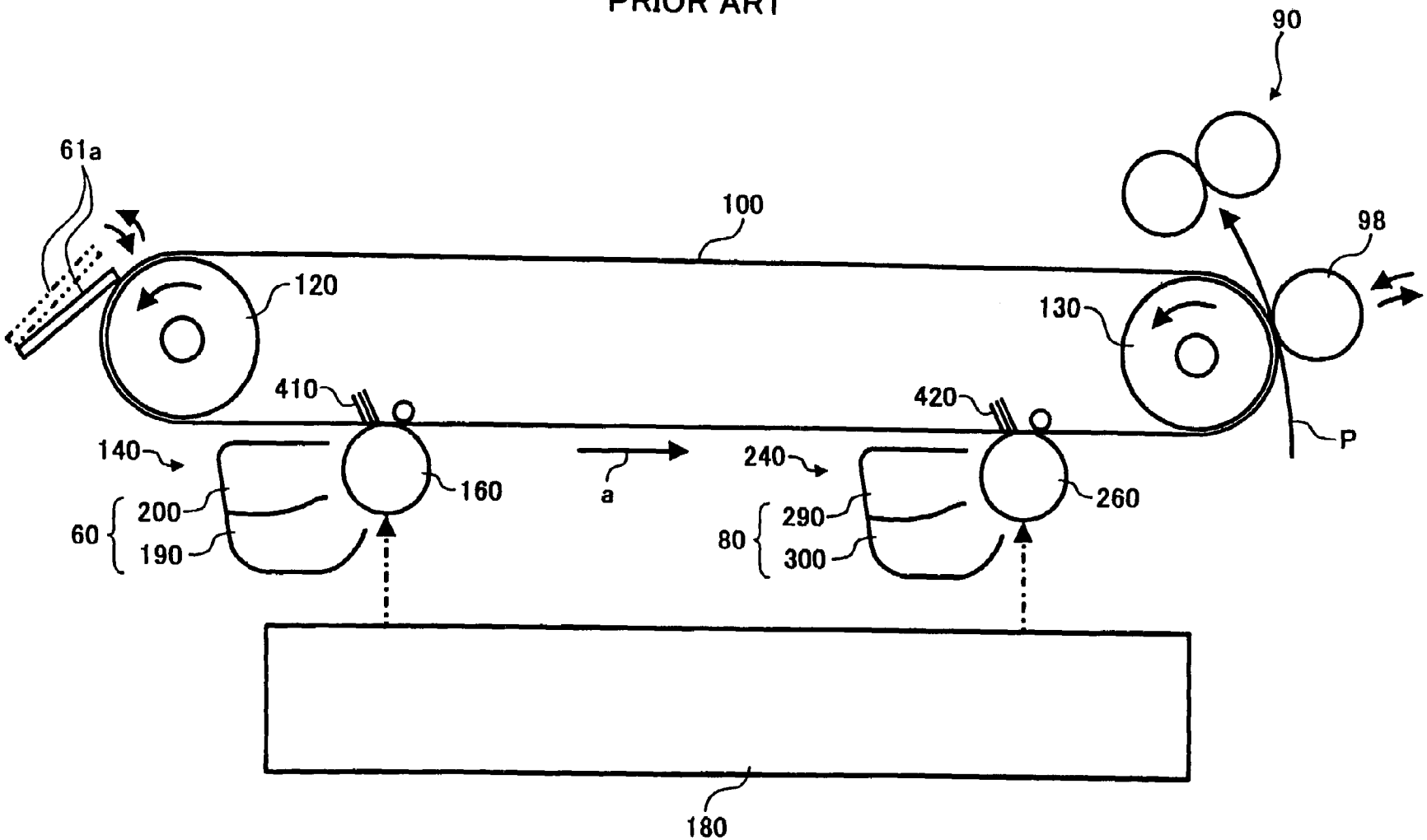
FIG. 1 PRIOR ART
FIG. 1 is a view showing a conventional, two-stage color image forming apparatus.

As shown in FIG. 1, the color image forming apparatus includes a belt or intermediate image transfer body 100 passed over a pair of rollers 120 and 130 and driven thereby in a direction indicated by an arrow a. Image forming process means are arranged around the belt 100 and include a first image station 140, a second image station 240, an image transfer roller or image transferring means 98 and a cleaning blade 61*a*, which are sequentially arranged in this order in the direction a. The image transfer roller 98 is movable into and out of contact with the roller 130 while the cleaning blade 61*a* is movable into and out of contact with the roller 120.

An image forming process based on the conventional electrostatic recording system will be described, taking the first image station 140 as an example. A photoconductive drum or image carrier 160 has its surface uniformly charged by charging means in the dark. An optical writing unit 180, which will be described later specifically, scans the charged surface of the drum 160 with a light beam in accordance with image data of some color, thereby forming a latent image on the drum 160. A developing device 60 develops the latent image with toner to thereby produce a corresponding toner image. The toner image is transferred from the drum 160 to the belt 100.

The developing devices 60 and 80 included in the first and second image stations 140 and 240, respectively, each store toner of two different colors. More specifically, the developing device 60 includes a magenta developing section 190 and a cyan developing section 200 storing magenta toner and cyan toner, respectively, while the developing device 80 includes a yellow developing section 290 and a black developing section 300 storing yellow toner and black toner, respectively. With this configuration, the developing devices 60, 80 can form a full-color toner image, as desired.

In operation, while the same image forming region of the belt 100 sequentially moves via the two consecutive image stations 140 and 240, a toner image of one color is transferred from each of the developing devices 60 and 80 to the above region of the belt 100 by image transfer brushes 410 and 420 facing the drums 160 and 260, respectively. At this instant, a bias for image transfer is applied to each of the image transfer brushes 410 and 420. The toner images are overlaid on the belt 100, forming a composite two-color toner image. Subsequently, while the region of the belt 100 carrying the two-color toner image again moves via the two image stations 140 and 240, a toner image of another color is transferred from each of the developing devices 60 and 80 to the belt 100 over the two-color toner image. As a result, a full-color toner image is completed in the same image forming region of the belt 100 when the image forming region moves via the image stations 140 and 240 two times.

The full-color toner image is transferred from the belt 100 to a sheet or recording medium P. More specifically, a bias for image transfer is applied to a secondary image transfer roller 98, which is pressed against and driven by the roller 130 via the belt 100 at the time of image transfer. When the sheet P is conveyed via a nip between the image transfer roller 98 and the belt 100, the full-color toner image is transferred from the belt 100 to the sheet P. After such image transfer, fixing means 90 fixes the toner image on the sheet P.

Preferred embodiments of a color image forming apparatus in accordance with the present invention will be described hereinafter.

1st Embodiment

Figure 2:
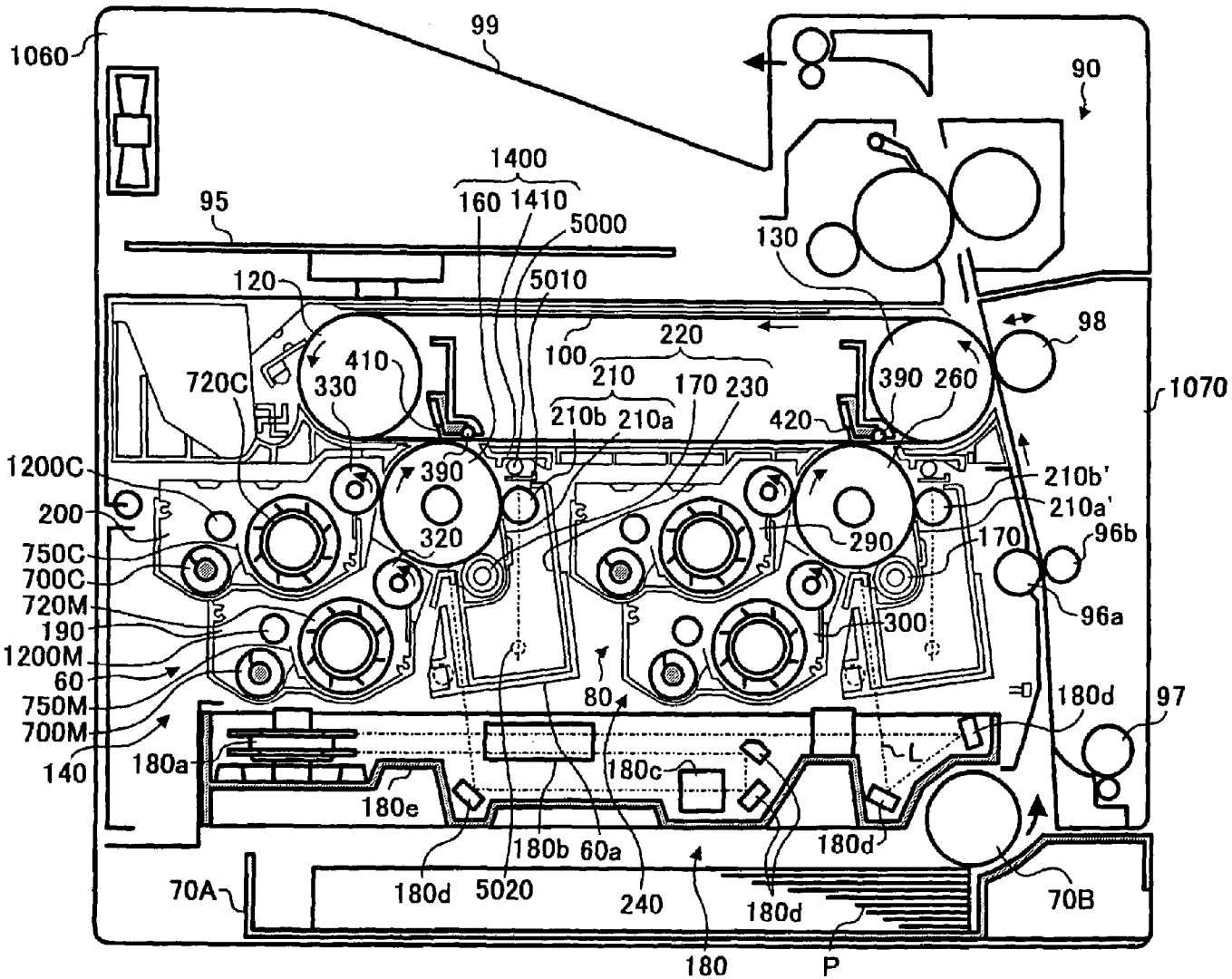
FIG. 2 is a partly sectioned front view showing a two-station color image forming apparatus in accordance with the present invention.

Referring to FIG. 2, a color image forming apparatus embodying the present invention is shown that constitutes an improvement over the apparatus disclosed in the above Laid-Open Publication No. 10-177286. As shown, the color image forming apparatus includes a sheet cassette 70A, a pickup roller 70B, the optical writing unit 180, the developing devices 60 and 80, the belt 100, the fixing means 90 and an electric unit 95, which are sequentially arranged one above the other from the bottom to the top in the direction of gravity. A pickup roller 97 assigned to manual sheet feed and a substantially vertical conveyance path are positioned at the right end of the apparatus, as viewed in FIG. 2. A pair of registration rollers 96*a* and 96*b* and the secondary image transfer roller 98 are positioned on the vertical conveyance path. The vertical conveyance path extends upward from the sheet cassette 70A to a print tray 99 via the pickup roller 70B, a secondary image transfer station where the image transfer roller 98 contacts the roller 130, and fixing means 90.

The optical writing unit 180 scans the charged surface of the drum 160 and 260 in accordance with image data and includes a light source implemented by either one or of an LED (Light Emitting Diode) array or a laser. In the illustrative embodiment, the optical writing unit 180 is provided with two semiconductor lasers.

More specifically, in the optical writing unit 180, laser beams issuing from two lasers in accordance with respective image data each are incident on one of two polygonal mirrors 180*a* stacked on each other. The laser beams reflected by the polygonal mirrors 180*a,* which are in rotation, are respectively focused on the drums 160 and 260, which are also in rotation, via scanning lenses 180*b* and 180*c* and mirrors 180*d.* Such optical parts of the writing unit 180 are fixed in place within a housing 180*e,* which bifunctions as part of the frame of the apparatus body. It is to be noted that the two-beam type laser optics is only illustrative and may be replaced with any other suitable writing scheme.

In the illustrative embodiment, the writing unit 180 is positioned below the drums 160 and 260, i.e., in the lower portion of the apparatus body. This makes it needless to form holes in the housing 180*e* for passing the laser beams and therefore enhances the mechanical strength of the housing 180*e.*

Means for forming a latent image and developing it is generally made up of a drum cassette, a cleaning cassette, which is a specific form of the cleaning device, and each developing device. These cassettes and device are constructed into a unit via subsidiary side walls, which will be described later, implementing one image station. Two image stations having an identical configuration are positioned at the right-hand side and left-hand side, respectively; the right and left image stations, as viewed in FIG. 2, constitute the first and second image stations 140 and 240, respectively.

Each image station 140 (240) includes at least the developing device 60 (80), a cleaning cassette 220 (220'), and a drum cassette 1400 (1400'). Because the two image stations 140 and 240 are identical in configuration except for the color of toner, the following description will concentrate on the first image station 140 by way of example.

Figure 3:
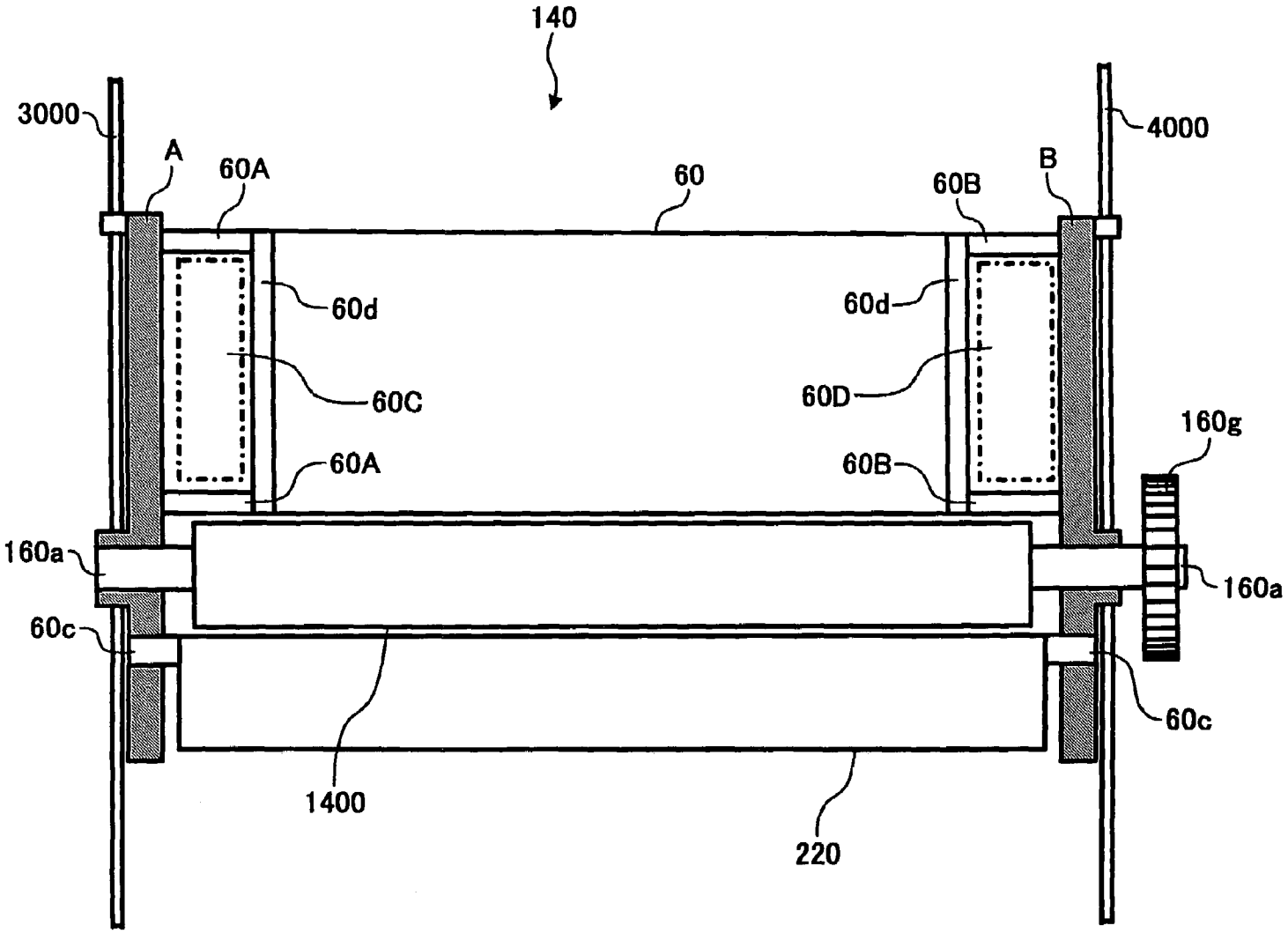
FIG. 3 is a partly sectioned plan view showing first image station included in the apparatus of FIG. 2.

First, reference will be made to FIG. 3 for describing the general construction of the first image station 140. As shown, subsidiary side walls or intermediate members A and B are respectively positioned inward of side walls 3000 and 4000, which form part of the apparatus body. The subsidiary side walls A and B are accurately spaced from each other and held accurately parallel to each other by stays and shafts not shown. The developing device 60 is supported and positioned by the subsidiary side walls A and B at both ends thereof via stud shafts 60A and 60B, so that the developing device 60 is constructed integrally with the subsidiary side walls A and B. The subsidiary side walls A and B are so sized and shaped as to conceal and protect gears, shafts and other drive members and a toner replenishing opening arranged at both sides 60C and 60D of the developing device 60.

Further, the subsidiary side walls A and B support the drum cassette 1400 and cleaning cassette 220 such that they are angularly movable and removable independently of each other. The developing device 60, drum cassette 1400 and cleaning cassette 220 so joined together by the subsidiary side walls A and B constitute the first image station 140. The first image station 140 is affixed to the positioning portions of the side walls 3000 and 4000 via the subsidiary side walls A and B. The subsidiary side walls A and B are removable from the apparatus body at least together with the developing device 60.

Figure 13:
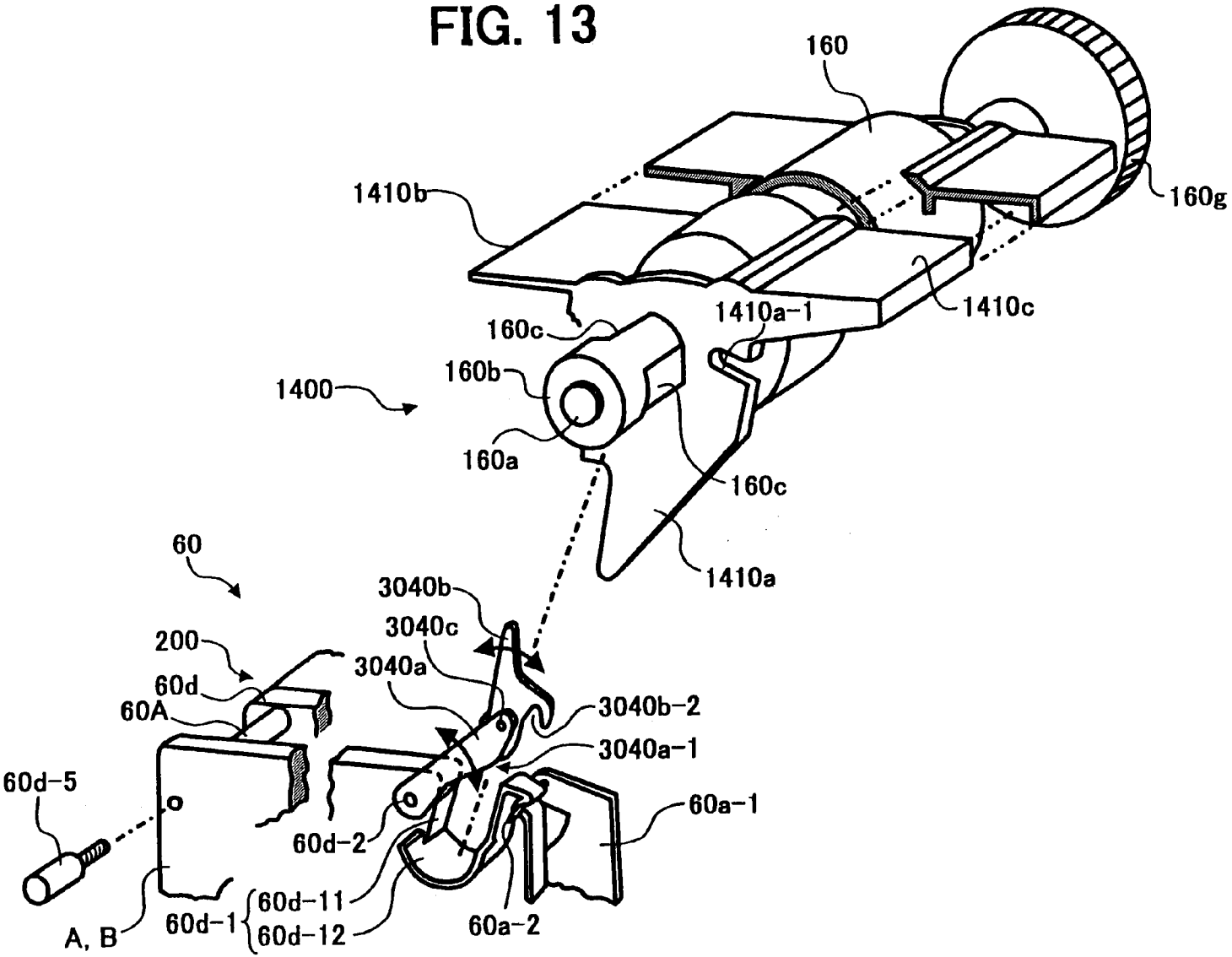
FIG. 13 is a perspective view showing the first image station from which the photoconductive drum has been removed.

As shown in FIG. 13 in detail, the drum cassette 1400 is made up of the drum 160, a rotary shaft 160*a,* a bearing 160*b,* and a holder 1410 for protecting the drum 160 while allowing it to freely rotate. Stated another way, the drum cassette 1400 differs from the conventional process cartridge in that the drum 160 is not constructed integrally with the other process means. The drum 160 is caused to rotate clockwise, as viewed in FIG. 2, by a motor MO mounted on the apparatus body via a driveline including a gear 160*g* and a worm shaft 250, as will be described later with reference to FIG. 21.

As shown in FIG. 2, the developing device 60 includes two developing rollers 320 and 330. As shown in FIG. 3, the drum cassette 1400 is accurately positioned relative to the subsidiary side walls A and B, which accurately support the developing device 60, so that the drum 160 and developing rollers 320 and 330 are accurately positioned relative to each other. In the illustrative embodiment, the drum 160 of the drum cassette 1400 is bare because it has to contact the developing rollers 330 and 320 and cleaning means 210 during image formation. Consequently, when the drum cassette 1400 is dismounted from the apparatus body and put on, e.g., a table, the bare drum 160 is apt to contact the table and be scratched or otherwise damaged thereby.

Figure 12:
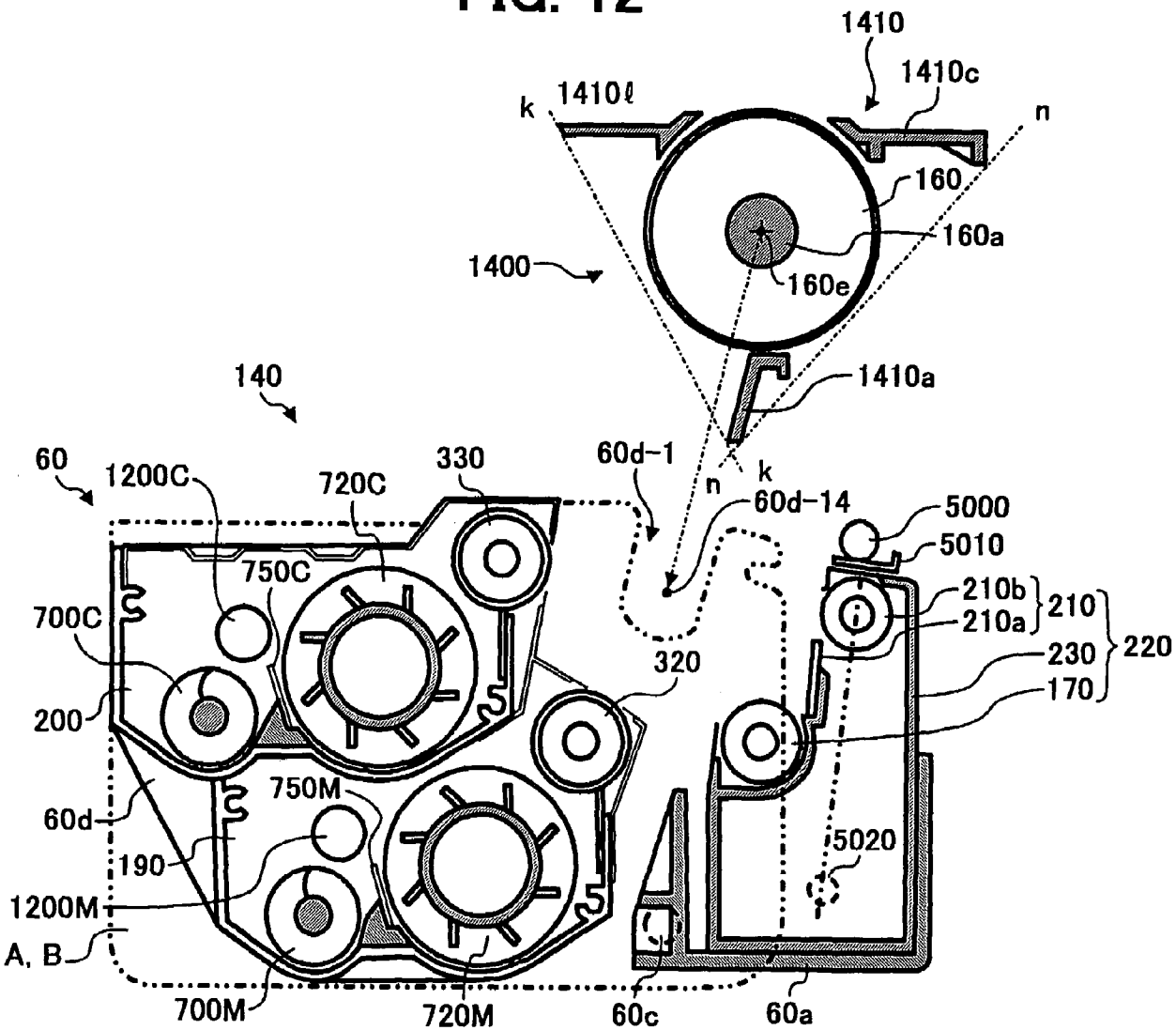
FIG. 12 is a fragmentary section showing the first image station from which a photoconductive drum has been removed.

In light of this, in the illustrative embodiment, the holder 1410 is arranged around the drum 160 as a member subsidiary to the drum 160, as shown in FIG. 12. As shown, the holder 1410 includes projections 1410*a,* 1410*b* and 1410*c* protruding away from the drum 160 at substantially equally spaced locations. A line k—k virtually connecting the ends of the projections 1410*a* and 1410*b* and a line n—n virtually connecting the ends of the projections 1410*a* and 1410*c* are positioned outward of the circumference of the drum 160. In this configuration, even when the drum cassette 1400 is placed on, e.g., a table on the line k—k or n—n in the event of, e.g., replacement, the holder 1410 prevents the bare drum 160 from contacting the table for thereby facilitating replacement.

Figure 39:
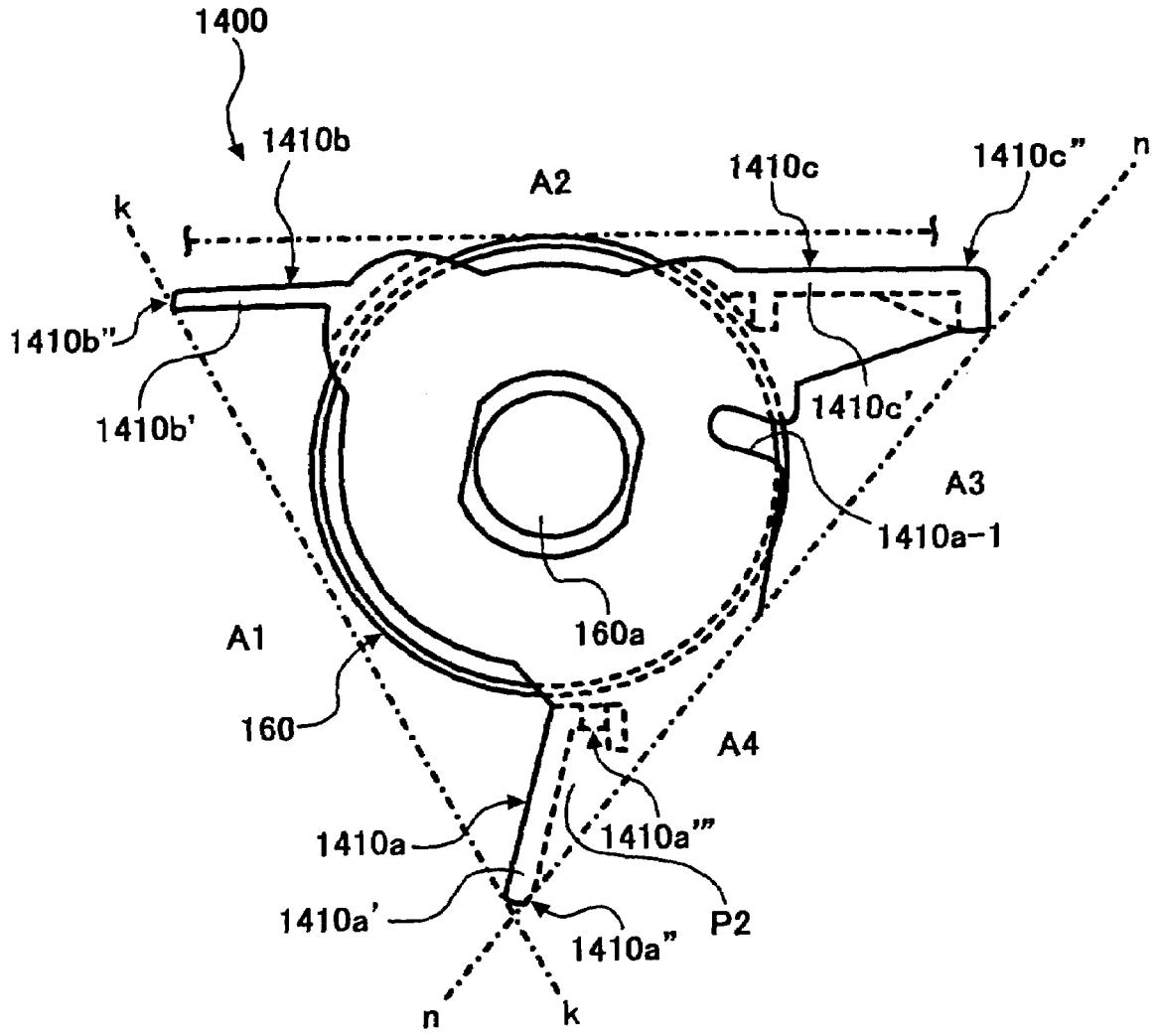
FIG. 39 shows a holder included the drum cassette.

More specifically, as shown in FIG. 39, the projections 1410*a* through 1410*c.* of the holder 1410 have walls 1410*a*', 1410*b*' and 1410*c*', respectively, each extending in parallel to the shaft 160*a* of the drum 160. The walls 1410*a*' through 1410*c*' prevent toner from being scattered out of the developing device 60 and prevent light from leaking to portions other than the exposing portion and discharging portion. The ends of the projections 1410*a* through 1410*c* virtually connected by the lines k—k and n—n are labeled 1410*a*" through 1410*c*", respectively.

A light propagation path P2 is formed in the projection 1410*a* for passing the light beam that scans the drum 160 in accordance with image data. The light beam is not incident to the exposing position of the drum 160 from beneath the drum 160, but incident to the same obliquely upward or obliquely downward, so that the amount of toner to accumulate on a light emission window is too small to influence writing accuracy. A slit 1410''' is formed in the projection 1410*a.*

The projections 1410*a* through 1410*c* divide the circumference of the drum 160 into four zones A1 through A4. In the zone A1, a toner image is formed on the drum 160 while, in the zone A2, the toner image is transferred to the sheet P. In the zone A3, the drum 160 is cleaned after image transfer while, in the zone A4, the surface of the drum 160 is uniformly charged. The wall 1410*b*' of the projection 1410*b,* which isolates the regions A1 and A2, is parallel or substantially parallel to the surface of the belt 100, obviating a wasteful space between the regions A1 and A2 and clearly indicating the order of replacement of the image forming means. Also, the wall 1410*c*' of the projection 1410, which isolates the regions A2 and A3, is parallel or substantially parallel to the surface of the belt 100, obviating a wasteful space between the regions A2 and A3 and clearly indicating the order of replacement of the image forming means.

Referring again to FIG. 12, the drum cassette 1400 is accurately positioned on the subsidiary side walls A and B in order to accurately position the drum 160 and cleaning means 210 and a charge roller or charger 170, which will be described later, relative to each other. The cleaning cassette 220 supporting the cleaning means 210 and charge roller 170 is also accurately positioned on the subsidiary side walls A and B relative to the drum cassette 1400. Further, the cleaning cassette 220 is pivoted to the subsidiary side walls A and B such that it is movable into and out of contact with the drum 160.

The configuration of the drum cassette 1400 and the positional relation of the developing device 60 and cleaning cassette 220 to the cassette 1400 described above allows the drum 160 to be replaced alone. Stated another way, the time for replacing the drum cassette 1400 can be determined only on the basis of the life of the drum 160. This is the point of the illustrative embodiment and clearly distinguishes the illustrative embodiment from the conventional process cartridge. More specifically, the illustrative embodiment (i) allows only a member that should be replaced to be replaced for thereby obviating waste.

Furthermore, the subsidiary side walls A and B can be dismounted from the apparatus body relative to the side walls 3000 and 4000 while supporting the developing device 60, i.e., the developing device 60 is replaceable. In addition, after the subsidiary side walls A and B have been so dismounted, the drum cassette 1400 and cleaning cassette 220 each can be removed from the subsidiary side walls A and B. This means that the developing device 60 is replaced substantially alone together with the subsidiary side walls A and B, obviating waste.

As for the replacement of the developing device 60 by the user, the driveline including gears and shafts and toner replenishing opening are exposed to the outside on the end walls of the developing device 60 in order to facilitate mounting and dismounting, as described in Laid-Open Publication No. 20000-298315 as well. In this configuration, however, the user is apt to touch such exposed parts and suffer from smears or hurts when removing the developing device 60. In addition, it is likely that the exposed parts are damaged if directly hit against, e.g., the floor. To solve these problems, in the illustrative embodiment, the subsidiary side walls A and B conceal the exposed parts.

If the drum cassette 1400, like the drum 160, can be dismounted from the apparatus body alone before the developing device 60 or the cleaning cassette 220, then the replacement of the drum cassette 1400, which is frequent, will be facilitated also. More specifically, the drum 160, i.e., drum cassette 1400 is replaced more often than the other process units. In this sense, wastefully removing the developing device 60 and cleaning cassette 220 together with the subsidiary side walls A and B at the time of replacement of the drum cassette 220 would be troublesome, would lower appliance, and would smear the user's hand and surroundings.

In light of the above, the illustrative embodiment (ii) allows only a unit that should be replaced to be dismounted from the apparatus body and (iii) allows a unit of the kind needing frequent replacement to be dismounted with the highest priority. These are also the points of the illustrative embodiment and clearly distinguish the illustrative embodiment from the conventional process cartridge.

In the illustrative embodiment, the points (i) through (iii) are applied to the other cassettes and units as well. The drum 160 and 260 each may be implemented as a photoconductive belt, if desired.

The life of the drum 160 that determines the time for replacing the drum cassette 1400 will be described hereinafter. Recently, technologies relating to photoconductive materials have extended the life of the drum 160 to one corresponding to 400K prints to 500K prints, which is four or five times as long as the traditional life. On the other hand, when the diameter of the drum 160 is reduced to reduce the size and weight of the apparatus or when a plurality of developing sections are assigned to a single drum 160 as in FIG. 2, specifications and structural conditions required of the apparatus become severe, accelerating the exhaustion of the drum 160. More specifically, although the life and durability of a photoconductive material may be enhanced, the frequency of replacement cannot and will not be reduced so long as it is driven hard. The lives of the other process devices are also extending.

As shown in FIG. 2, the cleaning cassette 220 includes a charge roller or charger 170 for uniformly charging the surface of the drum 160. Cleaning means 210 is made up of a cleaning blade or cleaning means 210*a* (210*a*' at the second image station) for removing residual toner and dust from the surface of the drum 160 and a seal roller or cleaning means 210*b* (210*b*' at the second image station) for preventing toner from flying about during cleaning. A cleaning case 230 holds such components and stores collected or waste toner.

More specifically, the charge roller 170 and seal roller 210*b* are rotatably mounted on the cleaning case 230 and operatively connected to the drum 160 by gear trains not shown. The drum 160 is driven by a driving force transmitted thereto via the worm gear 250 and gear 160*g*, see FIG. 21. When the drum cassette 1400 is mounted to or dismounted from the subsidiary side walls A and B, the charge roller 170 and seal roller 210*b* are brought into or out of, respectively, mesh with the gear trains. To minimize wasteful replacement, the charge roller 170 and cleaning means 210 that deteriorate due to fatigue are provided with substantially the same life corresponding to, e.g., 400K to 500K prints.

Figure 10:
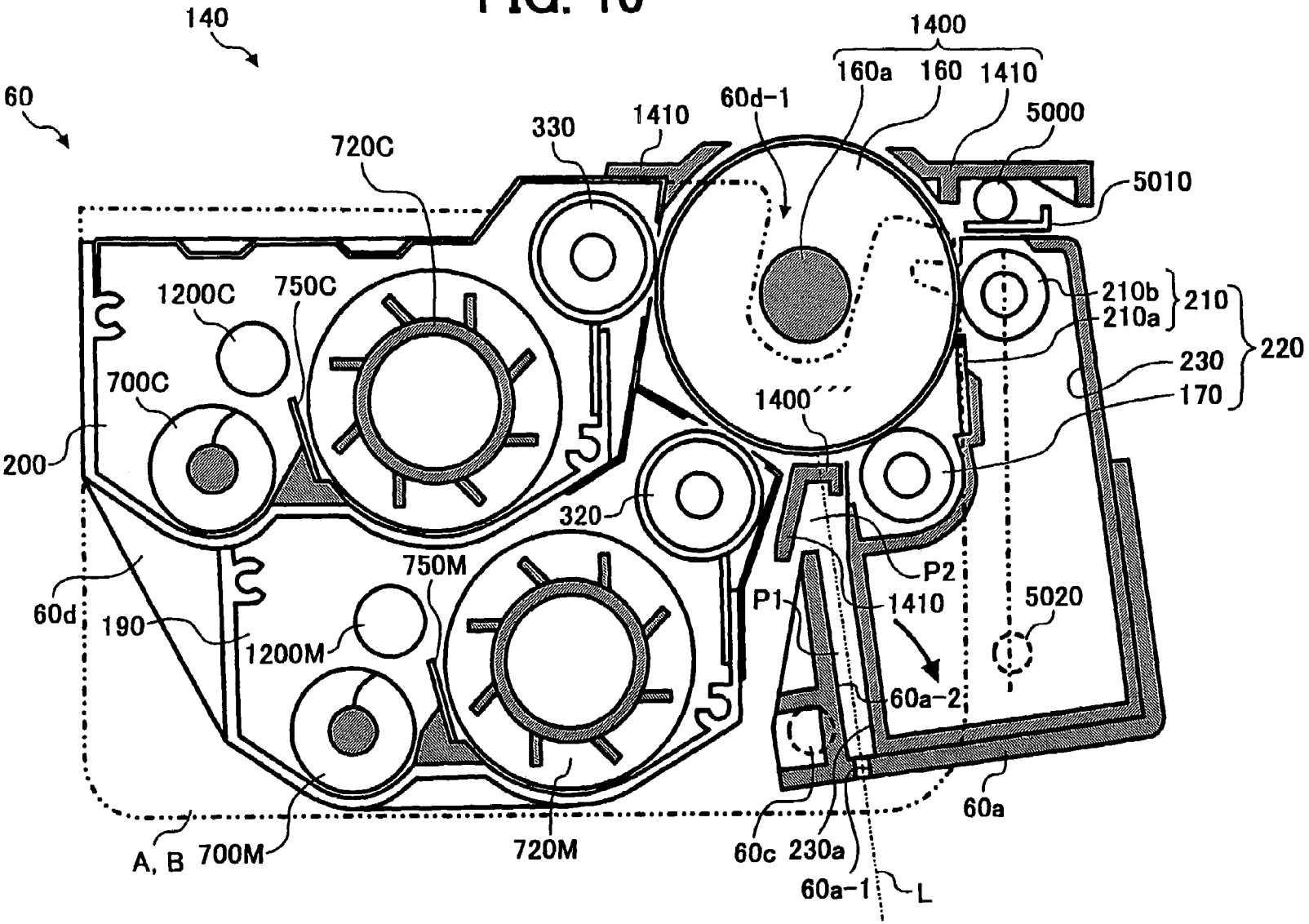
FIG. 10 is a fragmentary section showing the first image station.
Figure 11:
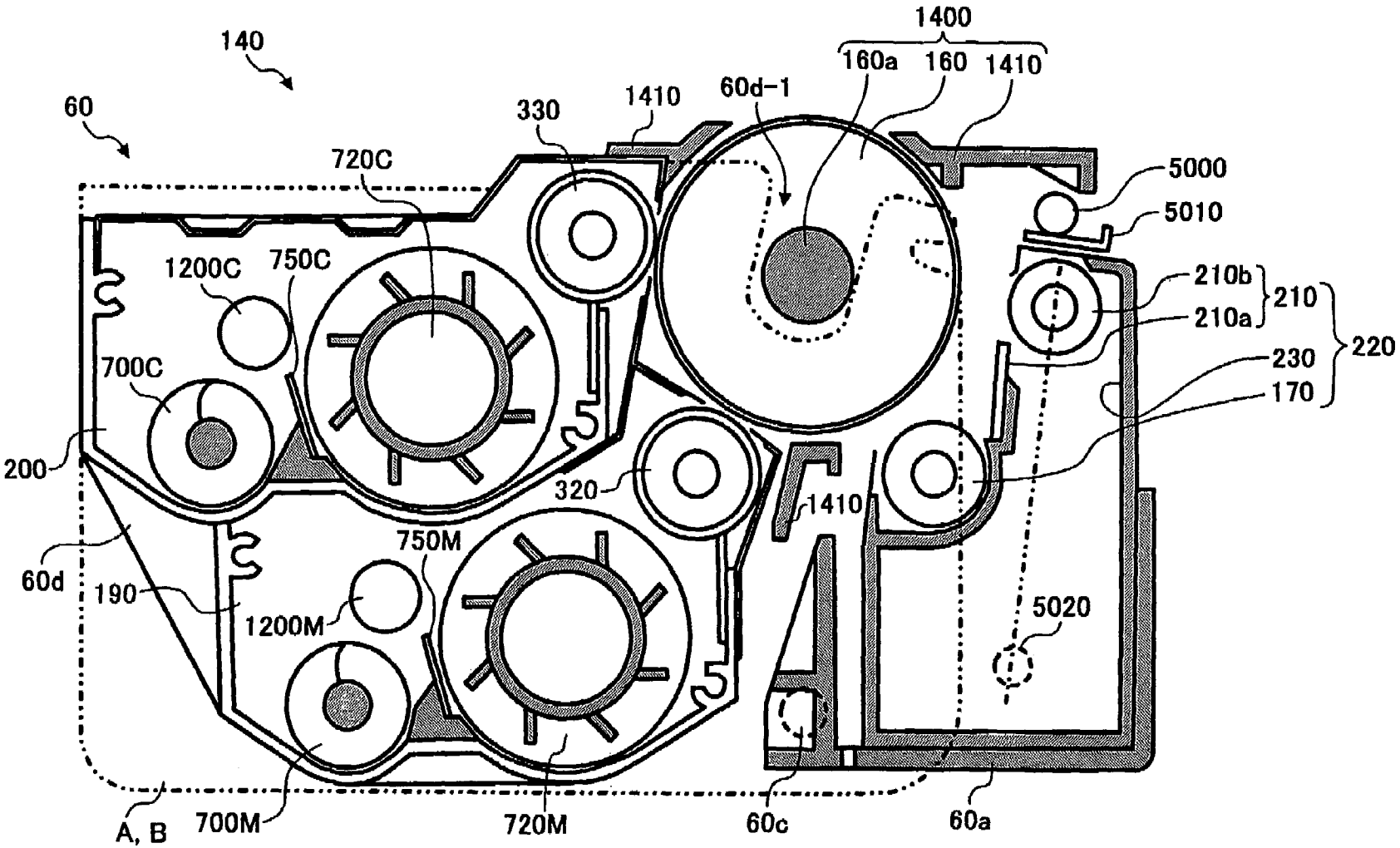
FIG. 11 is a fragmentary section showing the first image station.
Figure 14:
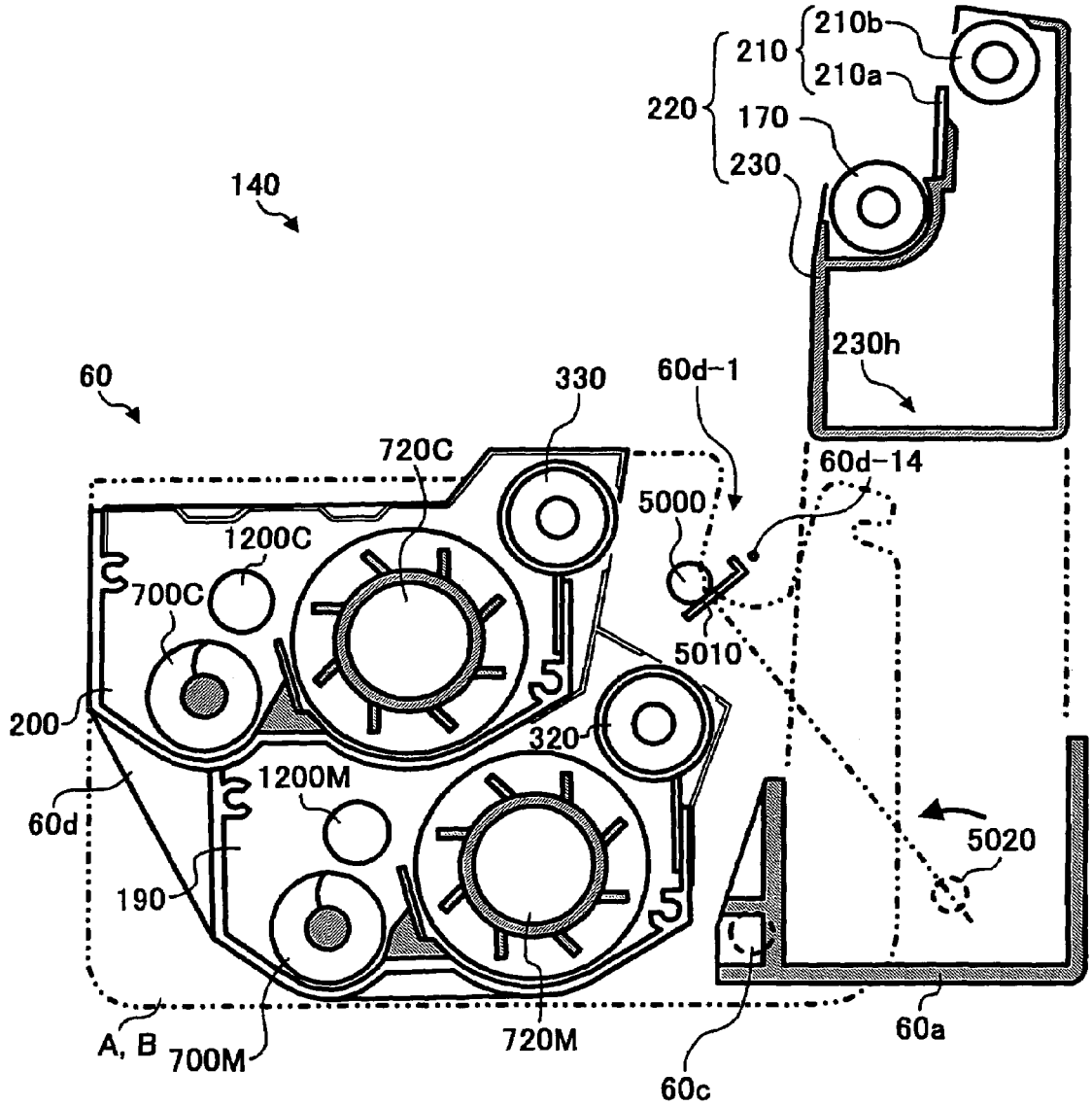
FIG. 14 is a fragmentary section showing the first image station from which a cleaning cassette has been removed.

The space available in the cleaning case 230 for storing waste toner is selected such that the space is filled up with waste toner before the life of the charge roller 170 and that of the cleaning means 210 end. As shown in FIGS. 10 and 11, the cleaning cassette 220 is received in and affixed to a cassette case or cleaning device case 60*a* mounted on the subsidiary side walls A and B and therefore accurately positioned relative to the drum cassette 1400 and drum 160. Further, as shown in FIG. 14, the cleaning cassette 220 is removably mounted to the cassette case 60*a* so as to be replaceable alone. The cleaning cassette 220, like the drum cassette 1400, is positioned on and affixed to the subsidiary side walls A and B and removable alone while being movable toward and away from the drum cassette 1400.

To meet the increasing demand for the size reduction of the apparatus and that of the drum 160, it is necessary to locate the cleaning cassette 220 around the drum 160, i.e., in a broad space extending from the right side toward the bottom of the drum 160, as viewed in FIG. 2. The cleaning cassette 220 therefore cannot be removed upward unless the drum cassette 1400 positioned above the cleaning cassette 220 is removed from the subsidiary side walls A and B beforehand. The arrangement in which the drum cassette 1400 is positioned above the cleaning cassette 220 not only miniaturizes the apparatus body, but also allows the cassette 1400, which is replaced most frequently, to be easily removed with the highest priority. Further, such an arrangement prevents the user from removing the cleaning cassette 220 before removing the drum cassette 1400. This clearly shows an operation to be performed next and therefore enhances appliance. In addition, the user is prevented from performing erroneous replacement or damaging parts in the event of replacement.

Moreover, the drum 160 and developing device 60 each are removable in a direction perpendicular to its axis. Should the drum 160 or the developing device 60 be removed in the axial direction, the drum 160, for example, might contact drive means assigned thereto and might be damaged thereby.

When the cleaning cassette 220 is filled with waste toner, information urging the user to remove the cleaning cassette 220 is output. While the illustrative embodiment uses the charge roller 170 and cleaning blade 210*a* and seal roller 210*b* as a charger and cleaning means, respectively, they are only illustrative. This is also true when use is made of a cleaningless cassette.

As shown in FIG. 10, the cleaning cassette 220 is configured to pass a light beam L for writing a latent image therethrough. More specifically, the light beam L issuing from the writing unit 180 toward the drum 160 is propagated through a slot 60*a*-1 formed in the bottom of the cassette case 60*a* and a path or space P1 substantially parallel to the light beam L. The path P1 is formed between the right inner surface 60*a*-2 of the cassette case 60*a* and the left outer surface. 230*a* of the cleaning case 230. The path P1 is closed except for its inlet and outlet.

While the cleaning cassette 220 is made up of the cleaning case 230 and cassette case 60*a*, the cleaning case 230 and cassette case 60*a* may be constructed integrally with each other in order to broaden the space available in the cleaning case 230, if desired. In such a case, the light beam L will be propagated through the space of the cleaning case 230, so that the slot 60*a*-1 and path P1 should be configured to insure the propagation of the light beam L. Also, the above integral configuration prevents dust and disturbing light from entering the path P1.

Figure 40:
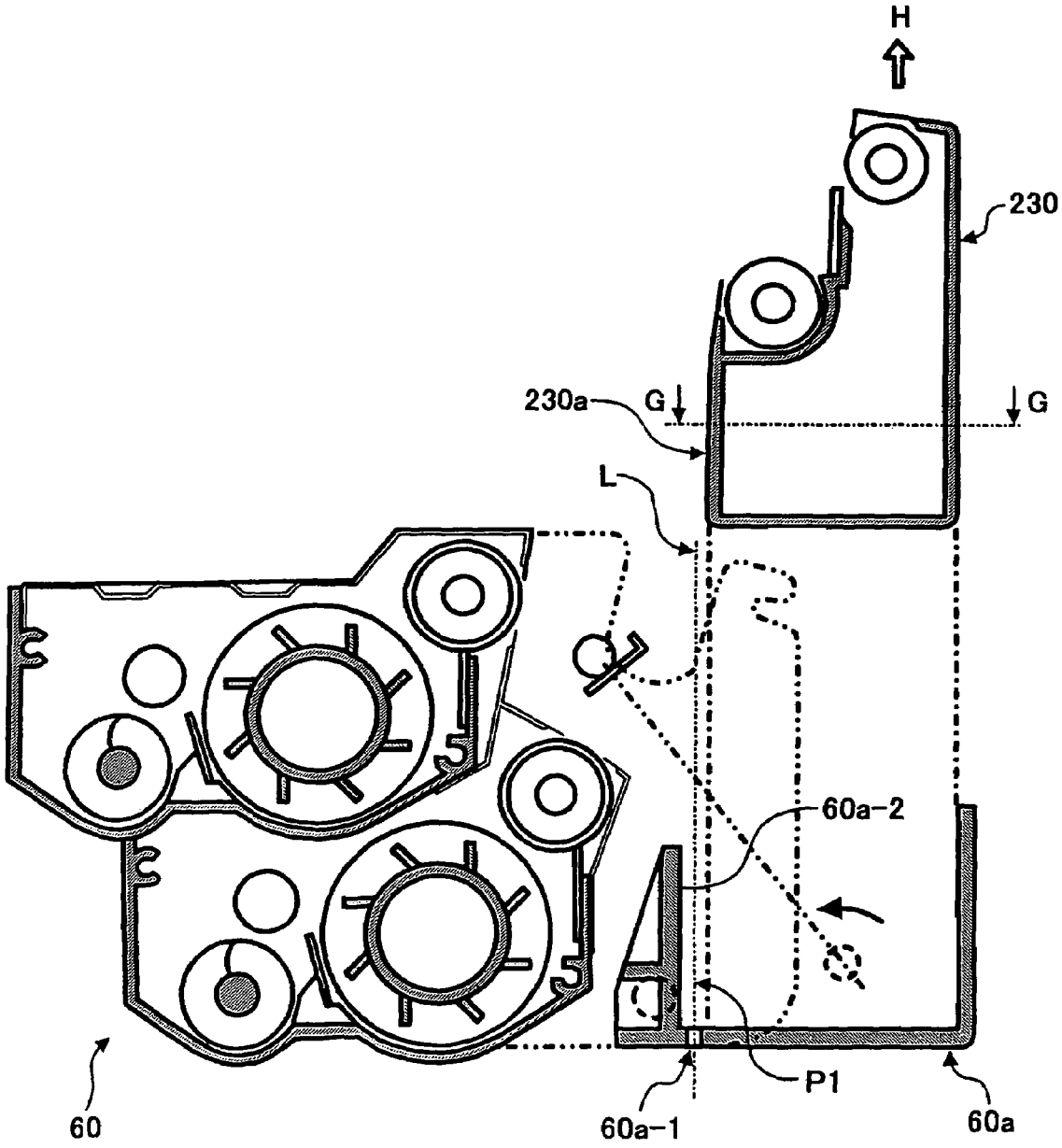
FIG. 40 shows a condition wherein the cleaning cassette is dismounted from the apparatus body.
Figure 41:
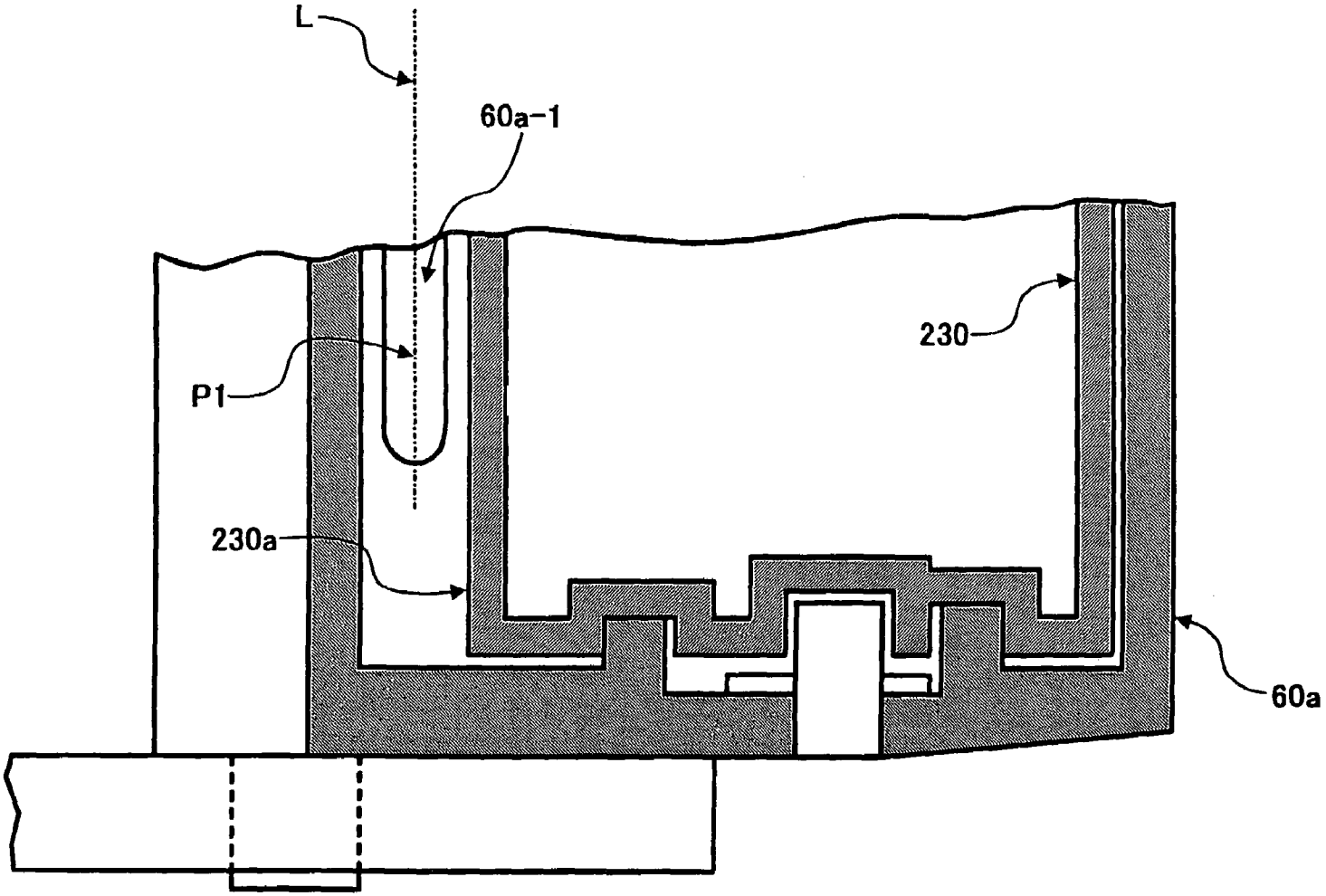
FIG. 41 is a section along line G—G of FIG. 40.

FIG. 40, as well as FIG. 14, shows the cleaning case 230 removed from the cassette case 60*a* in a direction indicated by an arrow H. FIG. 41 is a section along line G—G of FIG. 40. As shown, the left outer surface 230*a* of the cleaning case 230 is made flat in order to form the path P1 substantially parallel to the light beam L and to facilitate fabrication.

Figure 42:
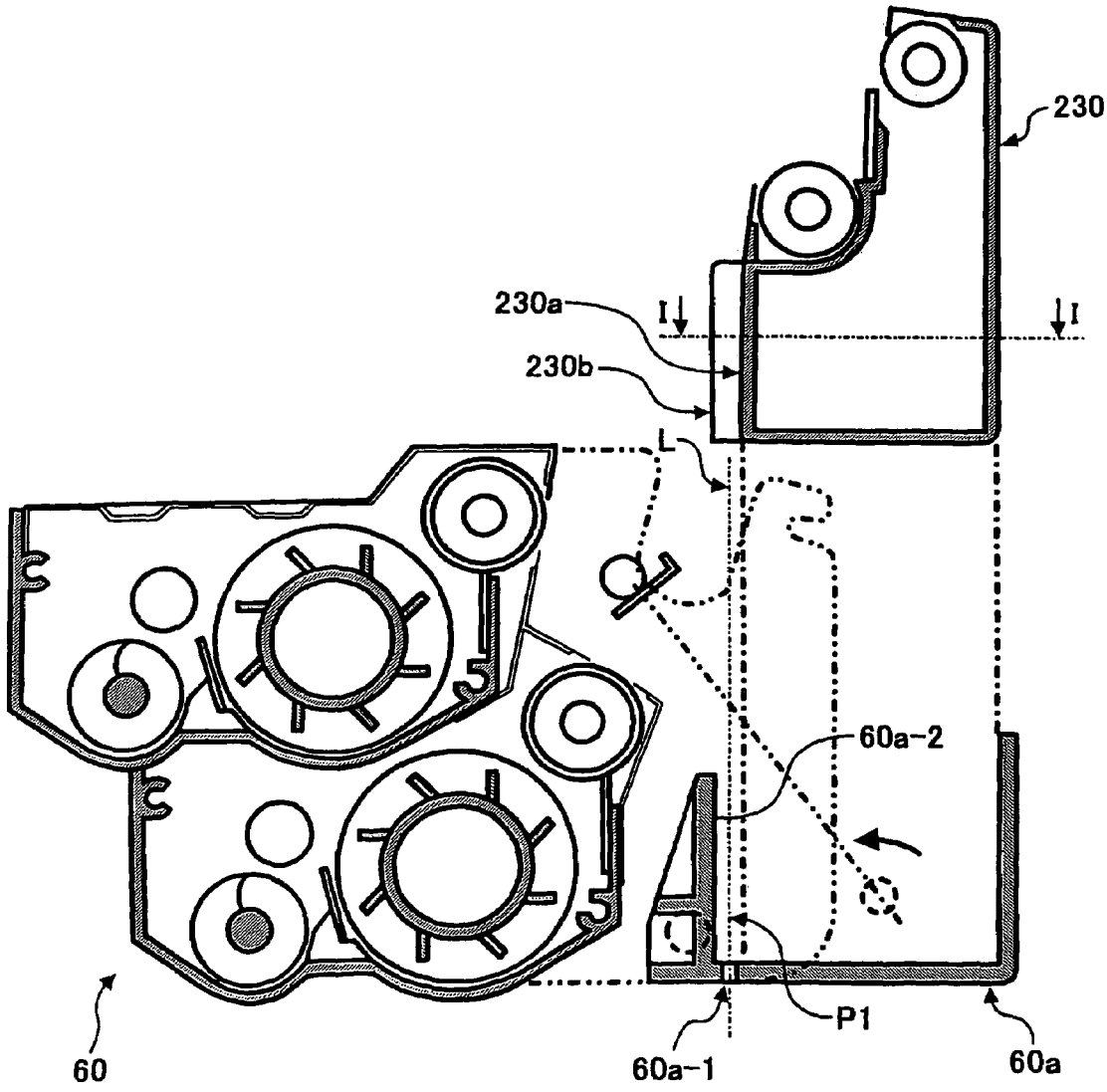
FIG. 42 shows a condition wherein the cleaning cassette is dismounted from the apparatus body.
Figure 43:
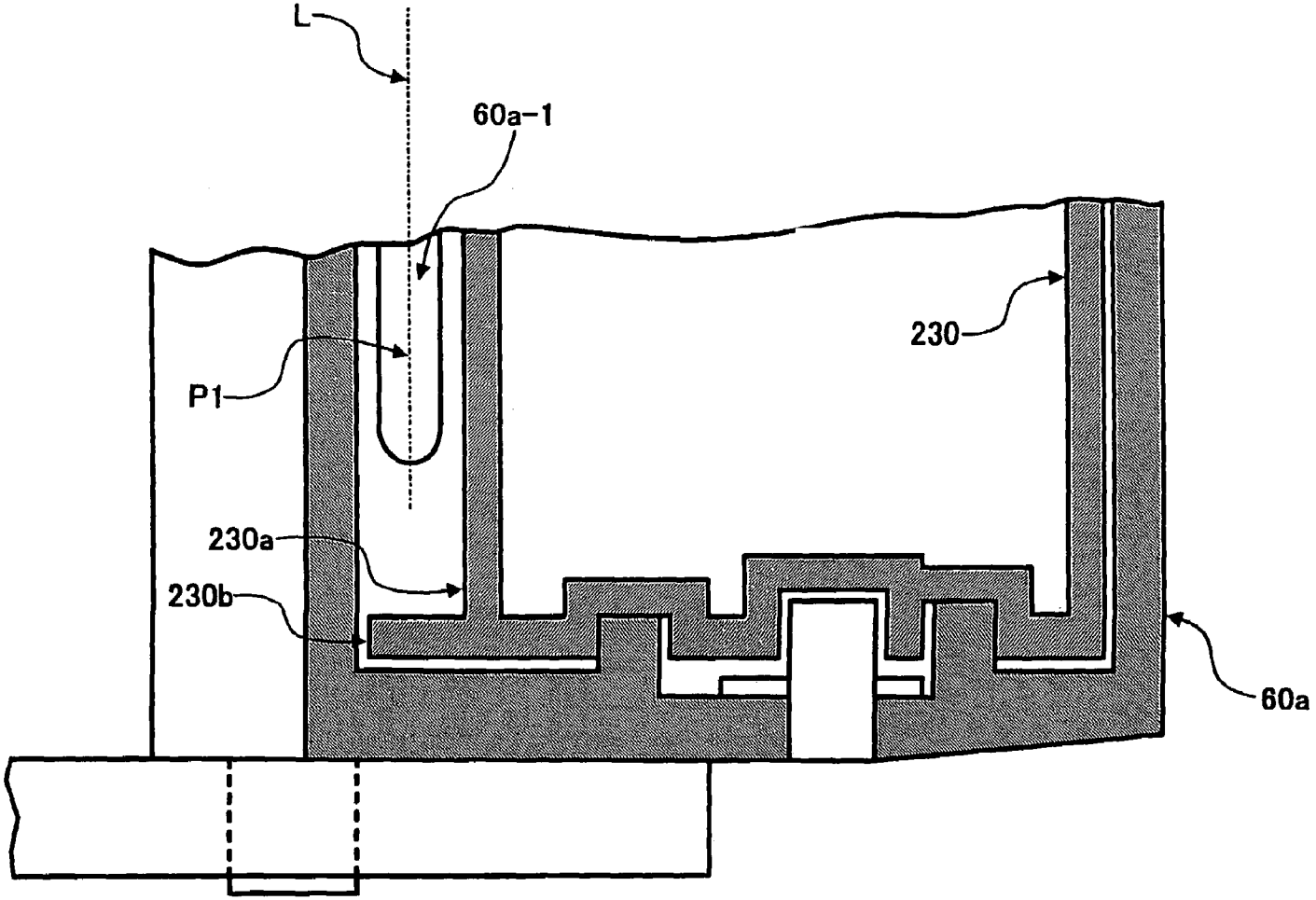
FIG. 43 is a section along line I—I of FIG. 42.

FIG. 42 shows another specific configuration of the cleaning case 230. FIG. 43 is a section along line I—I of FIG. 42. As shown, the front end of the left outer surface 230*a* of the cleaning case 230 is extended toward the slot 60*a*-1 in the form of a generally U-shaped portion 230*b* that forms the path P1.

Figure 44:
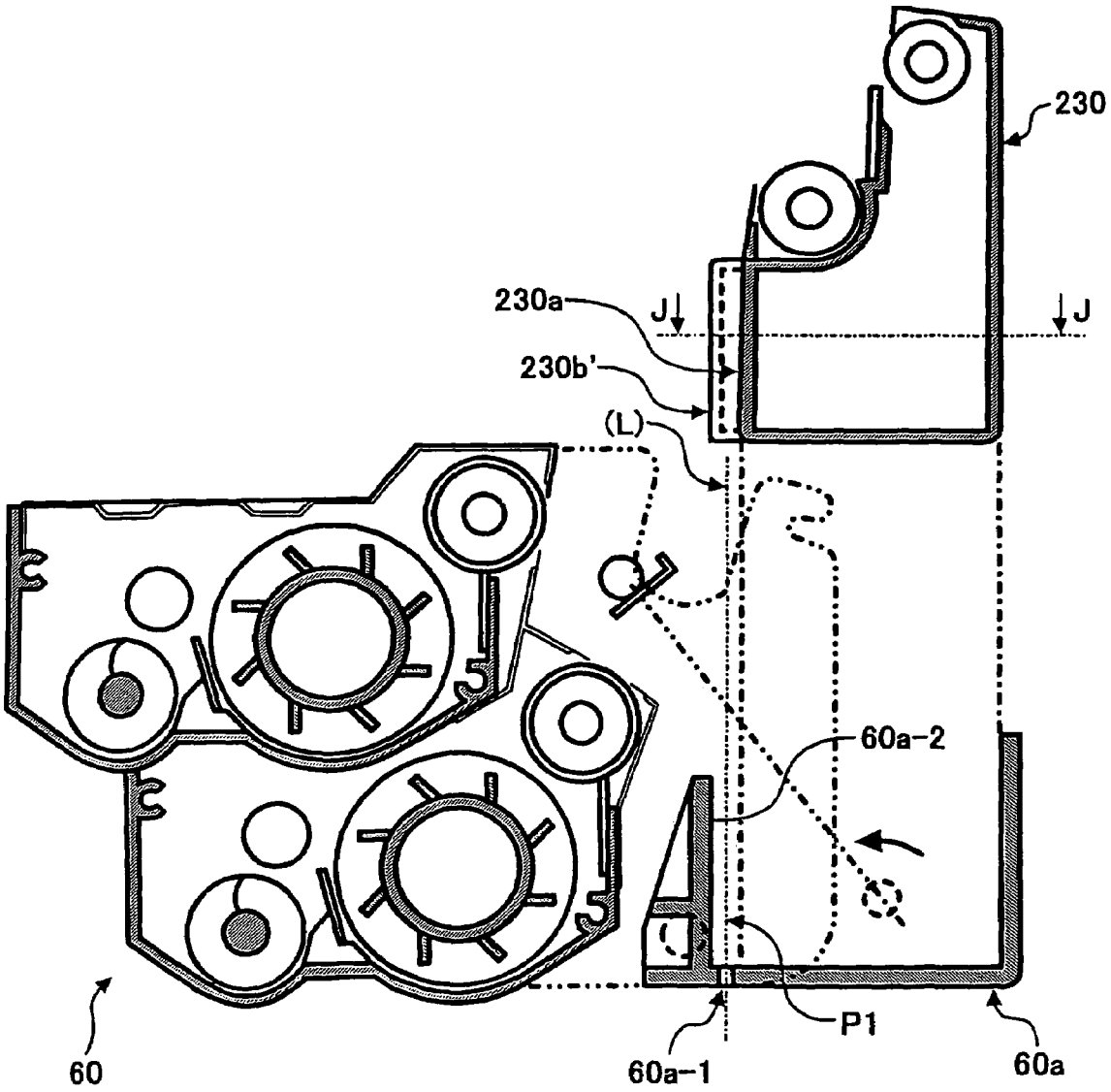
FIG. 44 shows a condition wherein the cleaning cassette is dismounted from the apparatus body.
Figure 45:
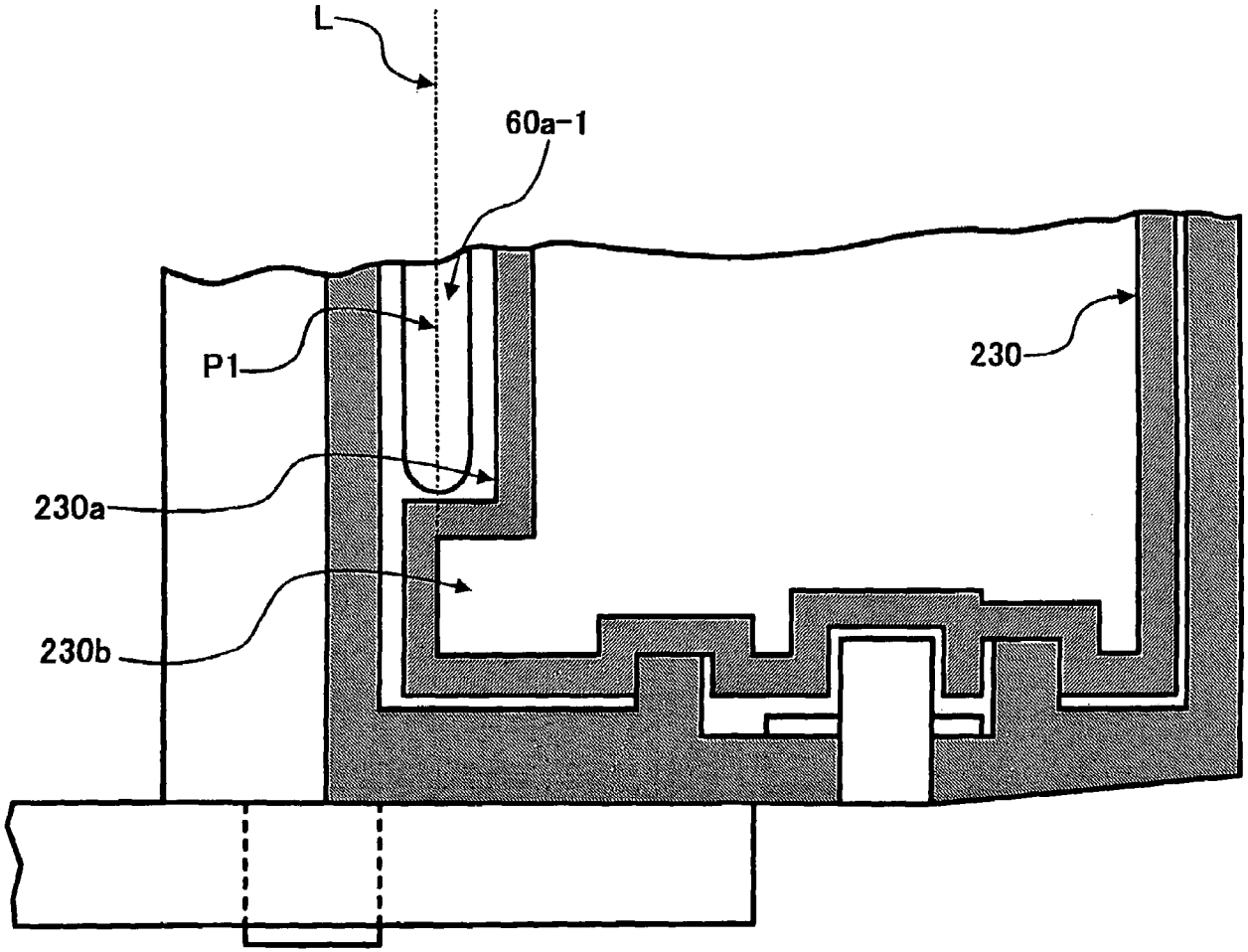
FIG. 45 is a section along line J—J of FIG. 42.

FIG. 44 shows still another specific configuration of the cleaning case 230. FIG. 45 is a section along line J—J of FIG. 44. As shown, the cleaning case 230 additionally includes a portion 230*b*' for storing waste toner. The portion 230*b*', coupled with the U-shaped portion 230*b* of FIGS. 42 and 43, increases the space available for storing waste toner.

While the image forming means constructed independently of each other have the previously stated advantages, clearances are not avoidable between nearby image forming means because a cartridge case, for example, does not cover the image forming means like the process cartridge does. Such clearances, which bring about the scattering and leakage of toner or the entry of disturbing light, must be dealt with by toner or light shielding means. The extra shielding means, however, makes the construction sophisticated and increases the cost. Although minimum shielding means is necessary, flying toner or disturbing light should only be intercepted so long as image formation is insured.

In any case, part of the cleaning cassette 220 forms the path P1 and conceals the light beam L and therefore serves to prevent dust and external light from entering the path P1 as well. The illustrative embodiment additionally forms path P2 between the outlet of the path P1 and the drum 160 for the same purpose. More specifically, as shown in FIGS. 10 and 39, the projection 1410*a* of the holder 1410 is generally U-shaped and open toward the light beam L coming out of the cleaning cassette 220. The slit 1410*a*-1 also stated earlier is formed in the upper end of the projection 1410*a* adjacent the drum 160.

The path P2 formed in the holder 1410 of the drum cassette 1400 and the path P1 formed in the cleaning cassette 220 are aligned with each other to constitute a single path extending from the writing device 180 to the drum 160.

As stated above, the illustrative embodiment reduces the size of the apparatus and protects the light beam L from scattering toner and external light while increasing the capacity for storing waste toner. In the illustrative embodiment, scattering toner and disturbing light are preventing from entering the path constituted by the paths P1 and P2 and slot 60*a*-1 in the front-and-rear direction or the right- and left direction, as stated above. However, the problem is the toner or similar dust that drops into the path via the slot 1410*a*''' formed in the projection 1410*a* of the holder 1410, i.e., at the top of the path P2. A specific configuration for coping with such toner or similar dust will be described with reference to FIG. 46.

Figure 46:
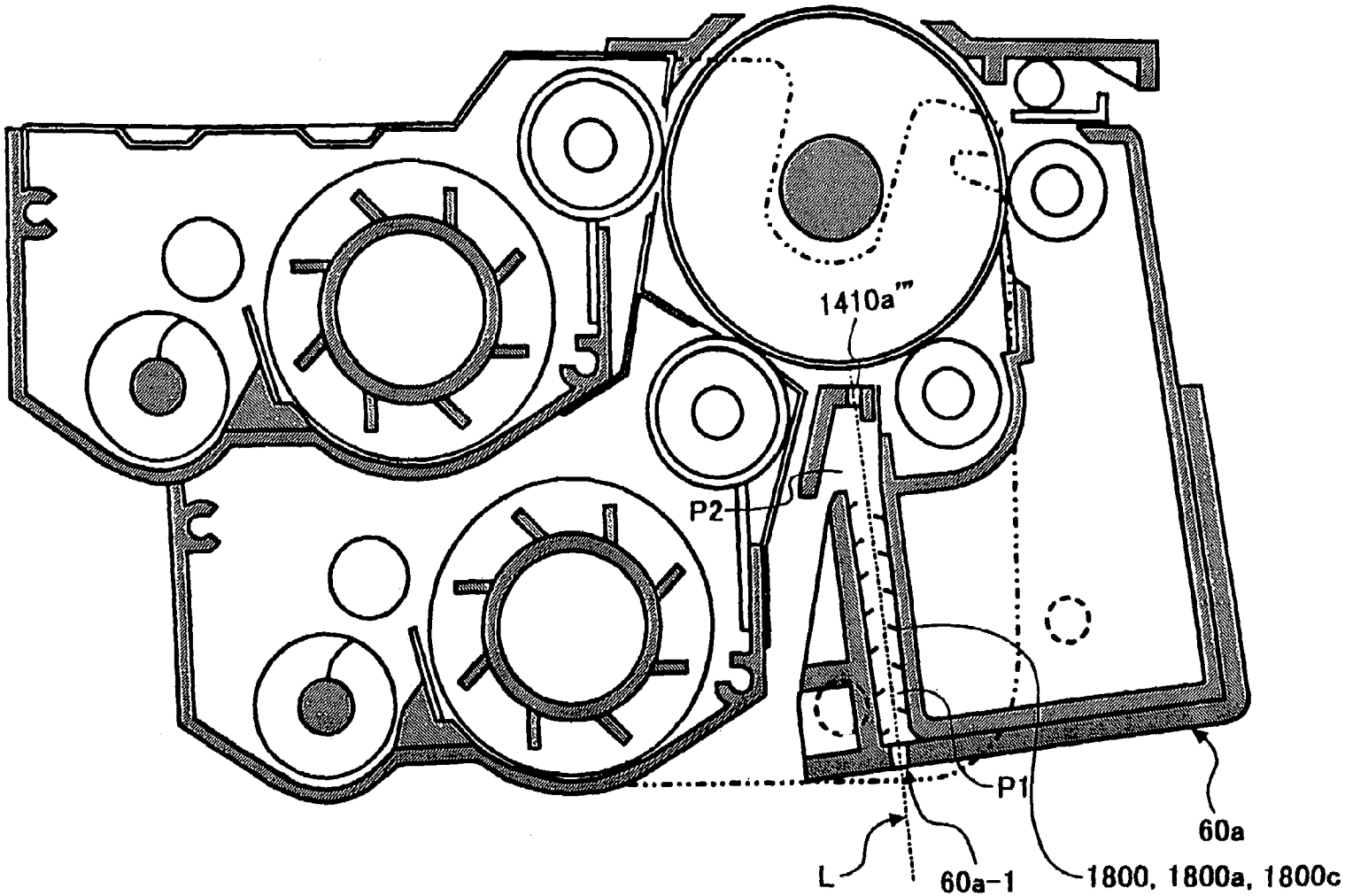
FIG. 46 shows a specific configuration of dust collecting means included in the cleaning cassette.

As shown in FIG. 46, dust collecting means 1800 is provided on the wall of the path P1 for collecting the toner, paper dust or similar dust entered the path P1 via the slot 1410*a*''' before such dust reaches the writing unit 180. The dust collecting means 1800 is implemented as a plurality of flat fins 1800*a* formed on the left inner surface 60*a*-2 of the cassette case 60*a* and the left outer surface 230*a* of the cleaning case 230. The fins 1800*a* are directed generally upward in the direction of gravity in order to surely catch dust dropping downward. Alternatively, adhesive members, which are simpler than the fins 1800*a*, may be affixed to the wall of the path P1.

The dust collecting means 1800 additionally includes an inclined portion 1800*c*. At least when the writing unit 180 writes a latent image on the drum 160, the inclined portion 1800*c* causes the path P1 to incline. More specifically, the dust entered and floating in the path P1 drops in due course in the direction of gravity toward the writing unit 180. Therefore, if the path P1, i.e., a line virtually connecting the slot 1410*a*''' of the holder 1410 and the slot 60*a*-1 of the cassette case 60*a* is vertical, then the dust undesirably deposits on the writing unit 180. In this sense, the deposition of the dust on the writing unit 180 can be reduced if the path P1, i.e., the above line is slightly inclined as represented by the inclined portion 1800*c*.

Referring again to FIG. 2, the developing device 60 made up of the magenta section 190 and cyan section 200 and cassette case 60*a* accommodating the cleaning cassette 220, which positions the charge roller 170 and cleaning means 210 relative to the drum 160, are mounted on the subsidiary side walls A and B. In addition, the drum cassette 1400 is mounted on the subsidiary side walls A and B.

As for the cyan section 200, fresh cyan toner is replenished to one end portion of a screw conveyor 700C via a tubular shaft 1200C, which forms a toner replenishing opening. The cyan toner conveyed by the screw conveyor 700C into the cyan section 200 is conveyed by a paddle roller 720C in the opposite direction and agitated thereby while being fed to the developing roller 330. A partition 750C isolates the screw conveyor 700C and paddle roller 720C from each other so as to prevent the toner being conveyed in the opposite directions from being mixed together.

The magenta section 190 is identical in configuration and operation with the cyan section 200 except that it includes a tubular shaft 1200M for the replenishment of magenta toner, a screw conveyor 700M, a paddle roller 720M, and a partition 750M.

The developing device 80 included in the second image station 240 and made up of the yellow section 290 and black section 300 is identical in configuration and operation with the developing device 60 except for the color of toner used.

To switch the color at the first image station 140, while the drum 160 is in rotation, one of the cyan section 200 with the developing roller 330 and the magenta section 190 with the developing roller 320 is rendered operative while the other of them is rendered inoperative. Two different types of color switching means are available with the illustrative embodiment, as will be described hereinafter.

Figure 4:
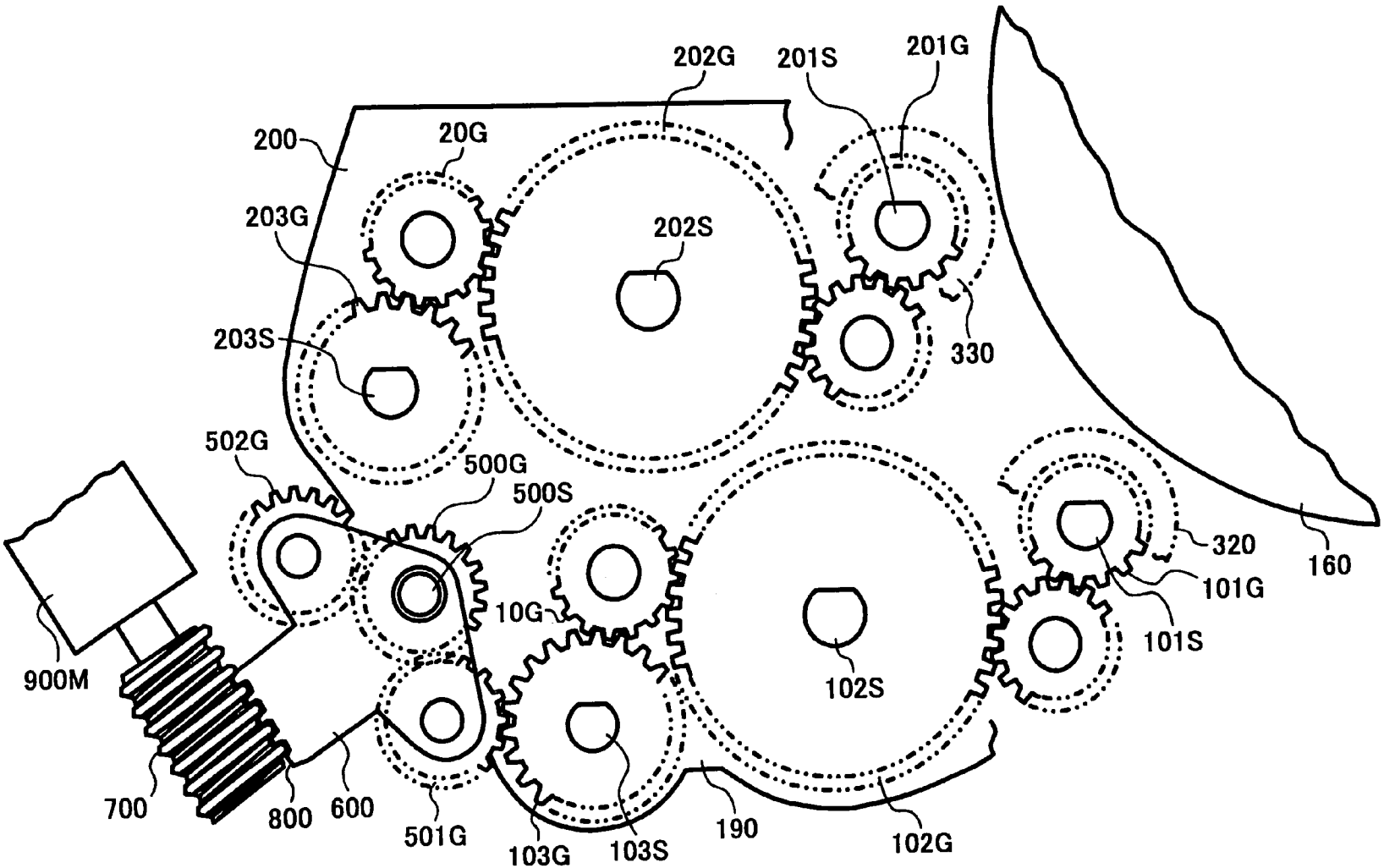
FIG. 4 shows a gear train constituting a driveline for a developing device included the apparatus of FIG. 2.
Figure 5:
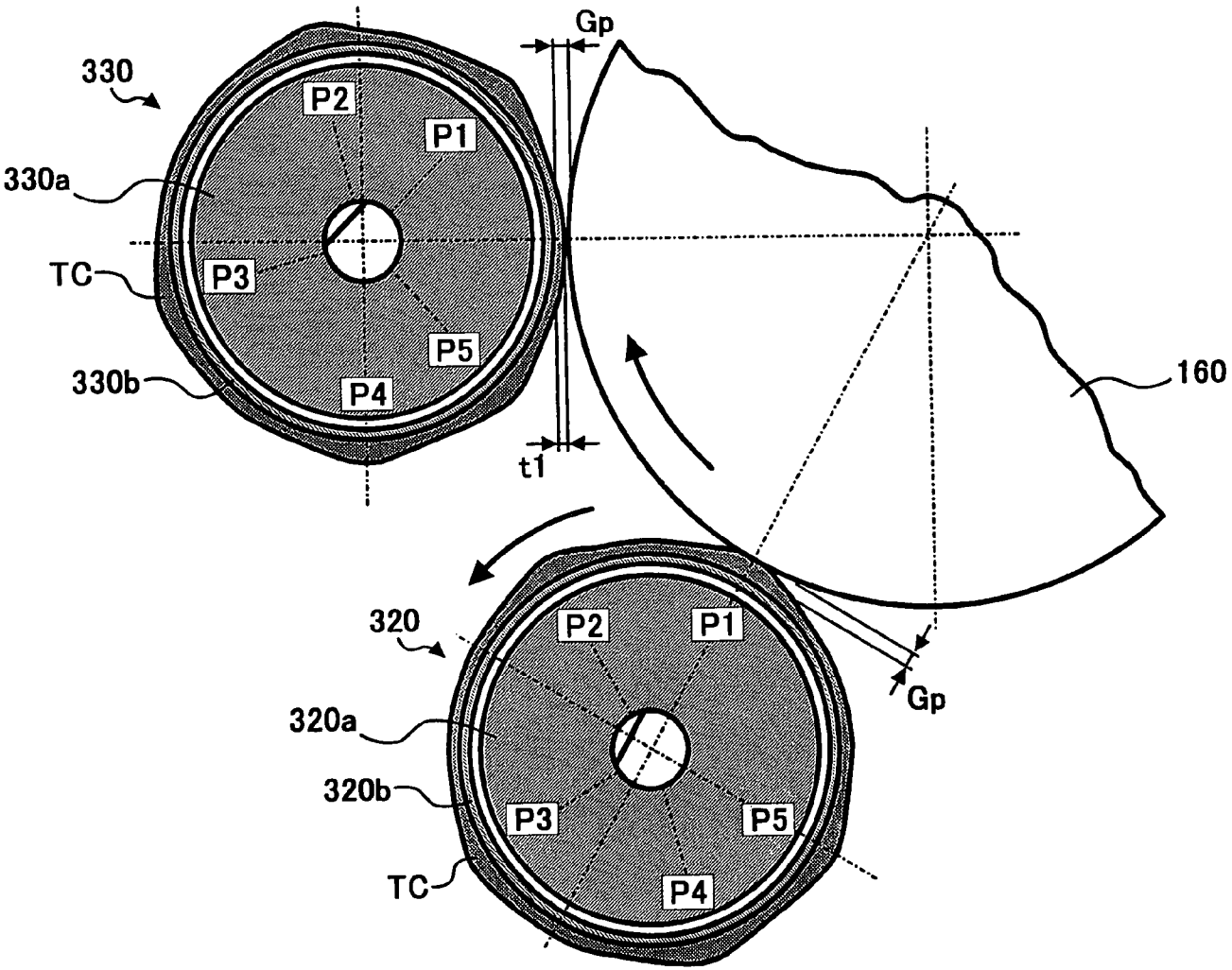
FIG. 5 shows two developing rollers included in the developing device of FIG. 4, one of which is operative while the other of which is inoperative.

Type 1 (See FIGS. 4 and 5)

Color switching means of Type 1 will be described, taking the developing device 60 as an example. Briefly, this color switching means not only switches the operating state of the developing roller 320, but also switches the positions of magnetic poles disposed in the developing roller 320 to thereby bring a developer into or out of contact with the drum 160.

First, means for switching the operating state of the developing roller 320 will be described. As shown in FIG. 4, gears 102G and 103G are respectively mounted on the shafts 102S and 103S of the paddle roller 720M and screw conveyor 700M of the magenta section 190 at the outside of one of opposite end walls of the magenta section 190. The gears 102G and 103G both are held in mesh with an intermediate idle gear 10G. Likewise, gears 102G and 101G are respectively mounted on the shafts 102S and 101S of the paddle roller 720M and developing roller 320 and operatively connected to each other via an intermediate idle gear.

As also shown in FIG. 4, in the cyan section 200, gears 202G and 203G are respectively mounted on the shaft 202S of a paddle roller 720C and the shaft 203S of the screw conveyor 700C and connected to each other via an intermediate idle gear 20G. Likewise, the gear 202G and a gear 201G mounted on the shaft 201S of the developing roller 330 are connected to each other via an intermediate idle gear. A drive source drives the developing rollers 320 and 330 in a direction indicated by an arrow via the gears 103G and 203G.

Figure 17:
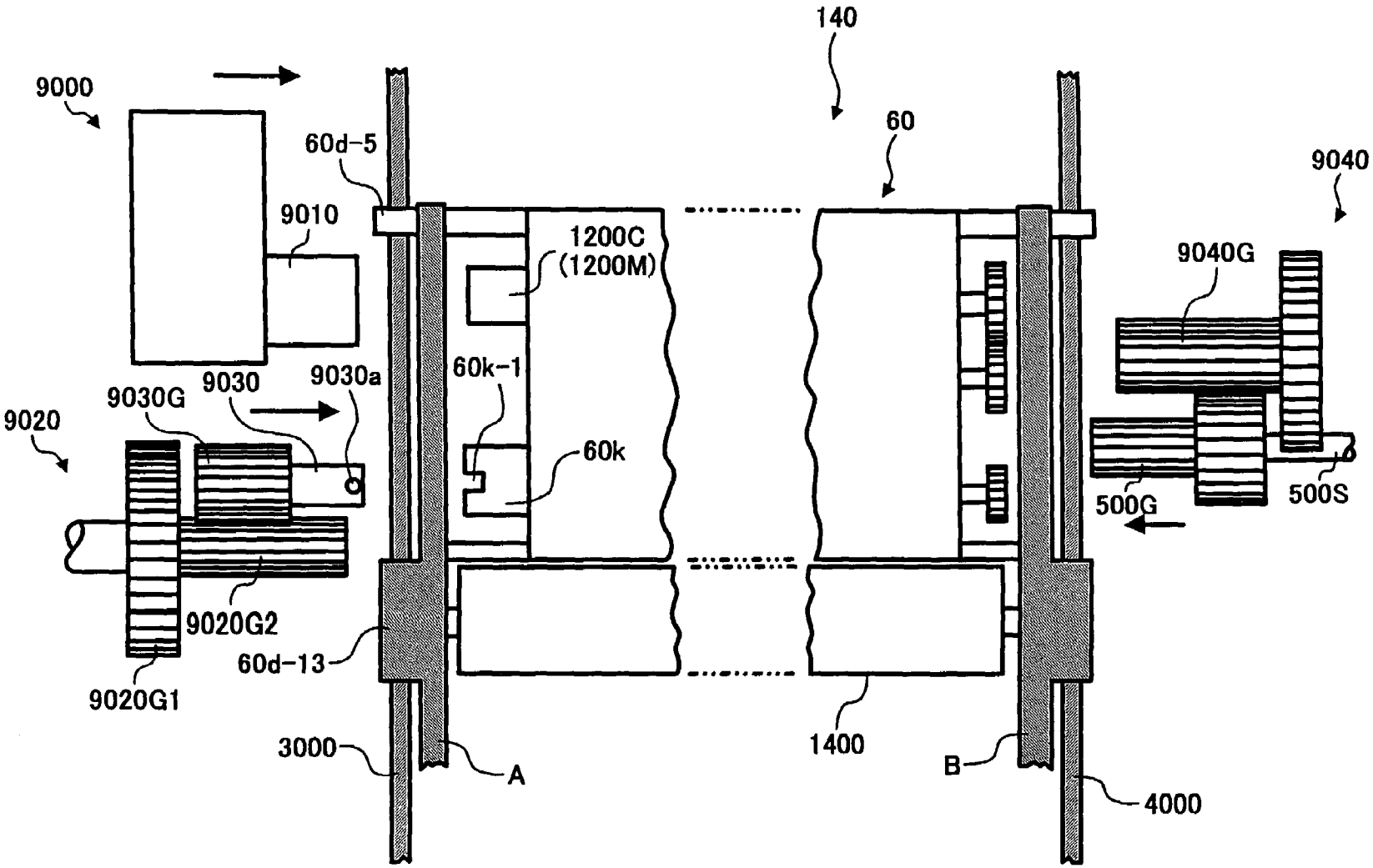
FIG. 17 is a fragmentary sectioned plan view of the first image station.

More specifically, a drive shaft 500S, see FIG. 17, is connected to the output shaft of a motor or drive source 900M, which is mounted on the apparatus body. A drive gear 500G is slidably mounted on the drive shaft 500S while a pair of switching gears 501G and 502G are constantly held in mesh with the drive gear 500G.

The switching gears 501G and 502G are journalled to a switching plate 600, which is pivotably mounted on the drive shaft 500S. When the switching plate 600 is angularly moved about the drive shaft 500S, it causes either one of the switching gears 501G and 502G to mesh with the gear 103G or 203G for thereby causing the developing roller 320 or 330 to rotate. FIG. 4 shows a specific condition wherein the switching gear 501G is brought into mesh with the gear 103G, causing the developing roller 320 to rotate.

The free end portion of the switching plate 600 is formed with a worm gear 800 meshing with a worm 700 mounted on the output shaft of the motor 900M. The motor 900M causes the worm 700 to selectively rotate in the forward or the reverse direction, causing the switching plate 600 to angularly move. As a result, one of the developing rollers 320 and 330 is rendered operative while the other of them is rendered inoperative.

The switching means described above causes one of the developing rollers 320 and 330 to rotate for developing a latent image formed on the drum 160 while maintaining the other of them in a halt. The developing rollers 320 and 330 each are made up of a nonmagnetic sleeve rotatable during development and a magnet disposed in the sleeve like a conventional developing roller. This is also true with the developing device 80 included in the second image station 240.

A prerequisite with the above switching scheme is that while one of the developing rollers 320 and 330 is rotating for developing a latent image formed on the drum 160, a developer deposited on the other of them is prevented from being transferred to the drum 160. Another prerequisite is that a developer deposited on the drum 160 is prevented from being transferred to the developing roller 320 or 330 in a halt. To meet these prerequisites, i.e., to obviate the mixture of different colors, it is necessary to prevent at least the developer on the developing roller 320 or 330 in a halt from contacting the drum 160.

Means for selectively bringing the developer into or out of contact with the drum 160 will be described hereinafter with reference to FIG. 5. As shown, the developing roller 320 is positioned upstream of the developing roller 330 in the direction of rotation of the drum 160 and made up of a nonmagnetic rotatable sleeve 320*b* and a magnet 320*a* disposed in the sleeve 320*b*. While the sleeve 320*b* is in rotation with the main pole P1 of the magnet 320*a* facing the drum 160, a developer TC forming a magnet brush on the sleeve 320*b* contacts a latent image formed on the drum 160. A bias for development is applied to the sleeve 320*b*. In this condition, the developer TC develops the latent image.

The other developing roller 330 is made up of a rotatable nonmagnetic sleeve 330*b* and a magnet 330*a* disposed in the sleeve 330*b*. While the developing roller 320 is developing the latent image, the sleeve 330*b* is held in a halt with the portion of the magnet 330*a* between a main pole P1 and a pole P5 adjoining it facing the drum 160. Therefore, a developer TC deposited on the sleeve 330*b* is spaced from the drum 160. The other poles P2 through P4 serve to scoop up the developer TC onto the sleeve 330*b* and convey the developer TC.

The magnets 320*a* and 330*a* each are rotatable by a preselected angle such that the developer TC on the developing roller 330 contacts the latent image formed on the drum 160 while the developer TC on the developing roller 320 does not contact the latent image, as will be described hereinafter with reference to FIG. 17. A bias for development is applied to the developing roller 330 as well. As shown in FIG. 17, pole switching means 9020 is connected to a tubular shaft 60*k* via a shaft 9030 formed with a gear. A forward-stop state of a preselected angle or a reverse-stop state of the preselected angle is selectively transferred from the pole switching means 9020 to the tubular shaft 60*k* via the shaft 9030.

It is necessary with a contact type developing system to insure sufficient contact of the developer TC with the drum 160 for thereby enhancing image quality. For this purpose, a gap Gp for development between the drum 160 and the sleeve of the developing roller should be as small as possible. On the other hand, to release the developer TC from the drum 160 by rotating the magnet disposed in the sleeve, the gap Gp should be greater than at least the thickness t1 of the developer TC deposited on the sleeve between nearby poles. The gap Gp should therefore preferably be about t1+0.2 mm.

If desired, the gears 501G and 502G angularly movable between the gears 103G and 203G may be replaced with drive gears angularly movable between the gears 101G and 201G.

Type 2 (See FIGS. 6 through 9)

Briefly, color switching means of Type 2 causes the entire developing device 60 including the developing rollers 320 and 330 to angularly move about a single fulcrum. This is also true with the other developing device 80.

More specifically, the developing device 60 is bodily moved about a shaft 60*p* extending substantially parallel to the axis of the drum 160, so that the developing roller 320 is moved toward the drum 160 while the other developing roller 320 is moved away from the drum 160. At the same time, the drive member and driven member associated with the developing roller 320 are operatively connected together while the drive member and driven member associated with the other developing roller 330 are disconnected from each other.

Figure 6:
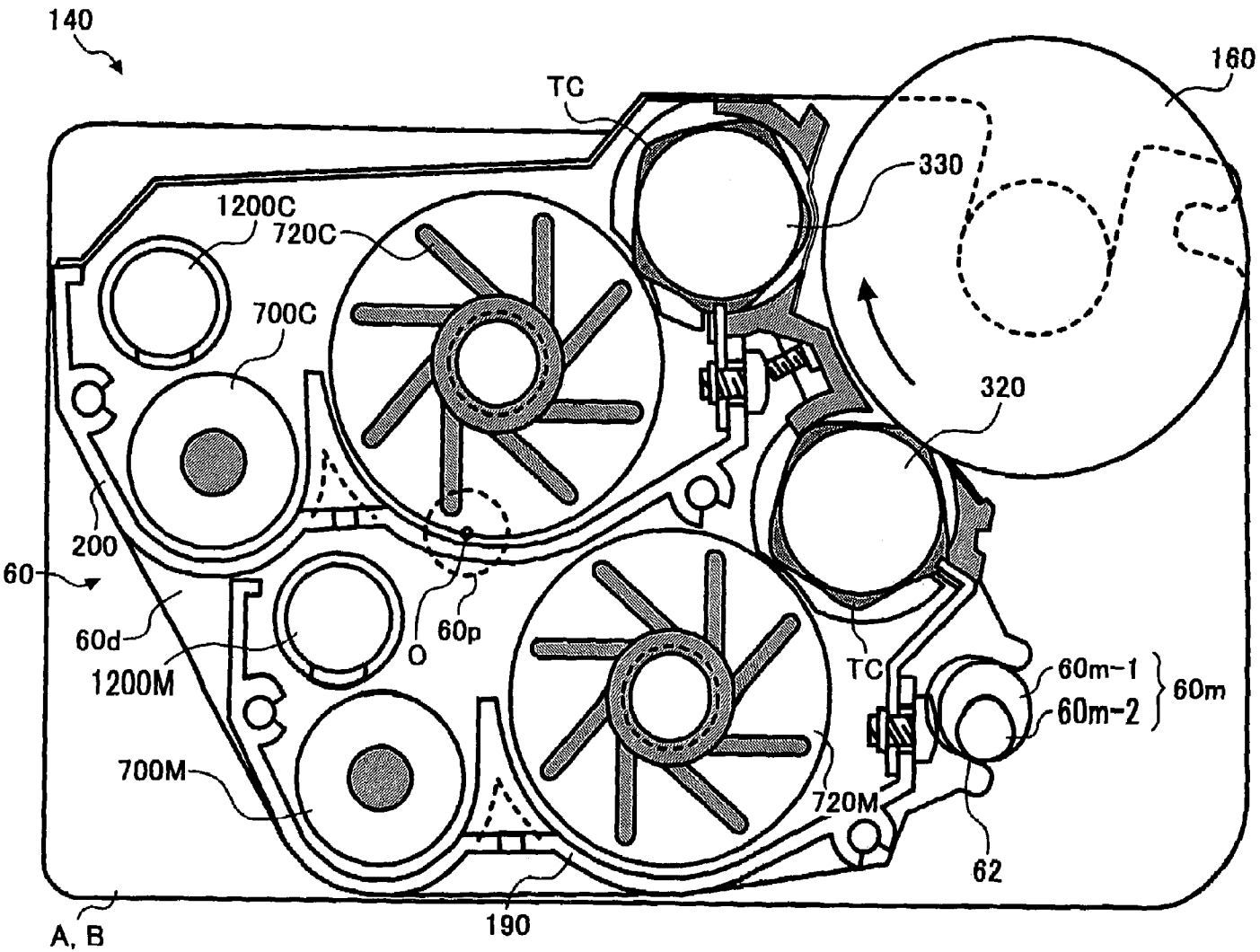
FIG. 6 is a fragmentary section showing the first image station.
Figure 7:
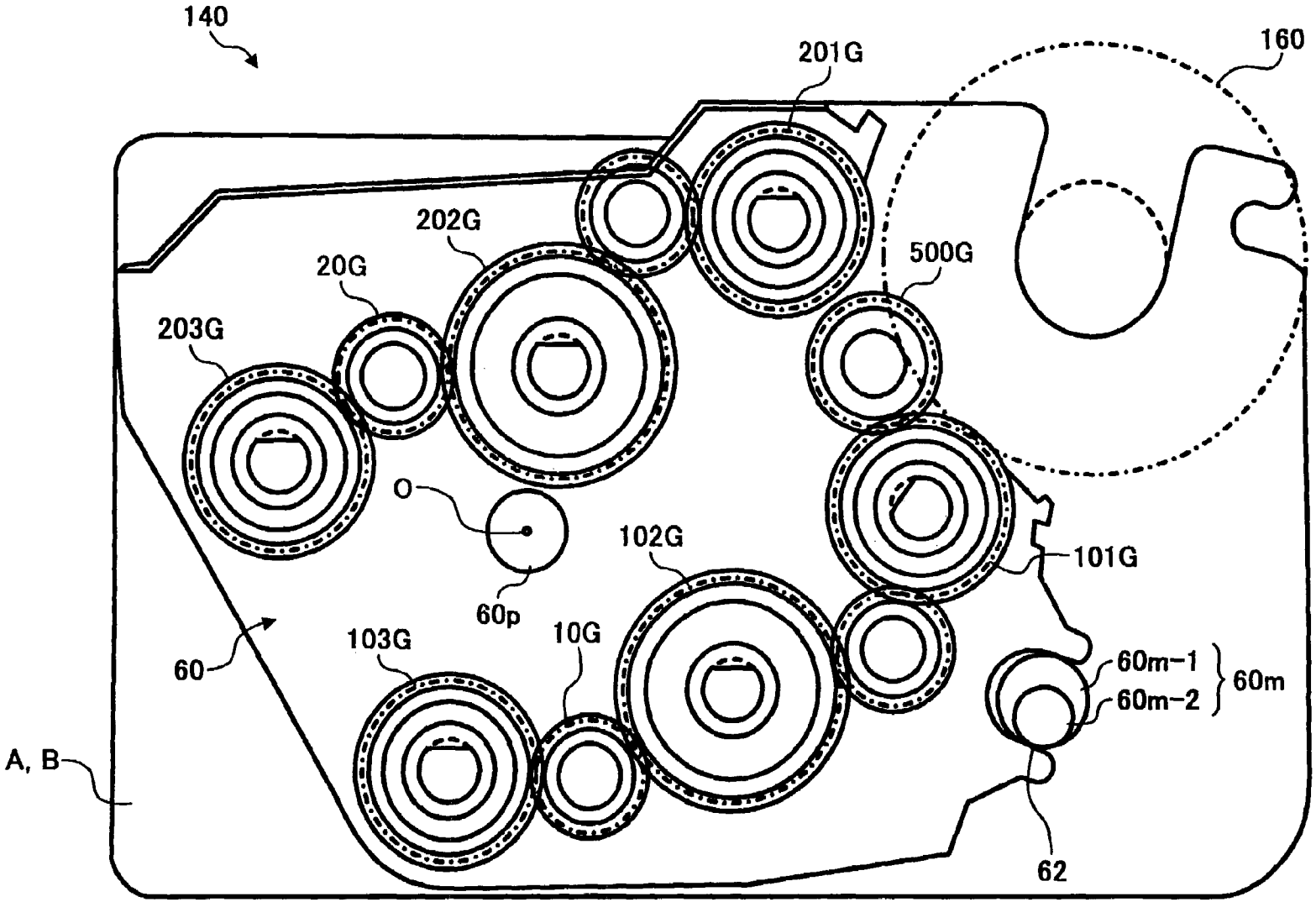
FIG. 7 shows a gear train constituting a driveline for the developing device.

As shown in FIGS. 6 through 7, in the developing device 60, the magenta section 190 including the developing roller 320 is positioned upstream of the cyan section 200 including the developing roller 330. The developing device 60 is mounted on opposite side walls 60*d* (only one is visible). The side walls 60*d* are supported by the subsidiary side walls A and B in such a manner as to be angularly movable about an axis O. Also, the drum 160 is rotatably supported by the subsidiary side walls A and B.

In the specific condition shown in FIG. 6, the developing roller 320 is rotating while being spaced from the drum 160 by a preselected gap with the developer TC contacting the drum 160. The other developing roller 330 downstream of the developing roller 320 is held in a halt with its developer TC not contacting the drum 160. At this instant, as shown in FIG. 7, the gear 101G is held in mesh with the drive gear 500G and driven thereby, causing the developing roller 320, paddle roller 720M and screw conveyor 700M to rotate. The gear 201G is held out of mesh with the drive gear 500G, so that the developing roller 330, paddle roller 720C and screw conveyor 700C are held in a halt.

Figure 8:
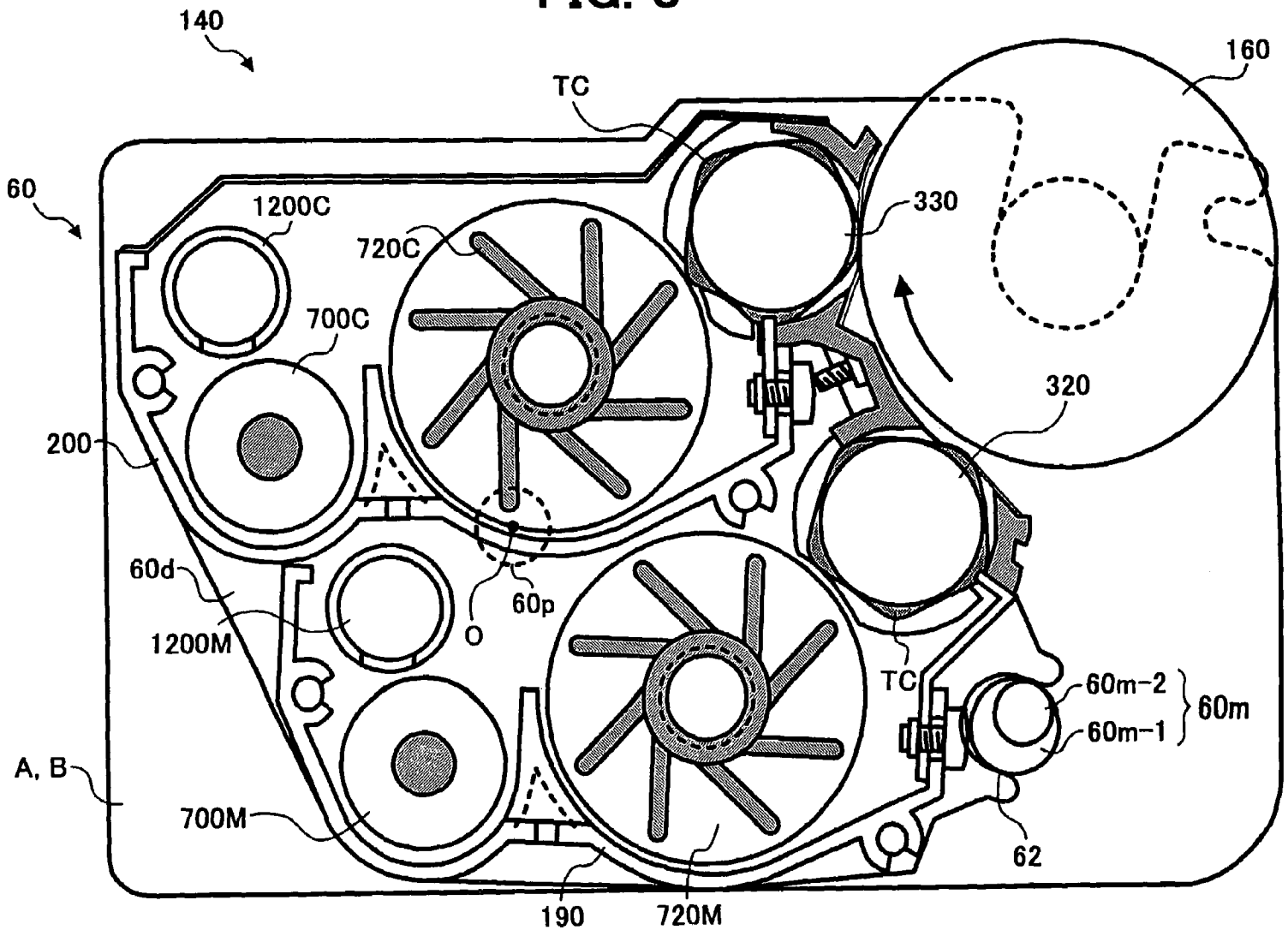
FIG. 8 is a fragmentary section showing the first image station.
Figure 9:
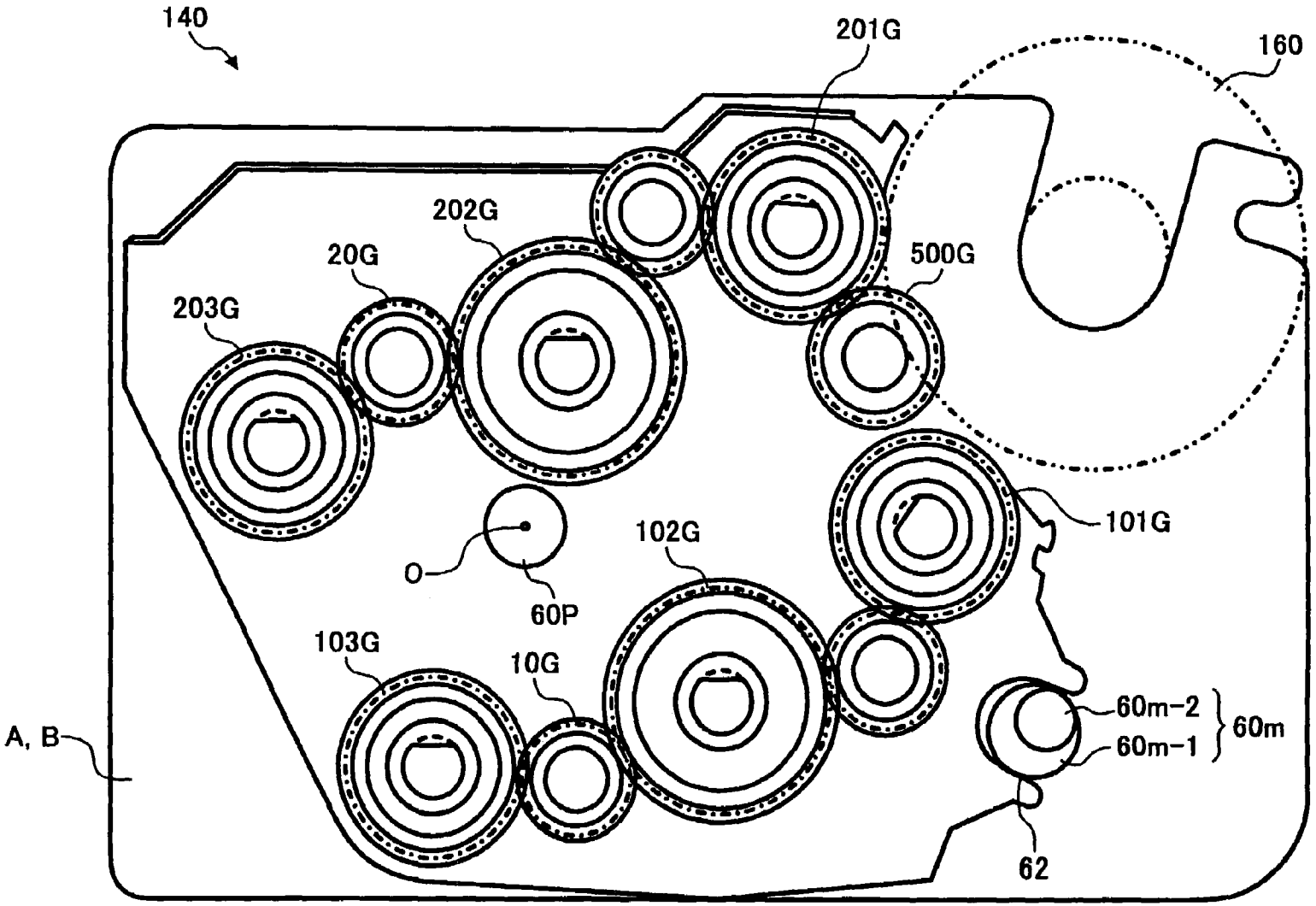
FIG. 9 shows a gear train constituting a driveline for the developing device.

FIGS. 8 and 9 show a condition wherein the side walls 60*d* of the developing device 60 are angularly moved clockwise about the axis O of the shaft 60*p* from the position shown in FIGS. 6 and 7, thereby rendering the developing roller 330 operative in place of the developing roller 320. In this condition, the developing roller 330 is rotating while being spaced from the drum 160 by a preselected gap with the developer TC contacting the drum 160. The other developing roller 320 upstream of the developing roller 330 is held in a halt with its developer TC not contacting the drum 160. At this instant, as shown in FIG. 9, the drive gear 500G is rotated to cause the developing roller 330, paddle roller 720C and screw conveyor 700C to rotate. The gear 101G is held out of mesh with the drive gear 500G, so that the developing roller 320, paddle roller 720M and screw conveyor 700M are held in a halt.

To move the side walls 60*d* of the developing device 60 about the shaft 60*p* by the preselected angle, the side walls 60*d* are angularly movably mounted on the shaft 60*p* while the shaft 60*p* is affixed to the subsidiary side walls A and B. Alternatively, the side walls 60*d* may be affixed to the shaft 60D while the shaft 60*p* may be rotatably supported by the subsidiary side walls A and B. An eccentric cam shaft 60*m* is rotatably mounted on a shaft parallel to the shaft 60*p*.

The eccentric cam shaft 60*m* has a larger diameter portion 60*m*-1 and a smaller diameter portion 60*m*-2 eccentric relative to the larger diameter portion 60*m*-1. The larger diameter portion 60*m*-1 received in recesses 62 formed in the side walls 60*d* at a suitable distance from the shaft 60*p*. The smaller diameter portion 60*m*-2 is caused to rotate in the forward or the reverse direction, causing the side walls 60*d* to angularly move about the axis O by the preselected angle.

In FIGS. 6 and 8, tubular shafts 1200C and 1200GM for the replenishment of cyan toner and magenta toner, respectively, are shown at positions slightly different from the positions shown in the other figures. Such a difference, however, is simply derived from layout and does not effect the crux of the present invention.

In the above configuration, even when an unexpected torque acts on the shaft 60*p*, the cam surface of the eccentric cam shaft 60*m* and the surface of the developing device 60 are surely held in contact with each other. This implements accurate angular movement and accurate stop position of the developing device 60 and thereby insures high image quality while reducing the size, cost and power consumption of a mechanism for driving the eccentric cam shaft 60*m*.

The color switching means of Type 1 uses electric and magnetic forces without moving the developing device 60, so that the developing device 60 must be fastened to the subsidiary side walls A and B by, e.g., screws. On the other hand, the color switching of Type 2 moves the developing device 60 relative to the drum 160, so that the developing device 60 must be supported by the subsidiary side walls A and B in such a manner as to be angularly movable about a single fulcrum. In this connection, in an image forming apparatus of the type switching color by moving a developing device, the developing device is, in many cases, angularly movably mounted on the body of the apparatus. This configuration does not allow the developing device to be dismounted or replaced. By contrast, the developing device 60 of the illustrative embodiment can be easily replaced because it is angularly movably mounted on the subsidiary side walls A and B, which are removable from the apparatus body.

As shown in FIGS. 11 and 12 as well as in the other figures, the cassette case 60*a* is supported by the subsidiary side walls A and B in such a manner as to be angularly movable about a shaft 60*c*, so that the cleaning cassette 220 is movable toward and away from the drum cassette 1400. A generally U-shaped holder 5010 is mounted on the cassette case 60*a* in such a manner as to be angularly movable about a shaft 5020. The holder 5010 and shaft 5020 constitute a locking mechanism in combination. A quenching lamp or discharging means 5000 (5000' at the second image station 240) is mounted on the top of the holder 5010 for discharging the drum 160. The quenching lamp 5000 is usually positioned in the space between the holder 1410 of the drum cassette 1400 and the cleaning cassette 220, so that the lamp 5000 can illuminate the drum 160.

The cassette case 60*a*, i.e., cleaning cassette 220 moves toward or away from the drum cassette 1400 when angularly moved. The subsidiary side walls A and B supporting the developing device 60 and cassette case 60*a* are positioned at and affixed to reference portions included in the side walls 3000 and 4000 of the apparatus body and positioned relative to the apparatus body thereby.

In the illustrative embodiment, the magenta section 190 and cyan section 200, for example, are implemented as parts basically not needing replacement because toner is replenished thereto. While such parts have customarily been adhered, fastened or otherwise affixed to the apparatus body, the illustrative embodiment allows the developing device 60 to be dismounted together with the subsidiary side walls A and B to cope with unexpected troubles or recycling, as stated above.

As shown in FIG. 2, for the miniaturization of the apparatus body, the magenta section 190 and cyan section 200 should naturally be arranged in the space around the side to the bottom of the drum cassette 1400 symmetrically to the cleaning cassette 220. Therefore, the developing device 60, like the cleaning cassette 220, cannot be pulled upward unless the drum cassette 1400 is removed from the subsidiary side walls A and B beforehand. The arrangement in which the drum cassette 1400 is positioned above the cleaning cassette 220 not only miniaturizes the apparatus body, but also allows the drum cassette 1400, which is replaced most frequently, to be easily dismounted with the highest priority. In addition, the developing device 60 cannot be dismounted unless the drum cassette 1400 is dismounted from the subsidiary side walls A and B. This successfully obviates erroneous replacement and damage to parts during replacement and thereby enhances appliance. This advantage is particularly significant in an image forming apparatus of the type relying on the user as to replacement.

As stated above, at the first image station 140, the subsidiary side walls A and B supporting the developing device 60 are affixed to the apparatus body to define a reference position for mounting. Subsequently, the drum cassette 1400 and cleaning cassette 220 are mounted to the subsidiary side walls A and B and positioned relative to the developing device 60 thereby.

The developing device 60 inclusive of the subsidiary side walls A and B and the cleaning cassette 220 are removable from the apparatus body either singly or in combination. This makes the relative position of the cassettes and units highly accurate and facilitates replacement. It is noteworthy that the drum cassette 1400, which is replaced most often, cannot be removed unless it is removed alone before, e.g., the cleaning cassette 220. Stated another way, the drum cassette 1400 is mounted to the apparatus body last. In this manner, the drum cassette 1400 and cleaning cassette 220 are sequentially removed in this order, and the developing device 60 is removed last, if necessary. After the drum cassette 1400 has been removed, the cleaning cassette 220 may be removed together with the developing device 60 while being accommodated in the cassette case 60*a*. Mounting is effected in the reverse order.

In the illustrative embodiment, the developing device 60 is removable from the apparatus body together with the subsidiary side walls A and B to cope with unexpected troubles or recycling, as stated earlier. This is also true with the developing device taught in Laid-Open Publication No. 11-295952. However, the illustrative embodiment is different in object and therefore in construction from the above document. At the time when the application corresponding to the above document was filed, the maximum life of a developer was as short as about 100K prints and therefore required a developing device to be frequency replaced as one of expendables like a drum unit. Therefore, considering appliance, the developing device was affixed to an apparatus body by a slide member that served to affix the drum unit at the same time.

However, because importance was attached to easy mounting and dismounting, the developing device simply rested on the apparatus when unlocked from the apparatus body. The operator was therefore required to replace the drum unit by touching the developing device held in such an unstable position, resulting in extremely inefficient operation and damage to a drum. Moreover, repeated replacement necessarily produced displacement or play between the developing device and the drum unit and effected image quality at last.

A developer available today has achieved a life as long as the life of a machine and has basically made it needless to replace a developing unit as an expendable. In light of this, in the illustrative embodiment, the developing device 60 constructed into a unit together with the subsidiary side walls A and B is affixed to the apparatus body alone. This is why the developing device 60, i.e., the subsidiary side walls A and B are used as a reference position at the first image station 140. It is, however, necessary with the developing device 60 to give consideration to, e.g., troubles, damage to parts and smearing ascribable to scattered toner as well as repair, replacement, cleaning and recycling work. In light of this, the developing device 60 is usually affixed to the apparatus body, but can be removed only when removal is required. This can be done because the subsidiary side walls A and B supporting the developing device 60 is removable from the apparatus body alone. This arrangement frees the subsidiary side walls A and B from play in the event of replacement of, e.g., the drum cassette 1400 and allows the developing device 60 to be easily removed, as needed. Moreover, the subsidiary side walls A and B protect the developing device 60 from troubles ascribable to replacement.

The cleaning cassette 220 should also be provided with its own locking means capable of obviating play at the time of replacement for the following reason. In the illustrative embodiment, the drum cassette 1400 includes only the drum 160 as process means and is separate from the charge roller 170 and cleaning means 210. Therefore, if the cleaning cassette 220 is not locked in the event of replacement, the charge roller 170 and cleaning means 210 are apt to scratch or otherwise damage the drum 160. The conventional drum unit including all of the drum, charger and cleaning blade can be removed without the drum being damaged.

The illustrative embodiment is practicable without regard to color/black-and-white, the number, arrangement or structure of developing sections or the construction of the apparatus body. Stated another way, the illustrative embodiment is applicable to all image forming apparatuses of the type including electrophotographic process means.

In the illustrative embodiment, the image transfer brushes 410 and image transfer roller 390 constituting the primary image transfer system, as distinguished from the secondary image transfer system, are not moved into or out of contact with the belt 100. Also, the belt 100 is angularly spaced from the writing position (5.00 position) by substantially 180°, so that the drum 160 does not disturb an image on the belt 100 even when rotating with eccentricity.

Further, in the illustrative embodiment, when the drum 160 is to be removed, the belt 100 is retracted. Subsequently, after the drum 160 has been mounted, the belt 100 is returned to the position where it contacts the drum 160. The drum 160 can therefore be replaced only by the displacement of the belt 100, which does not have to be accurately positioned relative to the drum 160, preventing image quality from changing before and after the replacement.

Reference will be made to FIGS. 10, 11, 12 and 14 for describing a procedure for removing the drum cassette 1400 and cleaning cassette 220 from the subsidiary side walls A and B at the first image station 140. FIG. 10 shows the first image station 140 mounted to and located at a reference position (side walls) inside the apparatus. As shown, the charge roller 170, magenta section 190, cyan section 200, quenching lamp 5000, cleaning blade 210*a* and other image forming means are arranged around the drum 160. The unit including the subsidiary side walls A and B with such image forming means and cassette case 60*a* will sometimes be referred to as the body of an image forming section hereinafter.

The opposite side walls 60*d* of the developing unit support the magenta section 190 and cyan section 200, constituting the developing device 60, which is, in turn, supported by the subsidiary side walls A and B larger in size than the side walls 60*d*. The subsidiary side walls A and B support, in addition to the developing device 60, the cassette case 60*a* such that the cassette case 60*a* is freely movable about the shaft 60*c*. A generally U-shaped notch 60*d*-1 is formed in the top of each of the subsidiary side walls A and B and receives the shaft 160*a* of the drum 160 for thereby positioning the drum cassette 1400.

The holder 5010 is supported by the cassette case 60*a* in such a manner as to be rotatable about a shaft 5020. In this condition, a dismounting procedure to be described with reference to FIGS. 11 through 14 begins. First, as shown in FIG. 10, the cassette case 60*a* is unlocked and then turned clockwise to move the charge roller 170 and cleaning means 210 (cleaning cassette 220) and quenching lamp 5000 away from the drum 160 to the position shown in FIG. 11. In this condition, the cleaning blade 210*a* and seal roller 210*b* are released from the drum 160, so that the drum cassette 1400 can be removed.

More specifically, in the condition shown in FIG. 10, the seal roller 210*b* facing the developing roller 330, as seen on the drum 160, is held in contact with the drum 160 at a position above a plane extending through the axis of the developing roller 330 and that of the drum 160, preventing the drum 160 from being pulled upward. It is therefore necessary to release the seal roller 210*b* from the drum 160. Also, the cleaning blade 210*a* is pressed against the drum 160 in the counter direction, preventing the drum 160 from being removed. For these reasons, the cassette case 60*a* is angularly moved clockwise about the shaft 60*c* beforehand.

Subsequently, as shown in FIG. 12, the drum cassette 1400 is pulled upward along the angle of the notches 60*d*-1 formed in the subsidiary side walls A and B. The holder 5010 is then turned counterclockwise about the shaft 5020 to remove the quenching lamp 5000 from the cleaning cassette 220. Thereafter the cleaning cassette 220 is removed upward, as shown in FIG. 14.

As shown in FIG. 14, the cleaning case 230 is box-shaped and has a hermetically closed space below the cleaning blade 210*a* and seal roller 210*b*. This space constitutes a waste developer chamber 230*h* for storing the developer, i.e., toner in the illustrative embodiment scraped off by the cleaning blade 210*a*. The cleaning cassette 220 is constructed integrally with the waste developer chamber 230*h* and removable from the cassette case 60*a*, i.e., the subsidiary side walls A and B. It follows that when the waste developer chamber 230*h* is filled up with waste toner, the cleaning cassette 220 can be bodily replaced or it can be reused if only the waste toner is discarded.

FIGS. 15 through 19 demonstrate the above procedure more specifically. It is to be noted that the procedure to be described is opposite in sequence to the procedure described above for better understanding the illustration. For the same purpose, major portions are exaggerated while the driveline and other unnecessary portions are not shown.

Figure 15:
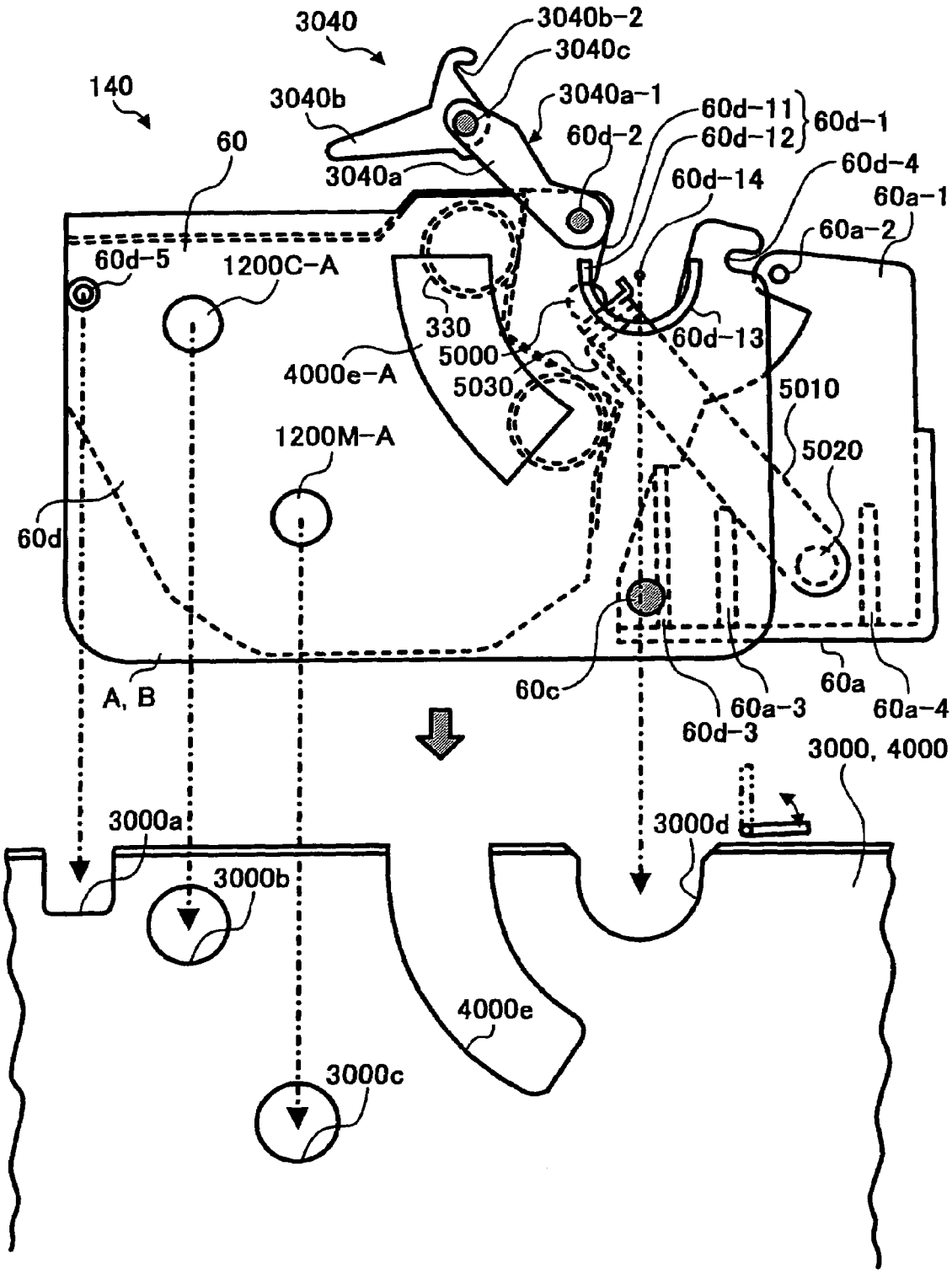
FIG. 15 is a fragmentary section showing side walls included in the apparatus body from which the first image station has been removed.

FIG. 15 shows a condition just before the subsidiary side walls A and B supporting the developing device 60 and cassette case 60*a* is mounted to the side walls 3000 and 4000 of the apparatus body. As shown, the subsidiary side wall A (B) is formed with holes 1200C-A and 1200GM-A at positions corresponding to the tubular shafts 1200C and 1200GM, which are used to replenish cyan toner and magenta toner, respectively. The holes 1200C-A and 1200GM-A are concentric with, but larger in diameter than, the tubular shafts 1200C and 1200M, respectively. A curved slot 4000*e*-A is also formed in the subsidiary side wall A and allows driving means mounted on the side wall 3000 and assigned to the developing device 60 to be brought into or out of operative connection with the drive means of the magenta and cyan developing sections 190 and 200.

The U-shaped notch 60*a*-1 is made up of an oval portion 60*d*-11 and a generally semicircular portion 60*d*-12 whose edge protrudes to the front in the direction perpendicular to the sheet surface of FIG. 15. Only the oval portion 60*d*-11 is inclined by a certain angle. A shaft 60*d*-2 protrudes from the subsidiary side wall A to the front, as seen in the direction perpendicular to the sheet surface of FIG. 15, in the vicinity of the notch 60*d*-1. A locking mechanism whose major component is a lever 3040 (3040' at the second image station 240) movable in a two-step motion is angularly movable about the shaft 60*d*-2. A through hole 60*d*-3 is positioned below the notch 60*d*-1. A generally U-shaped notch 60*d*-4 faces the lever 3040 with the intermediary of the notch 60*d*-1 and has a radius of curvature whose center coincides with the through hole 60*d*-3. A shaft 60*d*-5 protrudes to the front, as seen in the direction perpendicular to the sheet surface of FIG. 15, at the upper left position opposite to the notch 60*d*-1.

The cassette case 60*a* implemented as a top-open box is positioned between the subsidiary side walls A and B such that the outer surface, or front surface in the direction perpendicular to the sheet surface of FIG. 15, of the side wall 60*a*-1 of the cassette case 60*a* and the inner surface, or rear surface in the above direction, of the subsidiary side wall A closely contact and slide on each other. In this position, the cassette case 60*a* faces the developing device 60. The shaft 60*c* and a shaft 60*a*-2 protrude from the outer surface or the side wall 60*a*-1 to the front in the direction perpendicular to the sheet surface of FIG. 15.

The shaft 60*c* is received in the through hole 60*d*-3, so that the cassette case 60*a* is angularly movably supported by the subsidiary side wall A (B). Also, the shaft 60*a*-2 is received in the notch 60*d*-4 such that the counterclockwise movement of the cassette case 60*a* stops when the shaft 60*a*-2 abuts against the bottom of the notch 60*d*-4. In this sense, the notch 60*d*-4 plays the role of a stop and allows the cassette case 60*a* to be accurately positioned. It is to be noted that the position where the cassette case 60*a* stops moving counterclockwise, i.e., where the shaft 60*a*-2 abuts against the left edge of the notch 60*d*-4 is a set position assigned to the cassette case 60*a* during image formation.

The shaft 5020 protrudes from the inner surface, or rear surface in the direction perpendicular to the sheet surface of FIG. 15, of the side wall 60*a*-1 to the rear in the above direction. The holder 5010 holding the quenching lamp 5000 disposed in the cassette case 60*a* is rotatably mounted on the shaft 5020. A generally L-shaped locking piece 5030 is mounted on the upper portion of the holder 5010. Ribs 60*a*-3 and 60*a*-4 are formed on the inner surface of the side wall 60*a*-1 at opposite sides of the shaft 5020 and extend upward from the bottom of the above surface.

The side wall 3000 of the apparatus body has the following configuration. The side wall 3000 is implemented as generally L-shaped sheet metal whose upper end is bent to the front in the direction perpendicular to the sheet surface of FIG. 15. A top-open notch 3000*a* is formed in the side wall 3000 at a position corresponding to the shaft 60*d*-5. Holes 3000*b* and 3000*c* are formed in the side wall 3000 at positions corresponding to the tubular shafts or holes 1200C-A and 1200M-A, respectively. A top-open semicircular notch 3000*d* corresponds in position to the protruding portion 60*d*-13 of the semicircular portion 60*d*-12. A curved notch 4000*e* corresponds in position to, but is slightly larger in size than, the curved slot 4000*e*-A of the subsidiary side wall A. The other or rear side wall 4000 is identical with the side wall 3000 except that the holes 3000*b* and 3000*c* are absent.

Figure 16:
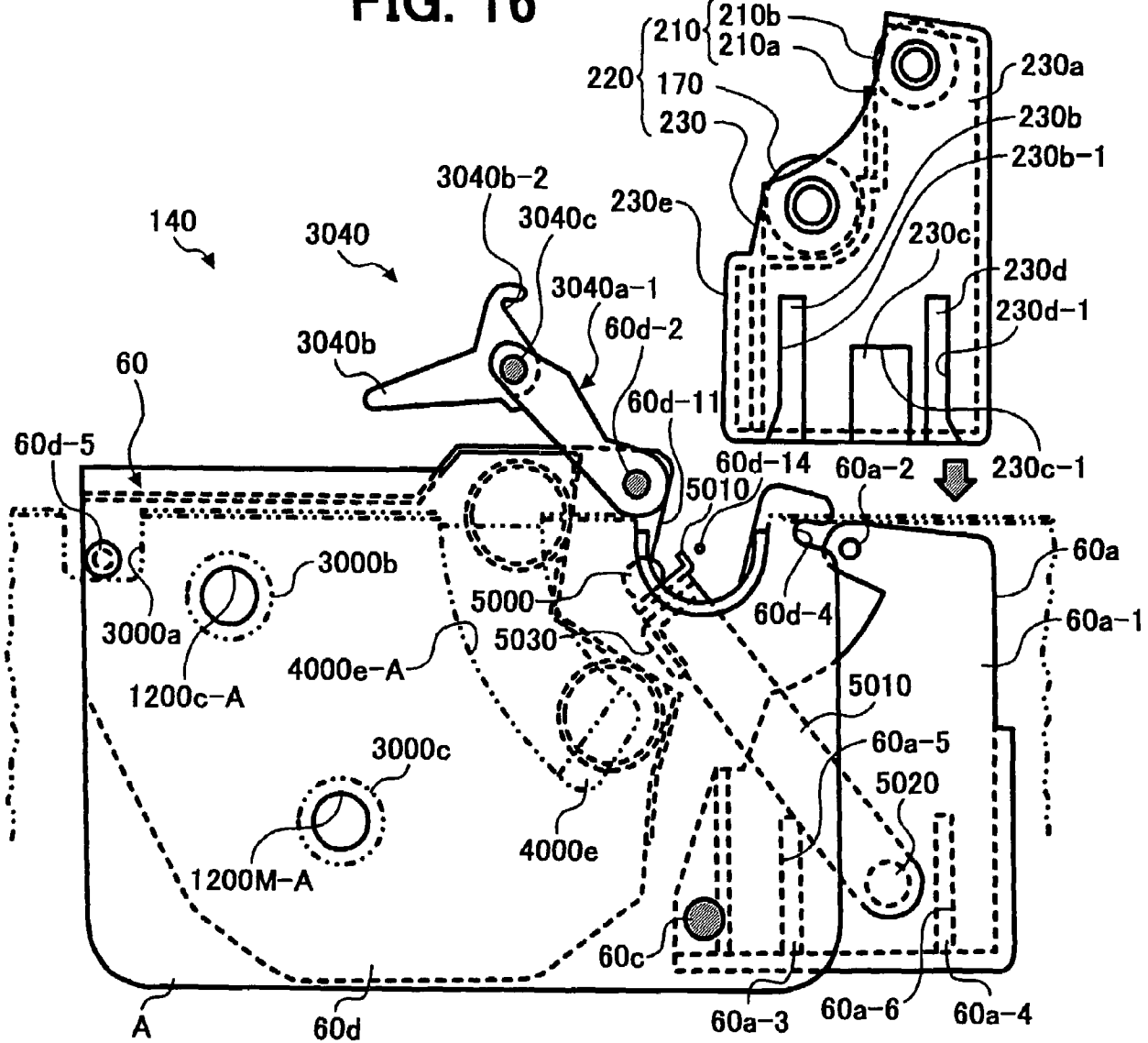
FIG. 16 is a fragmentary section showing the first image station from which the cleaning cassette has been removed after the mounting of the image station to the side walls of the apparatus body.

FIG. 16 shows a condition wherein the subsidiary side wall A has been moved substantially vertically downward from the position of FIG. 15 together with the developing device 60 and cassette case 60*a* and joined with the side wall 3000, but the cleaning cassette 220 is not joined with the cassette case 60*a*. As shown, the protruding portion or outer diameter portion 60*d*-13 of the semicircular portion 60*d*-2 included in the subsidiary side wall A and the semicircular notch 3000*d* of the side wall 3000 are engaged with each other, determining the position of the subsidiary side wall A relative to the side wall 3000 in the right-and-left and up-and-down directions. At the same time, the magenta section 190 and cyan section 200 are automatically positioned relative to the side wall 3000.

The outer diameter portion 60*d*-13, i.e., the semicircular portion 60*d*-12 of the subsidiary side wall A so positioned on the side wall 3000 has a center 60*d*-14 defining the reference position at the first image station 140. Further, the shaft 60*d*-5 of the subsidiary side wall A rests on the horizontal edge of the notch 3000*a* formed in the side wall 3000, preventing the subsidiary side wall A from rotating the determining the position of the subsidiary side wall A in the up-and-down direction together with the outer diameter portion 60*d*-13. In this condition, the developing device 60 is held in the preselected position for image formation.

In the condition shown in FIG. 16, the developing device 60 is not locked in position, but simply rests on the side walls 3000 and 4000 and is therefore unstable. This gives rise to the problem as to the replacement of the drum cassette 1400 as stated earlier in relation to Laid-Open Publication No. 11-295952.

To solve the above problem, the illustrative embodiment allows the developing device 60, i.e., the subsidiary side wall A to be surely locked to the apparatus body, i.e., the side wall 3000 (and side wall 4000). However, special, exclusive locking means is undesirable from the construction and cost standpoint. In the illustrative embodiment, the subsidiary side wall A is locked when the developing device 60 is locked. This locking operation does not need any special means either. Briefly, in the illustrative embodiment, the essential parts or means including the drive means assigned to the magenta section 190 and cyan section 200 and toner replenishing means bifunction as locking means for thereby reducing size and cost.

FIG. 17 shows a specific configuration of locking means for locking the subsidiary side wall A, i.e., the developing device 60 to the apparatus body. FIG. 17 shows a condition before locking. As shown, toner replenishing means 9000 and pole switching means 9020 are arranged on the apparatus body at the outside of the side wall 3000; the pole switching means 9020 drives the magnets 320*a* and 330*a*, FIG. 5. Also, developing roller drive means 9040 is arranged on the apparatus body at the outside of the side wall 4000.

The toner replenishing means 9000 is assigned to the magenta section 190 of the developing device 60. Identical a Toner replenishing means is assigned to the cyan section 200 although not shown specifically. The toner replenishing means 9000 is movable forward along a guide, not shown, to a position where a pipe 9010 accommodating a screw, not shown, is connected to the tubular shaft 1200M via the holes 3000*c* and 1200M-A, FIGS. 15 and 16.

The pole switching means 9020 for the magenta section 190 includes a gear 9020G1 mounted on the apparatus body, a gear 9020G2 formed integrally with the gear 9020G1, and a shaft 9030 with a gear 9030G slidably meshing with the gear 9020G2. The shaft 9030 is movable forward with the gear 9030G meshing with the gear 9020G2 into connection with the tubular shaft 60*k*, which drives the developing roller of the magenta section 190, via the notches 4000*e* and 4000*e*-A shown in FIGS. 15 and 16. At this instant, a lug 9030*a* formed on the shaft 9030 mates with a recess 60*k*-1 formed in the tubular shaft 60*k*, thereby transmitting torque. Identical pole switching means is assigned to the magenta section 190 although not shown in FIG. 17.

Developing roller drive means identical with the developing roller drive means 9040 for the magenta section 190 is also assigned to the cyan section 200, although not shown specifically. In the developing roller drive means 9040, a drive gear 9040G mounted on the apparatus body is movable along the drive shaft or guide 500S while remaining in mesh with the drive gear 500G, FIGS. 7 and 9.

When the pipe 9010, shaft 9030 and drive gear 500G are brought into engagement with the tubular shafts 60*k* and 1200M and gear of the developing device 60, the developing device 60 and subsidiary side walls A and B are automatically locked to the apparatus body. The movable members may be moved either automatically or manually. When the movable members are engaged with the magenta section 190 or the cyan section 200, the subsidiary side walls A and B are locked to the side walls 3000 and 4000 via the developing device 60.

Referring again to FIG. 16, as for the cleaning cassette 220, the cleaning case 230 is a hollow box and almost hermetically closed by the cleaning means 210 or fully hermetically closed on contacting the drum 160. The cleaning case 230 includes a side wall 230*a* supporting the charge roller 170 and seal roller 210*b*, which are positioned at the inside of the side wall, i.e., at the rear in the direction perpendicular to the sheet surface of FIG. 16. Three elongate, parallel grooves 230*b*, 230*c* and 230*d* are formed in the outer surface, or front surface in the above direction, of the side wall 230*a*, and each rises from the bottom of the side wall 230*a*. The bottom of a left side wall 230*e* is set back to the right, as viewed in FIG. 16, in a generally U-shaped configuration so as not to lie at least in the beam scanning range. At this stage of procedure, the quenching lamp 5000 is held in a position rotated counterclockwise about the shaft 5020.

Figure 18:
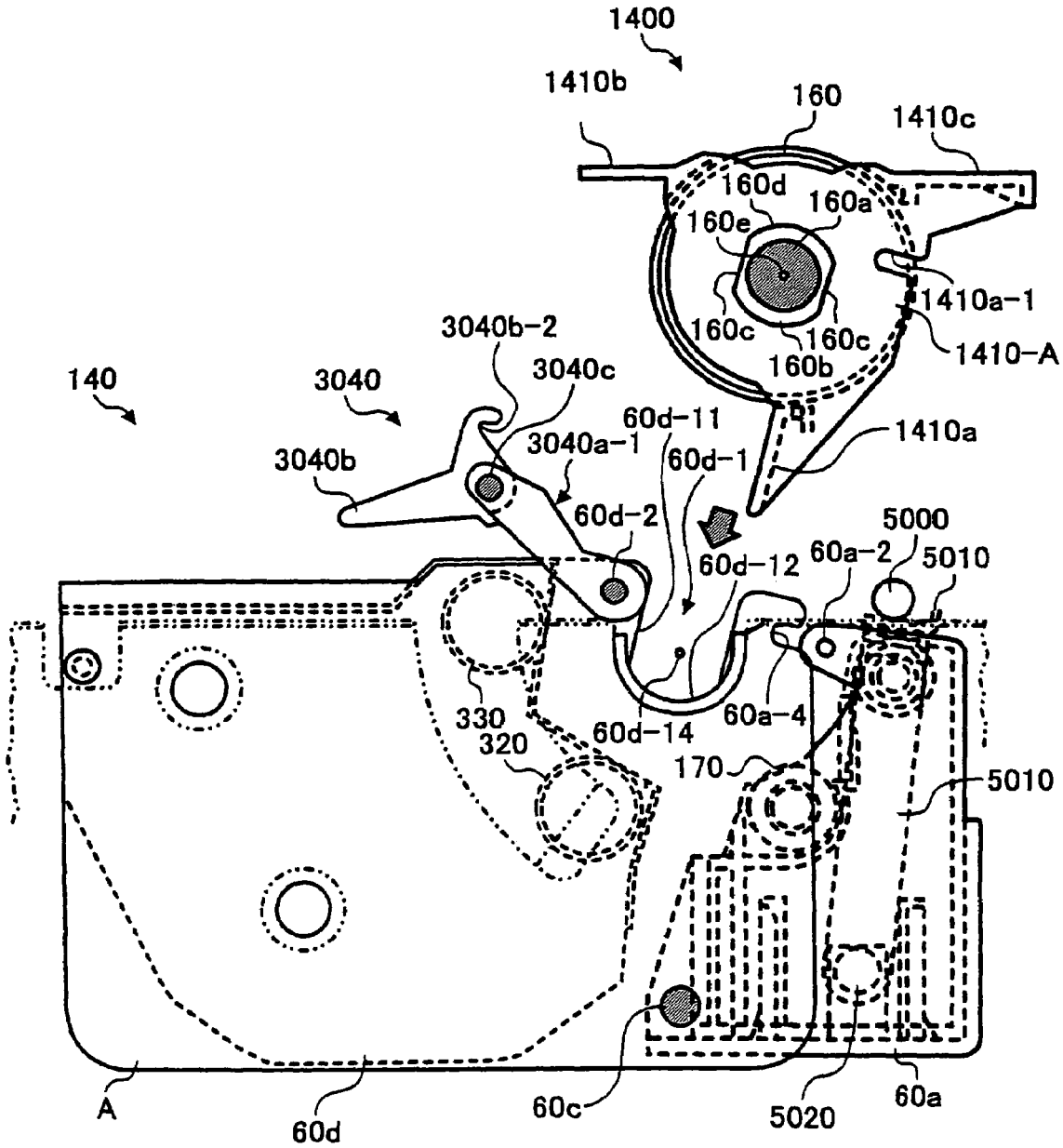
FIG. 18 is a fragmentary section showing the first image station from which a drum cassette has been removed after the mounting of the image station to the side walls of the apparatus body.

FIG. 18 shows a condition wherein the cleaning cassette 220 has been moved substantially vertically downward into the cassette case 60*a*, but the drum cassette 1400 is not mounted to the subsidiary side wall A. As shown, the left edge 203*b*-1 of the groove 230*b* and the right edge 230*d*-1 of the groove 230*d* respectively abut against the left side 60*a*-5 of the rib 60*a*-3 and the right side 60*a*-6 of the rib 60*a*-4; the ribs 60*a*-3 and 60*a*-4 protrude inward from the cassette case 60*a*. In this condition, the cleaning cassette 220 is positioned relative to the cassette case 60*a* in the right-and-left direction.

In the even of mounting, the elongate grooves 230*b* and 230*d* and ribs 60*a*-3 and 60*a*-4 guide each other, allowing the cleaning cassette 220 to be smoothly inserted into the cassette case 60*a*. Further, the upper edge 230*c*-1 of the groove 230*c* formed in the cleaning case 230 and the shaft 5020 of the cassette case 60*a* abut against each other, positioning the cleaning case 230 relative to the cassette case 60*a* in the direction of height. In addition, the wall of the groove 230*c* in the direction parallel to the sheet surface of FIG. 18 and the end face of the free end of the shaft 5020 abut against each other, positioning the cleaning cassette 220 relative to the cassette case 60*a* in the front-and-rear direction in the direction perpendicular to the sheet surface of FIG. 18.

After the cleaning cassette 220 has been set in the cassette case 60*a,* the U-shaped holder 5010 is turned clockwise until it has been locked to the cassette case 60*a*. To lock the holder 5010 to the cassette case 60*a,* arrangement may be made such that the bearing of the seal roller 210*b* and the locking piece 5030 of the holder 5010 are pressed against each other so as to cause the locking piece 5030 and shaft 5020 sandwich the cleaning cassette 220. At this time, the quenching lamp 5000 is located at a set position on the cassette case 60*a*.

As shown in FIG. 18, the shaft 160*a* of the drum 160 is rotatably supported by the side wall 1410-A of the holder 1410 via an oval bearing 160*b*. The oval bearing 160*b* is mounted on the side wall 1410-A with a certain angle of inclination. This angle of inclination defines an angle at which the drum cassette 1400 is inserted into the subsidiary side wall A, i.e., the angle of the right and left edges 160*c* of the oval bearing 160*b*. A notch 1410*a*-1 is formed in the side wall 1410*a* at the right-hand side of the oval bearing 160*b* and has the same curvature as the notch 60*d*-4 of the subsidiary side wall A.

Figure 19:
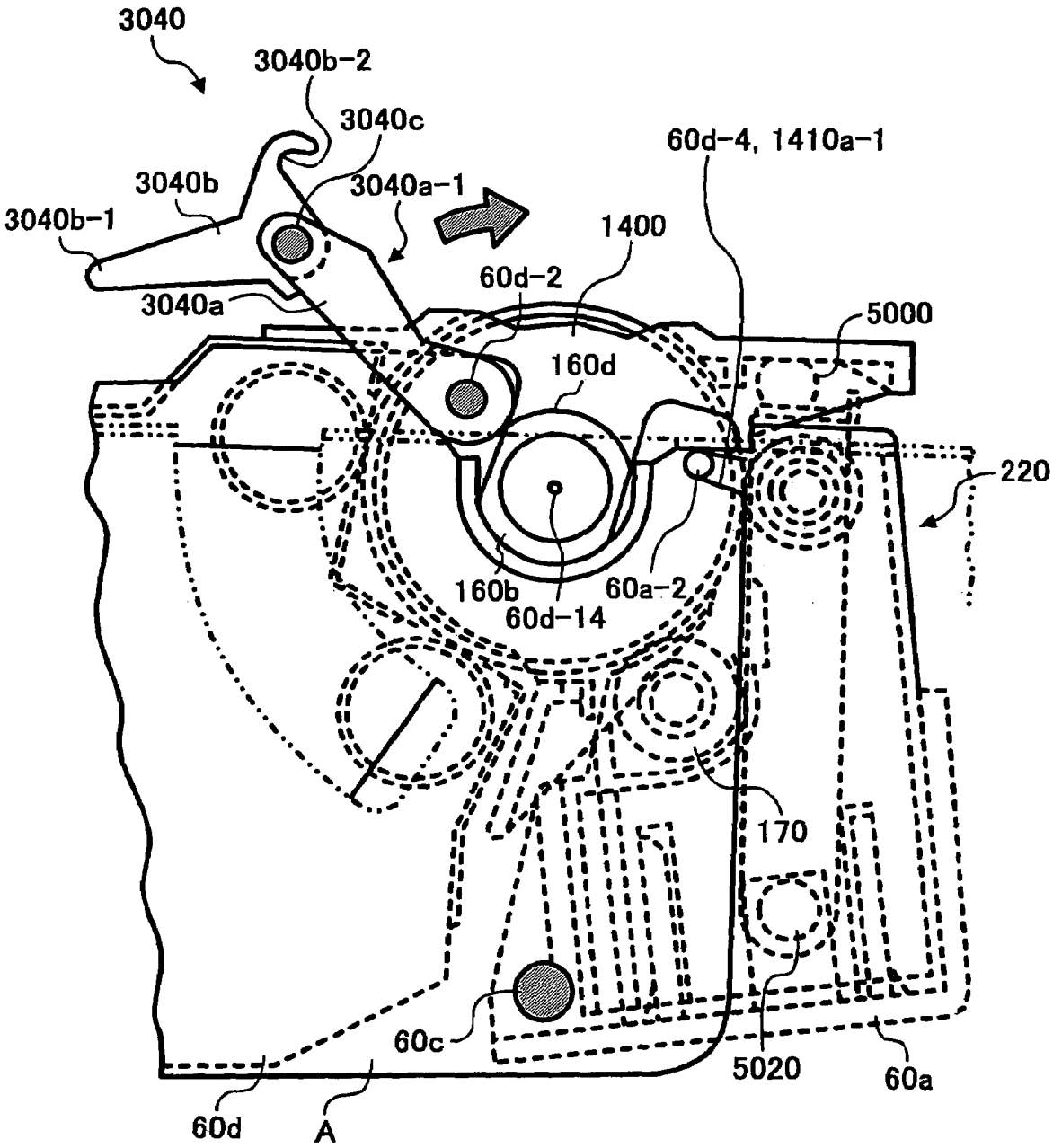
FIG. 19 shows how the drum cassette is mounted.

FIG. 19 shows a condition wherein the drum cassette 1400 has been moved obliquely downward to be joined with the subsidiary side wall A, and then the cassette case 60*a* has been turned clockwise about the shaft 60*c* until the cleaning cassette 220 and quenching lamp 5000 have faced the drum cassette 1400. As shown, the outer diameter portion 160*d* of the oval bearing 160*b* and the semicircular portion 60*d*-12, FIG. 18, of the notch 60*d*-1 formed in the subsidiary side wall A are engaged with each other, positioning the drum cassette 1400 relative to the subsidiary side wall A in the right-and-left and up-and-down directions.

More specifically, the axis 160*e* of the shaft 160*a*, i.e., the axis of the drum 160 is aligned with the center 60*d*-14 of the subsidiary side wall A, which is the reference position of the first image station 140, so that the drum 160 is positioned relative to the subsidiary side wall A. Also, the opposite flat portions 160*c* of the oval bearing 160*b* and opposite flat edges of an oval hole 60*d*-11 formed in the subsidiary side wall A contact each other, guiding the drum cassette 1400 being inserted while preventing it from rotating.

Moreover, the outer surface, or front surface in the direction perpendicular to the sheet surface of FIG. 19, of the side wall 1410-A of the holder 1410 and the inner surface, or rear surface in the above direction, of the subsidiary side wall A slidably contact each other, positioning the drum cassette 1400 relative to then subsidiary side wall A in the front-and-rear direction with respect to the above direction.

During the procedure for mounting the drum cassette 1400 described above, the cleaning cassette 220 is always spaced from the drum cassette 1400 and therefore does not damage the drum 160.

Subsequently, the cassette case 60*a* is moved clockwise about the shaft 60*c*. The notch 60*d*-4 of the subsidiary side wall A and the notch 1410*a*-1 of the drum cassette 1400 are identical in shape and aligned with each other in the front-and-rear direction. The shaft 60*a*-2 of the cassette case 60*a* is engaged with the notches 60*d*-4 and 1410*a*-1 so that the cassette case 60*a*, i.e., the cleaning cassette 220 and quenching lamp 5000 are positioned relative to the subsidiary side wall A and drum cassette 1400. The position where the shaft 60*a*-2 abuts against the left ends of the notches 60*d*-4 and 1410*a*-1 is a set position assigned to the cassette case 60*a* for image formation. At the same time, the notches 60*d*-4 and 1410*a*-1 play the role of a stop when the cassette case 60*a* is turned counterclockwise. By the procedure described so far, the drum cassette 1400, cleaning cassette 220 and quenching lamp 5000 are accurately positioned relative to the subsidiary side wall A and developing device 60.

Figure 24:
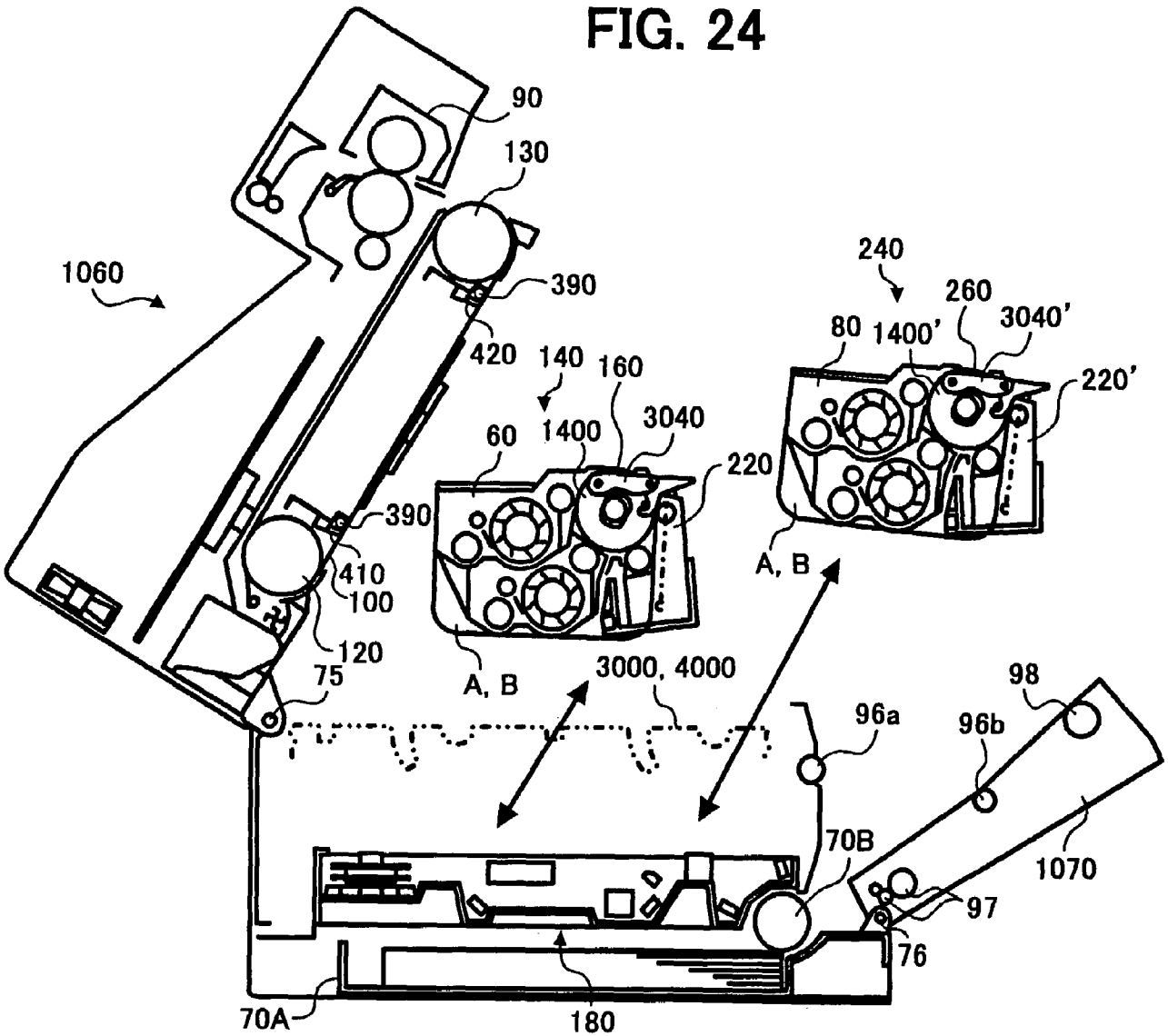
FIG. 24 demonstrates the removal of the image station from the apparatus body.

As shown in FIG. 24, when the operator turns the lever 3040 clockwise about the shaft 60*d*-2, the drum cassette 1400 and cassette case 60*a,* i.e., the cleaning cassette 220 and quenching lamp 5000 are locked to the subsidiary side wall A.

As shown in FIG. 19, the lever 3040 is made up of a first lever 3040*a*, a second lever 3040*b*, and a shaft 3040*c* connecting the two levers 3040*a* and 3040*b* such that they are angularly movable. The lever 3040, rotatable about the shaft 60*d*-2, constitutes a link mechanism movable in a two-step motion. When the operator nips one end 3040*b*-1 of the second lever 3040*b* and then turns the second lever 3040*b* clockwise about the shaft 60*d*-2, the straight portion 3040*a*-l of the first lever 3040*a* and the outer diameter portion 160*d* of the oval bearing 160*b* abut against each other, stopping the clockwise movement of the first lever 3040*a*.

As the operator further turns the second lever 3040*b* clockwise, only the second lever 3040*b* angularly moves about the shaft 3040*c* until a notch 3040*b*-2 formed in the other end of the second lever 3040*b* mates with the shaft 60*a*-2 of the cassette case 60*a*. At this instant, the first lever 3040*a* presses the drum cassette 1400 against the subsidiary side wall A while the second lever 3040*b* locks the cassette case 60*a* to the subsidiary side wall A. In this manner, the first lever 3040*a* and second lever 3040*b* lock the drum 160 and cassette case 60*a*, respectively, to the subsidiary side wall A. The holder 5010 locks the cleaning cassette 220 to the cassette case 60*a*. In this sense, the second lever 3040*b* locks the cleaning cassette 220 to the subsidiary side wall A. A dismounting sequence is opposite to the mounting sequence described above.

In the above configuration, the lever 3040 including the first and second levers 3040*a* and 3040*b* plays the role of locking means for locking the drum 160 to the subsidiary side wall A. In addition, the lever 3040 constitutes a major part of a simultaneous locking mechanism for locking or unlocking the drum 160 and cleaning cassette 220 to or from the subsidiary side wall A at the same time. The operator cannot dismount the drum 160 or the cleaning cassette 220 from the subsidiary side wall A without unlocking the simultaneous locking mechanism. The simultaneous locking mechanism prepares the drum 160 and cleaning cassette 220 for mounting or dismounting when operated by the operator's single action. By the procedure described above, the first image station 140 is fully mounted to the apparatus body.

If desired, before mounting the subsidiary side walls A and B to the apparatus body, the operator may mount the cleaning cassette 220 to the cassette case 60*a*, mount them to the apparatus body together, and then mount the drum cassette 1400. Stated another way, after removing the drum cassette 1400 from the subsidiary side walls A and B, the operator can dismount the developing device 60 from the apparatus body together with the cleaning cassette 220. In this manner, in the illustrative embodiment, the drum cassette 1400 does not include process means other than the drum 160, which is replaced most often, and can be freely mounted and dismounted from the subsidiary side walls A and B, which constitute the other process means cassette or unit. The drum cassette 1400 is mounted to the apparatus body after the other process means cassette or unit (developing device 60) or dismounted from the same before the other process means or unit.

Further, the subsidiary side walls A and B supporting the developing device 60, which is long life and scarcely replaced, is used as a reference position for the process means. The drum cassette 1400 and cleaning cassette 220 are positioned relative to and mounted and dismounted from the subsidiary side walls A and B. In addition, at least when the drum cassette 1400 is to be dismounted, the subsidiary side walls A and B are locked to the apparatus body.

The construction of the first image station 140 described above is representative of a specific form of process means. More specifically, the construction of the process means is open to choice so long as the intermediate members supporting the developing section are used as a reference position and the drum is removable alone.

Furthermore, in the illustrative embodiment, the drum and other process means each are removable alone. This successfully reduces running cost and loads on environment while facilitating the user's work for replacement. More specifically, the drum cassette 1400, cleaning cassette 220 and subsidiary side walls A, B (developing device 60) are sequentially dismounted in this order. At this instant, the drum cassette 1400 conceals the holder 5010, which allows the cleaning cassette 220 to be removed, until the drum cassette 1400 has been removed. This prevents the user from confusing the holder 5010 with the lever 3040, which is used to remove the drum cassette 1400, and therefore allows the untrained user, as distinguished from a service person, to perform replacement in the expected order.

Moreover, in the illustrative embodiment, the cassette or unit having the shortest life is expected to be removed first so as to facilitate the user's operation. More specifically, the drum cassette 1400 that is exhausted most is replaceable alone with the other process means being left on the apparatus body. This frees the user from troublesome operation in the event of replacement of the drum 160.

Figure 20:
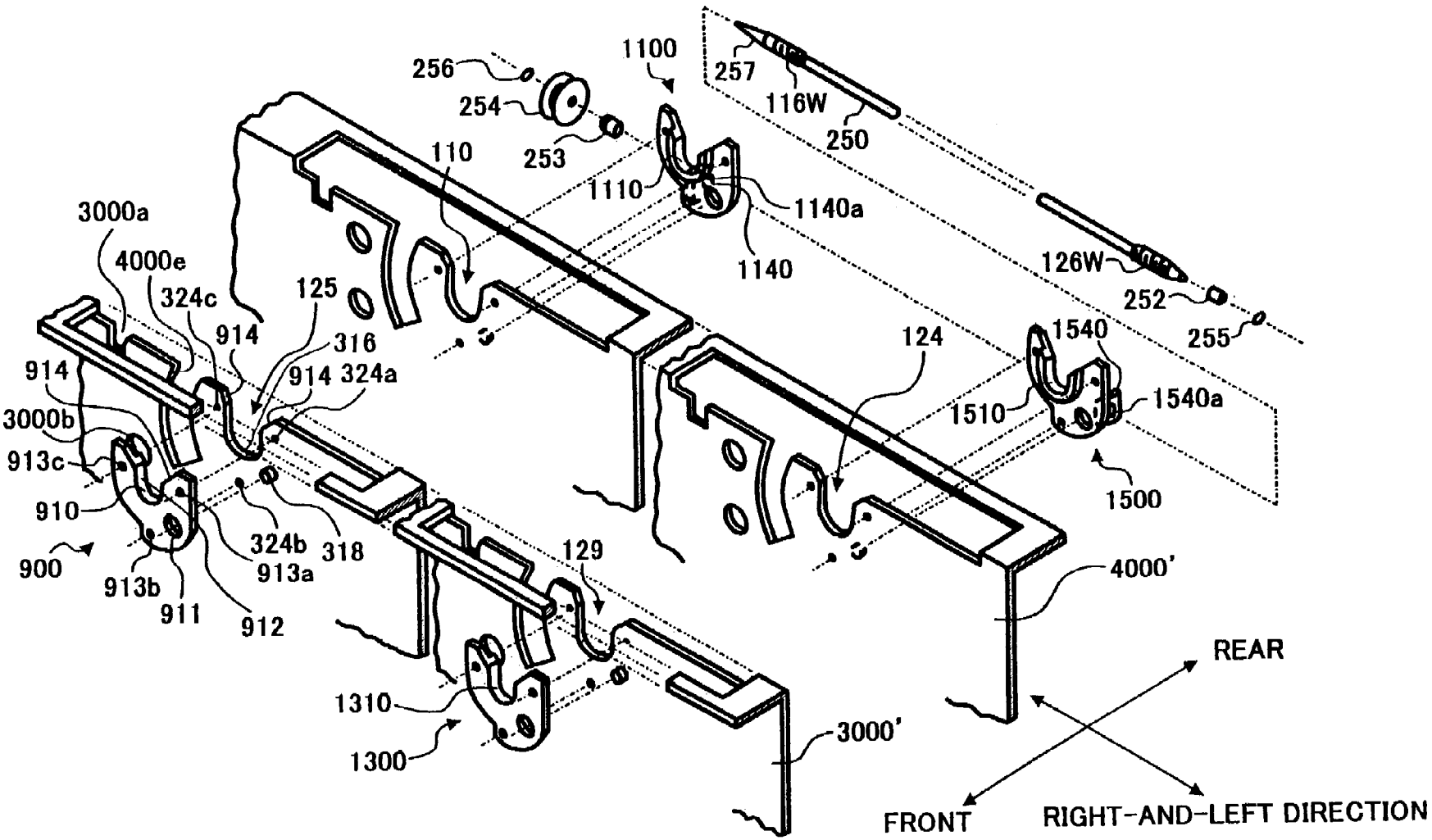
FIG. 20 is a perspective view showing the side walls of the apparatus body.

A modified form of the side wall forming part of the apparatus body will be described with reference to FIG. 20. In the configuration described with reference to FIGS. 15 through 19, the outer diameter portion 60*d*-13 of the subsidiary side wall A is directly received in the notch 3000*d* of the side wall 3000. By contrast, as shown in FIG. 20 that pertains to the first image station 140, the modified side wall, labeled 3000', has a common mount member 900 mounted thereto beforehand. The outer diameter portion 60*d*-13 of the subsidiary side wall A is selectively locked to or unlocked from the common mount member 900. This is also true with the other side wall 4000' facing the side wall 3000' and second image station 240. More specifically, the common mount member 900 and a common mount member 1100 are respectively mounted to the side walls 3000' and 4000' at the first image station 140 while common mount members 1300 and 1500 are respectively mounted to the side walls 3000' and 4000' at the second image station 240. Among them, the common mount member 900 will mainly be described with reference to FIGS. 20 and 21.

As shown in FIG. 20, the side walls 3000' and 4000' are identical in configuration with the side walls 3000 and 4000, FIG 15, except for the configuration around mount portions 125 and 110. In FIG. 20, structural elements identical with the structural elements shown in FIG. 15 are designated by identical reference numerals. The mount portion 125 is implemented as a generally U-shaped notch formed in the portion of the side wall 3000' expected to form the first image station 140. Likewise, the mount portion 110, substantially identical in shape with the mount portion 125, is formed in the portion of the side wall 4000' facing the mount portion 125. Further, a mount portion 129 is implemented as a generally U-shaped notch formed in the portion of the side wall 3000' expected to form the second image station 240. A mount portion 124, substantially identical in shape with the mount portion 129, is formed in the portion of the side wall 4000' facing the mount portion 129.

At the first image station 140, the common mount member 900 is mounted to the side wall 3000' from the front side while the common mount member 1100 is mounted to the side wall 4000' from the rear side. Likewise, at the second image station 240, the common mount member 1300 is mounted to the side wall 3000' from the front side while the common mount member 1500 is mounted to the side wall 4000' from the rear side.

The common mount member 900 is formed with a notch or shaft support portion 910 for supporting the outer diameter portion 60*d*-13 of the subsidiary side wall A. Likewise, the common mount members 1100, 1300 and 1500 are respectively formed with notches or shaft support portions 1110, 1310 and 1510 for supporting outer diameter portions, not shown, corresponding to the outer diameter portion 60*d*-13 each. The notches 910, 1110, 1310 and 1510 are expected to support the subsidiary side walls A and B and, in this sense, play the role of subsidiary plate or intermediate member support portions.

Notches or shaft support portions 1110, 1310 and 1510 identical with the notch 910 of the common mount member 900 are formed in the common mount member 1100, 1300 and 1500, respectively, so as to support the respective outer diameter portions not shown. The notches 1110, 1310 and 1510, like the notch 910 play the role of subsidiary plate or intermediate member support portions.

As shown in FIG. 20, the common mount members 1100 and 1500 associated with the rear side wall 4000' are identical in shape with each other except for drive means support portions 1140 and 1540. More specifically, the drive means support portions 1140 and 1540 support opposite end portions of the worm shaft 250 and are therefore different in position from each other. The drive means support portions 1140 and 1540 are respectively formed with holes 1140*a* and 1540*a* for supporting the worm shaft or drive member 250, which drives the drum 160.

The front common mount member 900, as seen in FIG. 20, will be described more specifically hereinafter. The common mount member 900 is formed with a positioning slot 911, a positioning step 912 and holes 913*a*, 913*b* and 913*c* in addition to the notch 910. Opposite edges of the notch 910 are formed with slants 914 at their tops in order to easily guide the outer diameter portion 60*d*-13. The lower and upper portions of the U-shaped notch 910 each are provided with the same diameter as the outer diameter portion 60*d*-13; the upper portion is open.

The step 912 is also generally U-shaped and slightly larger than the notch 910. The slot 911 determines a position in the direction of rotation whose center is defined by the notch 910, and is elongated toward the axis. A pin 318 is studded on the front surface, as viewed in FIG. 20, of the vertical portion of the side wall 3000' and movably received in the slot 911. The side wall 3000' is formed with holes 324*a*, 324*b* and 324*c* around the mount portion or U-shaped notch 125 for mounting the common mount member 900.

To mount the common mount member 900 to the side wall 3000', the step 912 of the common mount member 900 is received in the U-shaped notch 316 of the side wall 3000', thereby determining the axis position of the notch 910. In addition, the slot 911 is engaged with the pin 318 to thereby determine the position of the common mount member 900 in the direction of rotation whose center is defined by the notch 910. In this condition, the holes 913*a* through 913*c* and holes 324*a* through 324*c* align with each other and are used to affix the common mount member 900 to the side wall 3000'. The other common mount members 1100, 1300 and 1500 each are affixed to the side wall 3000' or 4000' in the same manner as the common mount member 900.

Subsequently, the worm shaft 250 is inserted into the hole 1540*a* of the drive means support portion 1540 and then into the hole 1140*a* of the drive means support portion 1140 with a worm 116W at the head. The drive means support portion 1140 supports the end of the worm shaft 250 adjacent the worm 116W via a bearing 253. A pulley 254 is mounted on a tapered portion 257 included in the worm gear 250 and affixed thereto by a nut 256. The drive means support portion 1540 supports the other end of the worm shaft 250 adjacent a worm 126W via a bearing 252. A stop member 255 is fitted on the end of the worm shaft 250 adjacent the worm 126W. In this condition, the worms 116W and 126W are positioned beneath the axes of the notches 1110 and 1510, respectively.

At the first image station 140, the outer diameter portion 60*d*-1 of the subsidiary side wall A is engaged with the mount portion 125 of the side wall 3000', so that the subsidiary side wall A (developing device 60) is positioned relative to the side wall 3000' in the right-and-left and up-and-down directions.

The outer diameter portion 60*d*-13, i.e., the substantially semicircular portion 60*d*-12 has a center 60*d*-14 that serves as the reference mounting position at the first image station 140. The shaft 60*d*-5 of the subsidiary side wall A rests on the horizontal bottom of a notch 3000*a* formed in the side wall 3000', preventing the subsidiary side wall A from angularly moving. In addition, the shaft 60*d*-5 and notch 3000*a* cooperate with the outer diameter portion 60*d*-13 to determine the position of the subsidiary side wall A relative to the side wall 3000' in the up-and-down direction, thereby maintaining the subsidiary side wall A at the expected position for image formation. In this manner, the subsidiary side wall A (developing device 60) is positioned on the side wall 3000'. This is also true with the other subsidiary side wall B mounted to the side wall 4000' and the second image station 240.

Figure 21:
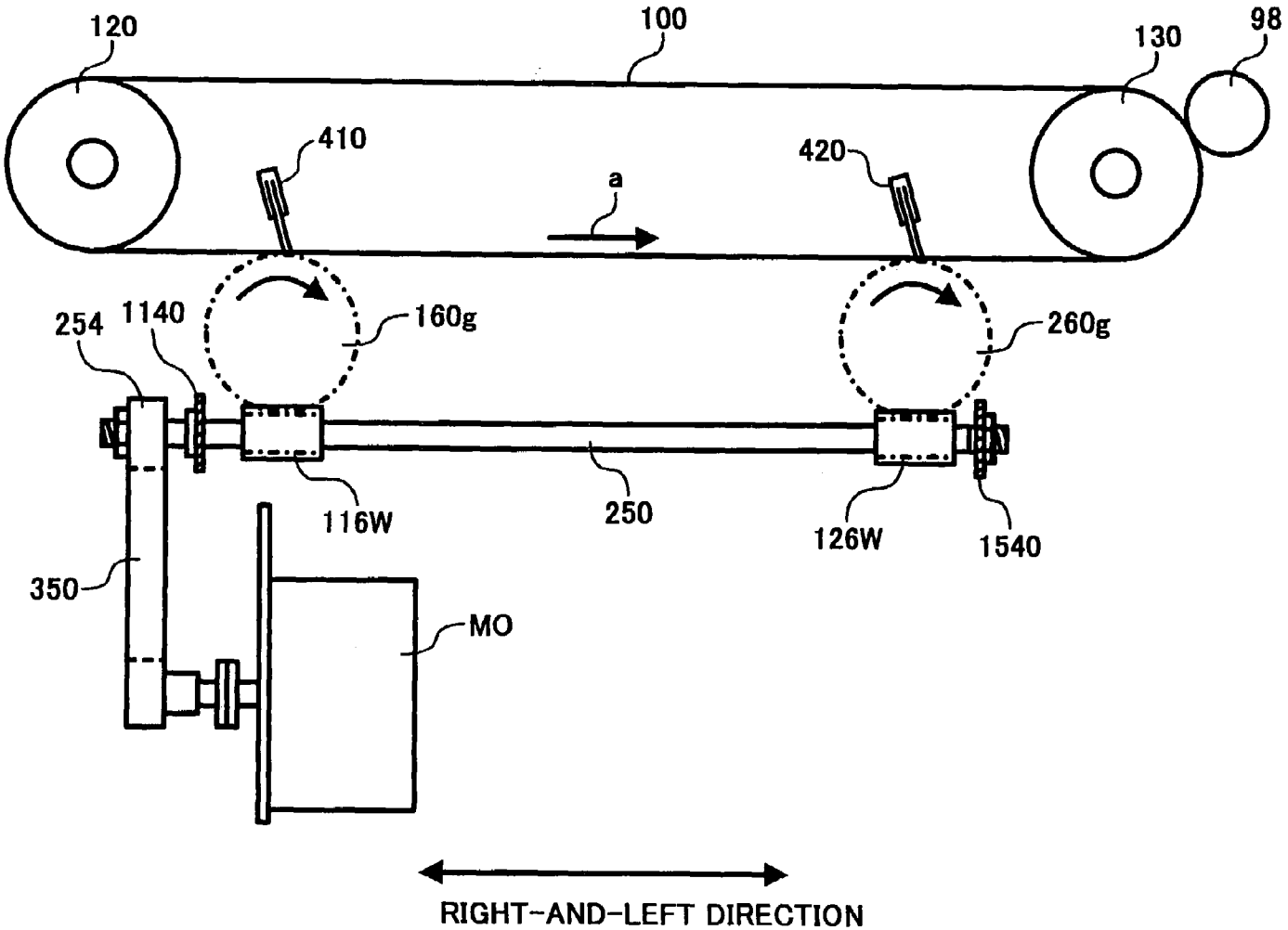
FIG. 21 shows the general construction of the apparatus together with drive means assigned to an intermediate image transfer body.

As shown in FIG. 21, only if the drum cassette 1400 is mounted to the first image station 140, the gear 160*g* mounted on the shaft of the drum 160 is automatically brought into mesh with the worm 116W. Likewise, only if the drum cassette 1400 is mounted to the second image station 240, the gear 260*g* mounted on the shaft of the drum 260 is automatically brought into mesh with the worm 126W. The worm shaft 250 is connected to the motor MO via the pulley 254 and belt 350, so that the drums 160 and 260 are capable of being driven by the motor MO.

As stated above, in the modification, the subsidiary side walls A and B supporting the developing device 60 are selectively locked to or unlocked from the common mount members 900, 1100, 1300 and 1500. The common mount members 1100 and 1500 include the drive means support members 1140 Shaft and 1540, respectively, that support the worm shaft or drive member 250. Therefore, only if the positional relation between the notches 1110 and 1510 and holes 1140*a* and 1540*a* is accurately determined, the drive gears 160*g* and 260*g* of the drums 160, 260 can be accurately positioned relative to the worm shaft 250.

Figure 22:
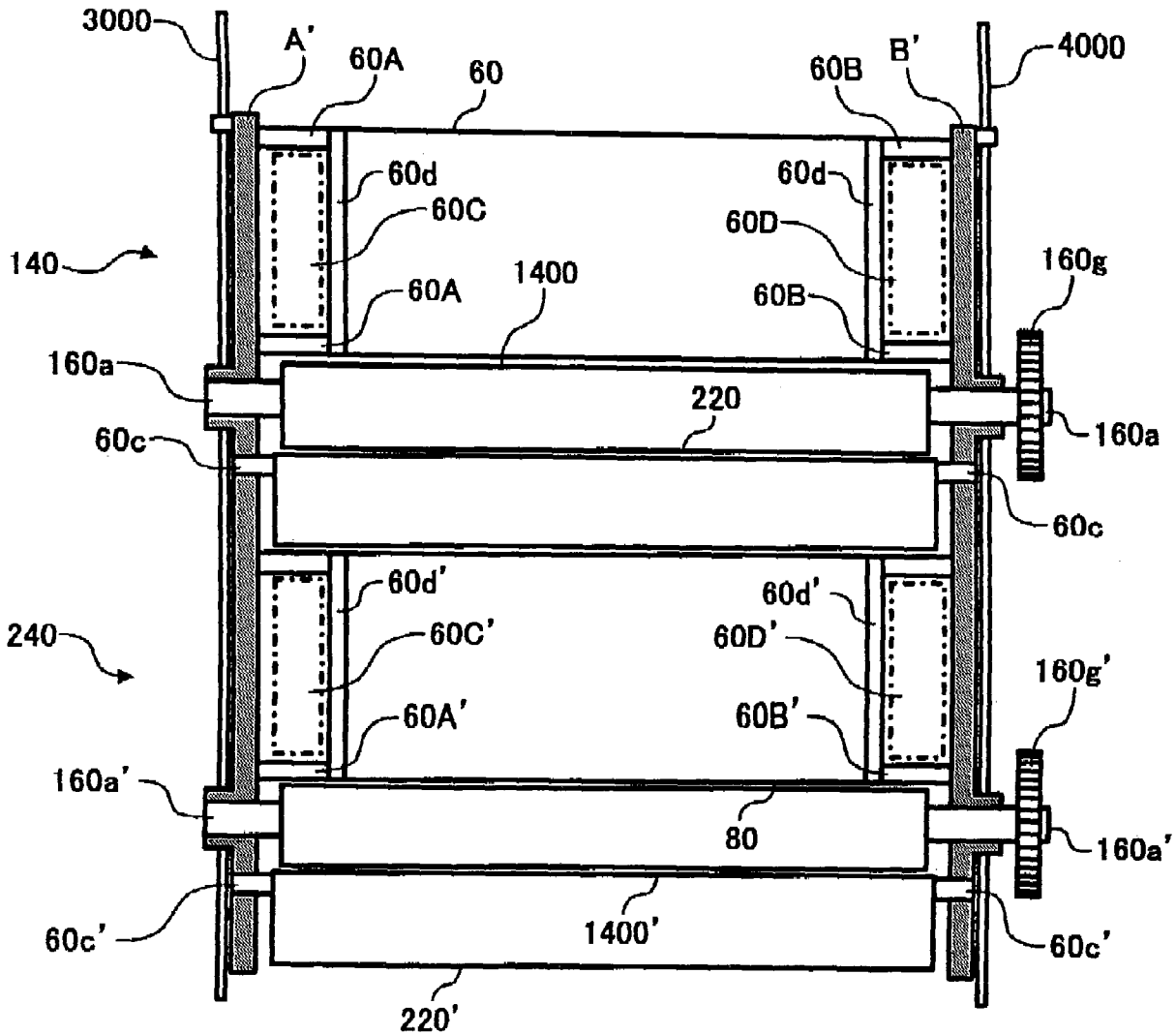
FIG. 22 is a fragmentary section of the first image station, as seen from the above.

FIG. 22 shows another modification of the illustrative embodiment. In the illustrative embodiment and modification thereof described above, a pair of subsidiary side walls A and B are assigned to each of the image stations 140 and 240. In the modification of FIG. 22, the image stations 140 and 240 share a pair of subsidiary side walls A' and B' larger in size than the subsidiary side walls A and b. The developing devices 60 and 80 and cassette cases 220 and 220' assigned to the image stations 140 and 240, respectively, are supported by the subsidiary side walls A' and B' via the side walls 60*d* and 60*d'* of the developing units.

The drum cassettes 1400 and 1400' assigned to the image stations 140 and 240, respectively, each are mounted to the subsidiary side walls A' and B' in such a manner as to be removable alone, facilitating the mounting and dismounting of the image forming sections. As for the rest of the construction, this modification also has the configuration shown in FIG. 3. More specifically, the image station 140 includes the stud shafts 60A and 60B, side portions 60C and 60D, shaft 60*c*, rotary shaft 160*a*, and gear 160*g* while the image station 240 includes stud shafts 60A' and 60B', side portions 60C' and 60D', shaft 60*c'*, rotary shaft 160*a'*, and gear 160*g'*.

The illustrative embodiment will be summarized hereinafter. The drums 160 and 260 each constitute an image carrier inclusive of, e.g., the shaft 160*a* and bearing 160*b*. The holder 1410 and notch 1410*a*-1 formed therein are subsidiary members subsidiary to the image carrier. Each image carrier is mounted to or dismounted from the apparatus body alone together with the subsidiary members. The image carrier with the subsidiary members will be referred to as an image carrier unit, which corresponds to the drum cassette 1400 in the illustrative embodiment.

The subsidiary members subsidiary to the image carrier are not essential for image formation because they simply protect the drum when the drum is placed on, e.g., a table before or after mounting. The notch 1410*a*-1 determines the position of the cassette case 60*a*, i.e., the positions of the cleaning cassette 220 and quenching lamp 5000 relative to the drum cassette 1400. However, the notch 1410*a*-1 is not essential because the cassette case 60*a* can be positioned to an acceptable degree without relying on the notch 1410*a*-1.

The gear or torque inputting means 160*g* may be mounted on the drum cassette 1400 beforehand or after the drum cassette 1400 has been mounted to the apparatus body. If the gear 160*g* is mounted to the drum cassette 1400 beforehand, then the gear 160*g* can be automatically brought into mesh with the worm 116W when the drum cassette 1400 is mounted to the apparatus body.

The cleaning cassette 220 is a specific form of a cleaning device. The image transfer roller 390 and image transfer brushes 410 and 420 are a specific form of image transferring means for transferring a toner image to the belt 100. The belt or intermediate image transfer body 100 intervening between the drum 160 and the sheet P and therefore constitutes part of the image transferring device. The cleaning device and image transferring device form part of image forming means.

In the illustrative embodiment, among the image forming means, the drum 160 is removed first, i.e., the subsidiary side wall A supporting the cleaning cassette 220 and developing device 60 cannot be removed before the drum 160. While the crux of the present invention is removing a structural element with the shortest life first, removing the drum 160 first is practical. The drum 160 is removed upward. The image transferring device including the roller 390, brushes 410 and 420 and belt 100 are arranged above the drum 160 for layout reasons.

Figure 23:
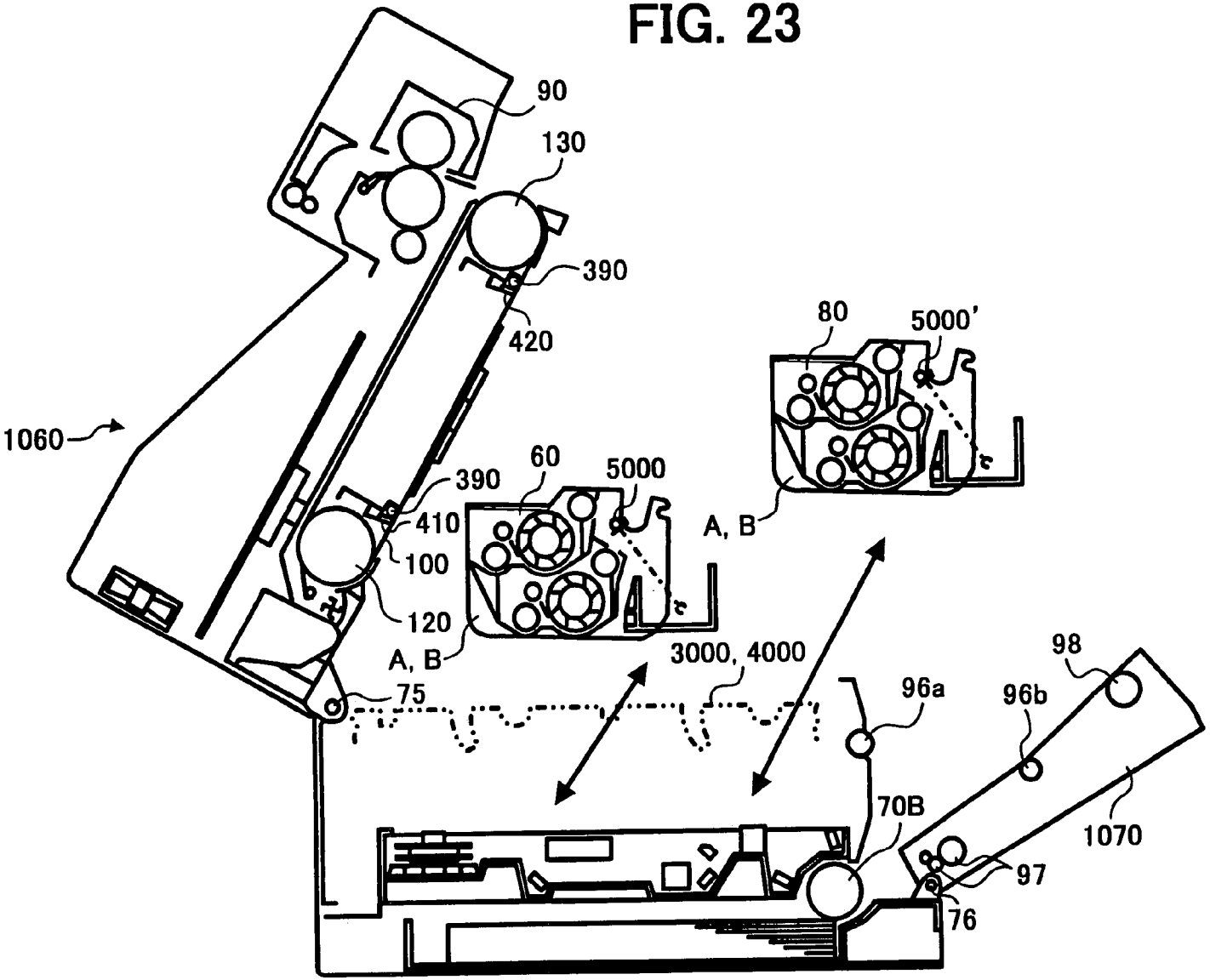
FIG. 23 demonstrates the removal of the image station from the apparatus body.

As shown in FIG. 23, in the illustrative embodiment, the image transfer roller 390 and brushes 410 and 420 are mounted on an upper casing 1060 together with the belt or intermediate image transfer body 100. The upper casing 1060 is angularly movable, or openable, about a shaft 75 to a position not obstructing the removal of, e.g., the drum 160. Also, a cover 1070 is openable about a shaft 76 for facilitating the removal. More specifically, when the upper casing 1060 supporting the roller 390 and brushes 410 and 420 is opened, a space for mounting or dismounting, e.g., the drum cassette 1400 is formed.

The upper casing 1060 is a specific form of an openable member movable relative to the side walls 3000 and 4000 or 3000' or 4000'. As shown in FIG. 15 by way of example, the subsidiary side walls A and B supporting the developing devices 60 and 80 are mounted on the side walls 3000 and 4000, respectively. The drum 160 (260) located at a position closest to the space formed above the side walls 3000 and 4000, i.e., subsidiary side walls A and B when the upper casing 1060 is opened, so that the drum 160 (260) can be replaced together with the drum cassette 1400 via the above space.

Although the roller 390 and brushes 410 and 420 for image transfer and belt 100 disposed above the drum 160 do not constitute the entire image transferring means, they are mounted on the upper casing 1060 and can therefore be retracted together when the upper casing 1060 is opened.

FIG. 23 shows a specific mode in which the subsidiary side wall A (B) is removed from the apparatus body after the removal of the cleaning cassette 220. This mode is effective in the case of maintenance of the kind unable to be performed unless the cleaning cassette 220 is removed. Alternatively, the subsidiary side wall A (B) may be removed from the side walls 3000 and 4000 while supporting the cleaning cassette 220 after the removal of the drum cassette 1400. This is also true when the common mount members 900, 1100, 1300, 1500, FIG. 20, are used. Mounting or dismounting the subsidiary side wall A (B) carrying the cleaning cassette 220 therewith is more efficient than sequentially assembling the structural elements one by one. In this manner, the subsidiary side wall A (B) supporting only the developing device 60 or the subassembly including it can be mounted or dismounted to the apparatus body, facilitating maintenance required.

The drum cassette 1400 is mounted to the subsidiary side wall (A) that supports the developing device 60. The cleaning case 230, which forms the frame of the cleaning device, is removably engaged with the cassette case 60*a* supported by the subsidiary side wall A (B), setting a positional relation between the cleaning means 210 and the drum 160. As shown in FIG. 10 by way of example, the cleaning blade 210*a* included in the cleaning means 210 is pressed against the drum 160 in the counter direction. The position where the cleaning blade 210*a* is pressed against the drum 160 and the degree of pressure are important in effecting adequate cleaning. Also, the seal roller 210*b* must be accurately positioned relative to the drum 160 in order to exhibit the expected sealing function.

The charge roller or charger 170 is mounted on the cleaning case 230 and therefore accurately positioned relative to the drum 160 like the cleaning means 210.

By comparing FIGS. 10 and 11, it will be seen that the cassette case 60*a* is movable toward and away from the drum 160 about the shaft 60*c* together with part of the cleaning cassette 220, i.e., the cleaning blade 210*a* and seal roller 210*b*. The cleaning cassette or cleaning device 220 is removably received in the cassette case 60*a*. As shown in FIG. 11, when the drum 160 is to be removed, the cassette case 60*a* is angularly moved to move the cleaning blade 210*a* and seal roller 210*b* away from the drum 160. In this condition, the drum 160 can be removed without the cleaning blade 210*a* contacting the drum 160 in the counter direction and damaging it.

The U-shaped holder 5010 angularly movable about the shaft 5020 relative to the cassette case 60*a* constitutes the locking mechanism together with the shaft 5020, as stated earlier. As shown in FIGS. 10 through 12, so long as the cleaning cassette 220 is mounted on the subsidiary side wall A (B), the cleaning cassette 220 can be supported by the developing device 60 via the subsidiary side wall A (B).

To remove the cleaning cassette 220 from the subsidiary side wall A (B), after the drum cassette 1400 has been removed, the holder 5010 is angularly moved to the oval portion 60*d*-11 of the notch 60*d*-1. In this condition, the drum cassette 1400 cannot be set in the oval portion 60*d*-11, so that the user is prevented from inadvertently mounting the drum cassette 1400 to the subsidiary side wall A (B) before mounting the cleaning cassette 220. Also, when the holder 5010 is so moved, the cleaning cassette 220 is unlocked and can therefore be replaced alone.

More specifically, as shown in FIG. 12 by way of example, when the cleaning cassette 220 is locked to the cassette case 60*a* by the holder 5010, the quenching lamp 5000 moves toward or away from the drum 160 together with the cleaning cassette 220 in accordance with the movement of the cassette case 60*a*. To exhibit the expected discharging function, the quenching lamp 5000 must be located at a preselected position adjacent the drum 160 and must therefore be retracted before the removal of the drum 160. In the illustrative embodiment, exclusive moving means for so moving the quenching lamp 5000 is not necessary because the quenching lamp 5000 is movable toward and away from the drum 160 together with the cleaning cassette 220.

When the drum cassette 1400 is mounted, the holder 5010 abuts against the drum cassette 1400 and cannot be operated. To allow the holder 5010 to be operated and moved to the range stated above, it is necessary for the drum cassette 1400 to be dismounted from the apparatus body beforehand. In this manner, the cleaning cassette 220 cannot be removed before the drum cassette 1400. Stated another way, the highest priority is given to the drum 160 as to dismounting.

Only the first lever 3040*b* positioned outward of the subsidiary side wall A (B) can be operated when the developing device 60, cleaning cassette 220 and drum cassette 1400 are mounted on the apparatus body via the side wall A (B). Therefore, the user cannot remove the cleaning cassette 220 without turning the first lever 3040*a* to release the notch

3040*b*-2 from the shaft 60*a*-2. When the first lever 3040*b* is so turned, the cassette case 60*a* is moved about the shaft 60*c* from the position shown in FIG. 10 to the position shown in FIG. 11, moving the cleaning means 210 away from the drum 160. Subsequently, as shown in FIG. 12, the drum cassette 1400 is removed, and then the holder 5010 is released. Only after such a procedure, the cleaning cassette 220 can be removed, as shown in FIG. 14.

As stated above, the highest priority is given to the drum 160 as to dismounting by mechanical arrangements. In addition, the cleaning means 210 is released from the drum 160 before the dismounting of the drum 160.

As shown in FIG. 23, although the upper casing 1060 is opened away from the space available for the removal, the developing device 60 and subsidiary side wall A (B) cannot be removed unless the drum cassette 1400 and cleaning cassette 220 are removed from the subsidiary side wall A (B) beforehand; otherwise, they might interfere with the upper casing 1060.

As stated above, the illustrative embodiment has the following characteristic arrangements (1) through (4).

(1) The image forming means including the developing device, drum cassette, charger and cleaning cassette are assembled integrally with each other via the subsidiary side walls, constituting the image station.

(2) The image station is removable from the side walls of the apparatus body together with the image forming means except for the drum cassette.

(3) The drum cassette, which is replaced more often, is removable from the subsidiary side walls, but the removal of the image station from the apparatus body (2) cannot be done unless the drum cassette is removed from the image station beforehand.

(4) The cleaning cassette, which includes the charging means and needs replacement although not as frequently as the drum cassette, is removable from the image station or subsidiary side walls, but the cleaning cassette cannot be removed from the image station unless the drum cassette is removed from the image station beforehand.

Second Embodiment

Specific examples of an alternative embodiment of the present invention that reinforces the previous embodiment will be described hereinafter.

EXAMPLE 1

Example 1 of the alternative embodiment will be described, taking the first image station 140 shown in FIG. 24 as an example. As shown, the subsidiary side wall A (B) supports the developing device 60 as in the previous embodiment. The subsidiary side wall A (B) is so sized and configured as to conceal and protect the gears and shafts of the developing device 60 and other drive members as well as toner replenishing opening. Further, the subsidiary side wall A (B) supports the drum cassette 1400 and cleaning cassette 220 such that the cassettes 1400 and 220 each are removable alone.

The developing device 60, drum cassette 1400 and cleaning cassette 220 joined together via the subsidiary side wall A (B) constitute the first image station 140. The first image station 140 is removably mounted to the positioning portions of the side walls 3000 and 4000 by using the subsidiary side wall A (B) as a reference.

Paying attention to the short life of the drum 160 and therefore frequent replacement of the drum cassette 1400, the previous embodiment is constructed to enhance easy replacement by the user, resource saving, and loads on environment. More specifically, in the previous embodiment, the drum cassette 1400 is dismounted from the image station alone with the highest priority and mounted to the same alone last. This makes it needless to replace the other parts still usable and noticeably facilitates replacement. Further, after the removal of the drum cassette 1400, the cleaning cassette 220 can be replaced alone or the first image station 140, i.e., the subsidiary side walls A and B can be mounted or dismounted.

On the other hand, considering the assembly line and user-oriented maintenance, which includes the replacement of the entire image station 140 and cleaning of the inside of the apparatus body, it is also necessary that the image station 140 be removable from the apparatus body with the drum cassette 1400 and, of course, the developing device 60 and cleaning cassette 220 being supported by the subsidiary side walls A and B. However, simply allowing the image station 140 to be removed with the subsidiary side walls A and B supporting the drum 160 would be similar to the conventional scheme that joins the drum implemented as a process cartridge and the other process means, losing the advantages of the previous embodiment.

In light of the above, Example 1 is constructed such that the drum cassette 1400 can be removed alone and that the image station 140 can be bodily removed from the apparatus body together with the drum cassette 1400, as needed. Mechanisms for mounting and dismounting the drum cassette 1400, cleaning cassette 220 and image station 140, i.e., the subsidiary side walls A and B are open to choice and are identical with the mechanisms of the previous embodiment.

FIG. 24 shows a condition just after the image station 140 having the developing device 60, drum cassette 1400 and cleaning cassette 220 supported by the subsidiary side walls A (B) has been removed from the apparatus body or just before the former is mounted to the latter. In practice, however, the removal of the image station 140 is rarely effected in such a condition, as stated above. The drum cassette 1400 and cleaning cassette 220 are, in many cases, mounted to the image station 140 present on the apparatus body. The second image station 240 is identical in configuration with the first image station 140 and will not be described specifically in order to avoid redundancy.

EXAMPLE 2

Figure 26:
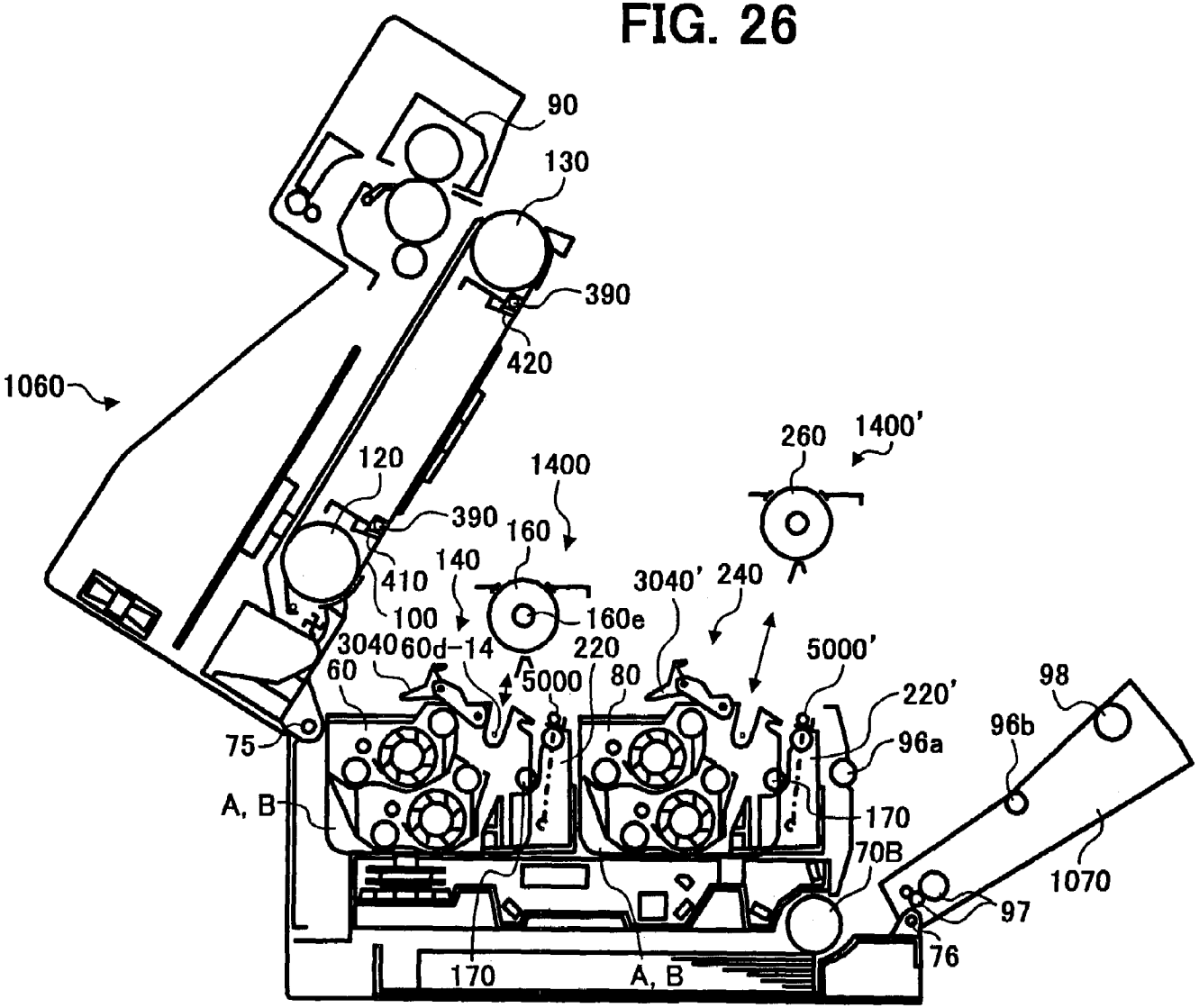
FIG. 26 shows the apparatus body from which the drum is directly dismounted.

As for another rare case, the user is allowed to clean the inside of the apparatus body by the following procedure. The user removes the first and second image stations 140 and 240 from the side walls 3000 and 4000 of the apparatus body, puts them on, e.g., a table, and then starts cleaning the inside of the apparatus body. The image stations 140 and 240 are configured to remain stable of the table, as stated earlier. The user may remove each of the drum cassettes 1400 and 1400' from the image station 140 or 240, i.e., the subsidiary side walls A and B from the image station 140 or 240. After cleaning, the user mounts the drum, cassettes 1400 and 1400' to the image stations 140 and 240, respectively, and then mounts the image stations 140 and 240 to the apparatus body. Alternatively, as shown in FIG. 26, the user may mount the image stations 140 and 240 without the drum cassettes 1400 and 1400' to the apparatus body and then mount the drum cassettes 1400 and 1400' to the image stations 140 and 240. The former procedure is more efficient to perform than the latter procedure.

In the procedure shown in FIG. 26, the drum cassettes 1400 and 1400' can, of course, be removed from the image stations 140 and 240 present on the apparatus body.

EXAMPLE 3

Again, the image stations 140 and 240 are removable from the side walls 3000 and 4000 while carrying the drum cassettes 1400 and 1400', respectively, therewith, so that the user can clean the inside of the apparatus body. In Example 3, the cleaning cassettes 220 and 220' can also be removed alone from the image stations 140 and 240, i.e., the subsidiary side walls A and B, respectively, dismounted from the apparatus body. This allows the user to replace even the cleaning cassettes 220 and 220', as needed.

Figure 27:
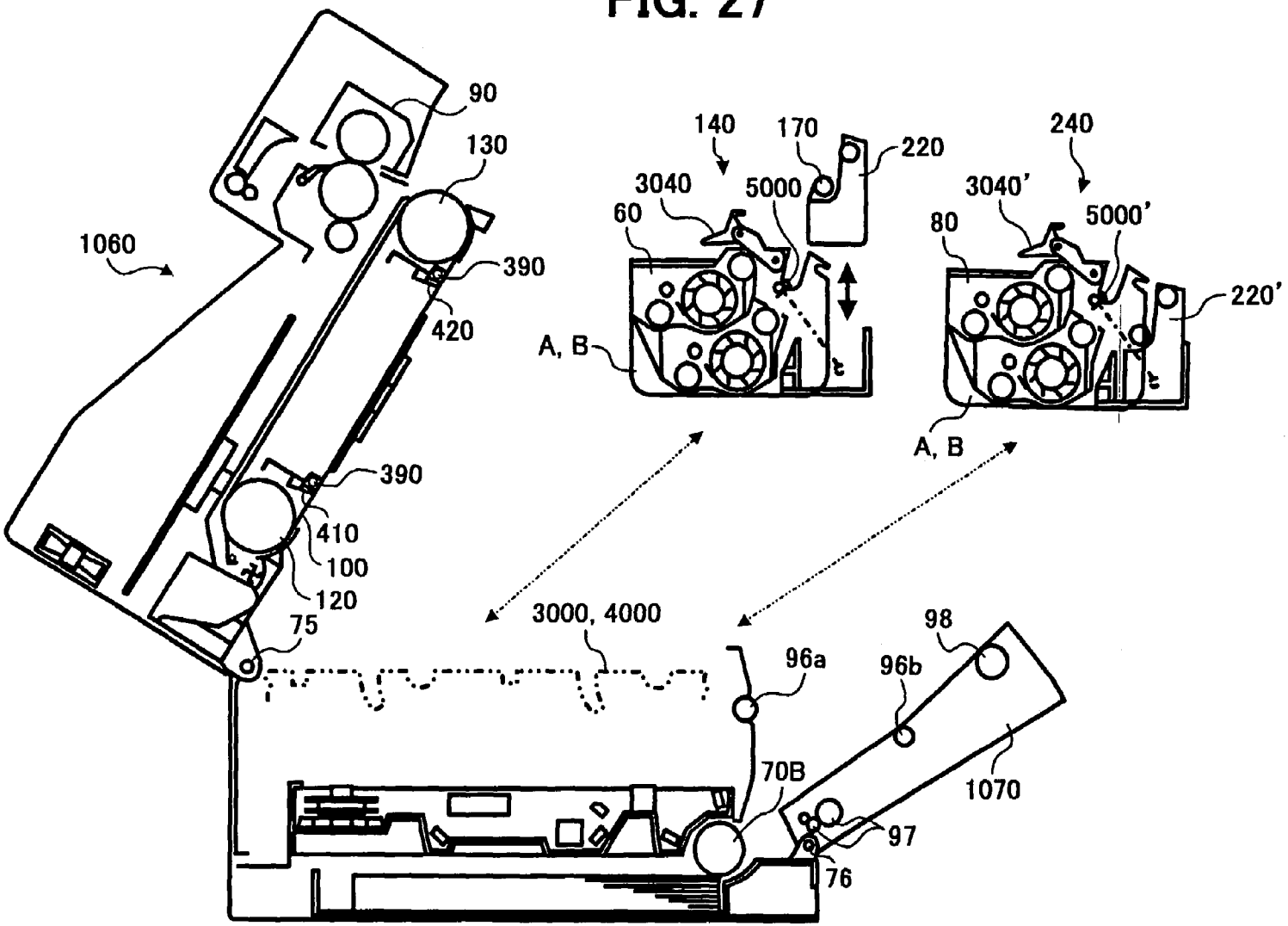
FIG. 27 shows the apparatus body from which the image station is directly dismounted.
Figure 28:
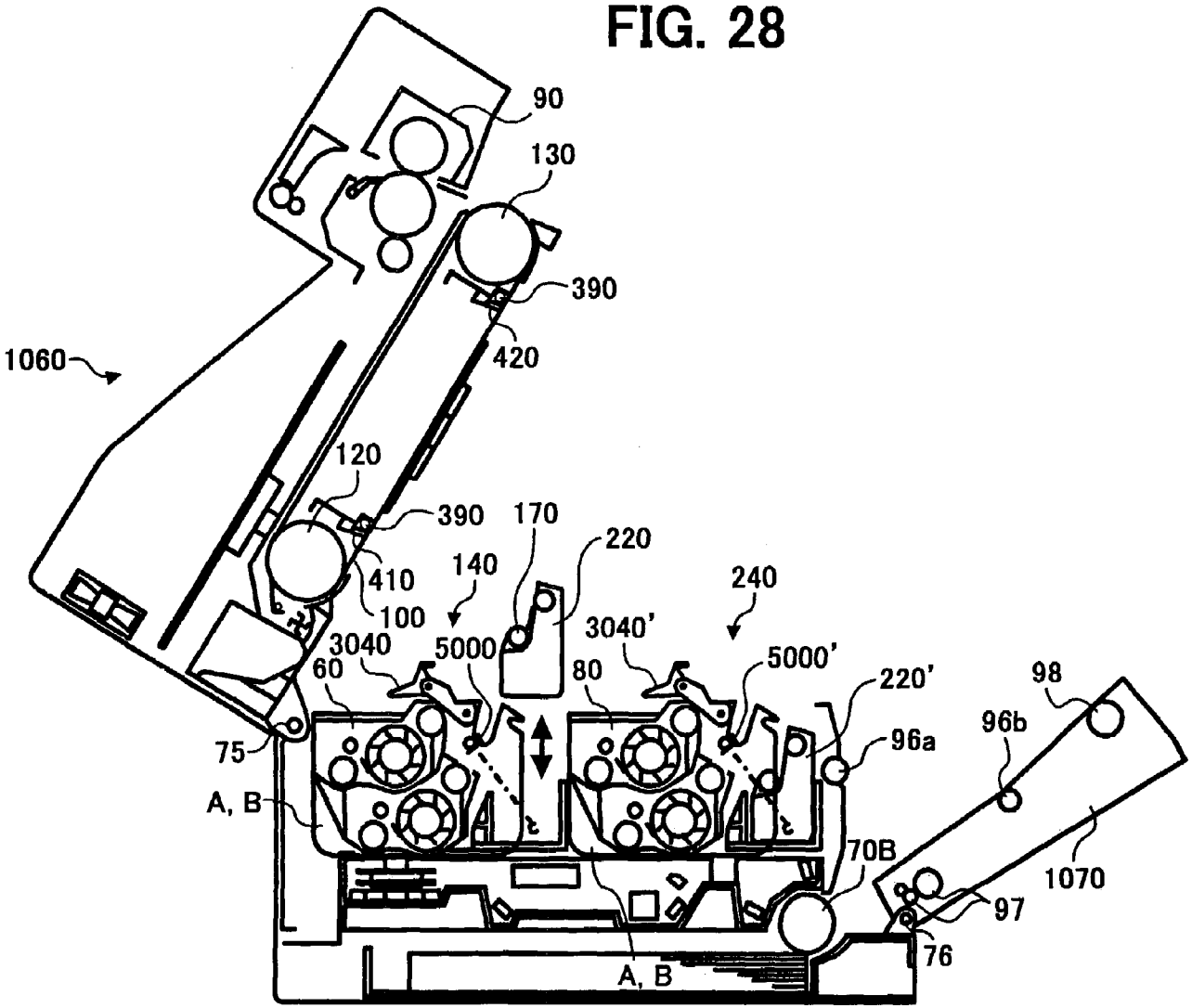
FIG. 28 demonstrates how the cleaning cassette is dismounted from the apparatus body.

More specifically, the cleaning cassettes 220 and 220' each are removed after the drum cassette 1400 or 1400' associated therewith or mounted before the drum cassette 1400 or 1400'. This is why FIG. 27 shows a condition wherein the drum cassettes 1400 and 1400' have been removed. After cleaning, the user mounts the cleaning cassette 220 and 220' to the image stations 140 and 240, i.e., the subsidiary side walls A and B, respectively, and then mounts the image stations 140 and 240 to the apparatus body. Alternatively, as shown in FIG. 28, the user may mount the image stations 140 and 240 without the cleaning cassettes 220 and 220' to the apparatus body and then mount the cleaning cassettes 220 and 220' to the image stations 140 and 240, respectively. The former procedure is more efficient to perform than the latter procedure.

Figure 25:
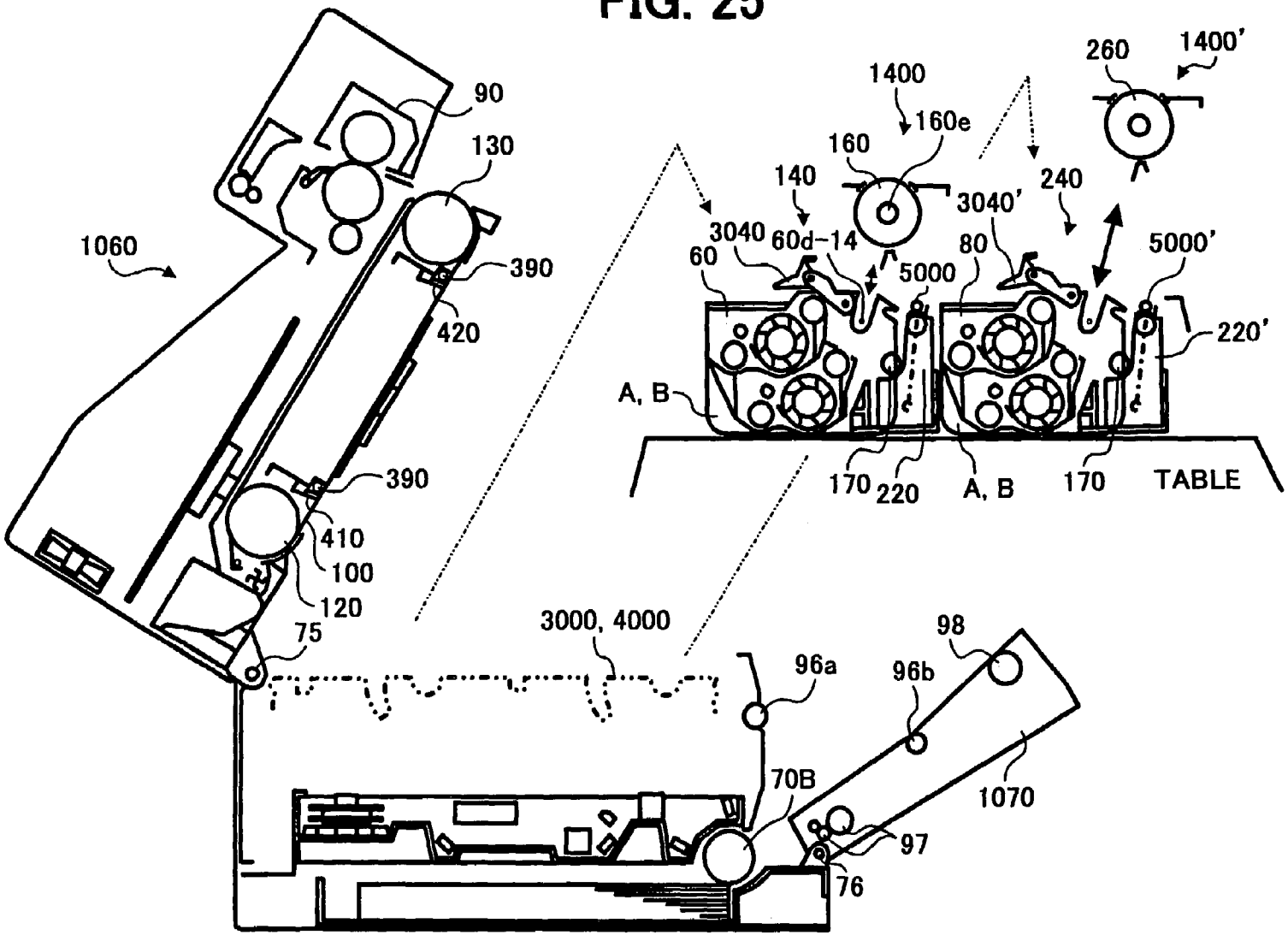
FIG. 25 demonstrates a procedure in which the image station is removed from the apparatus body, and then the drum is removed from the image station.

Subsequently, the user mounts the drum cassettes 1400 and 1400', as described with reference to FIGS. 25 and 26. In the condition shown in FIG. 28, the user can, of course, remove the cleaning cassettes 220 and 220' after removing the drum cassettes 1400 and 1400' from the image stations 140 and 240', respectively.

In Examples 1 and 2, the drum cassettes 1400 and 1400' and cleaning cassettes 220 and 220' are mounted or dismounted in a particular sequence. By contrast, Example 3 has no particular sequence as to mounting or dismounting. For example, the drum cassettes 1400 and 1400' and cleaning cassettes 220 and 220' may be mounted or dismounted in the reverse order or may even be mounted or dismounted without any order, although not shown or described specifically. This is also true with Examples 4 through 10 to follow.

EXAMPLE 4

In the previous embodiment, the charge roller 170 of, e.g., the first image station 140 is rotatably mounted on the cleaning cassette 220. The charge roller 170 has a life selected to be as long as the life of the cleaning blade and other cleaning means, but to end before the cleaning case 230 is filled up with waste toner, thereby facilitating replacement of the cleaning cassette 220 and obviating waste of parts ascribable thereto.

However, the charge roller 170 is held in contact with or slightly spaced from the drum 160 and applied with a bias and therefore often suffers from unexpected troubles. Moreover, the charge roller 170 needs frequent cleaning because toner deposits adhere thereto; it becomes more difficult to remove such toner with the elapse of time. Moreover, the relation between the life of the charge roller 170 and the time when the cleaning case 230 becomes full is sometimes disturbed. In such a case, the cleaning cassette 220 must be replaced without regard to the expected timing.

Figure 29:
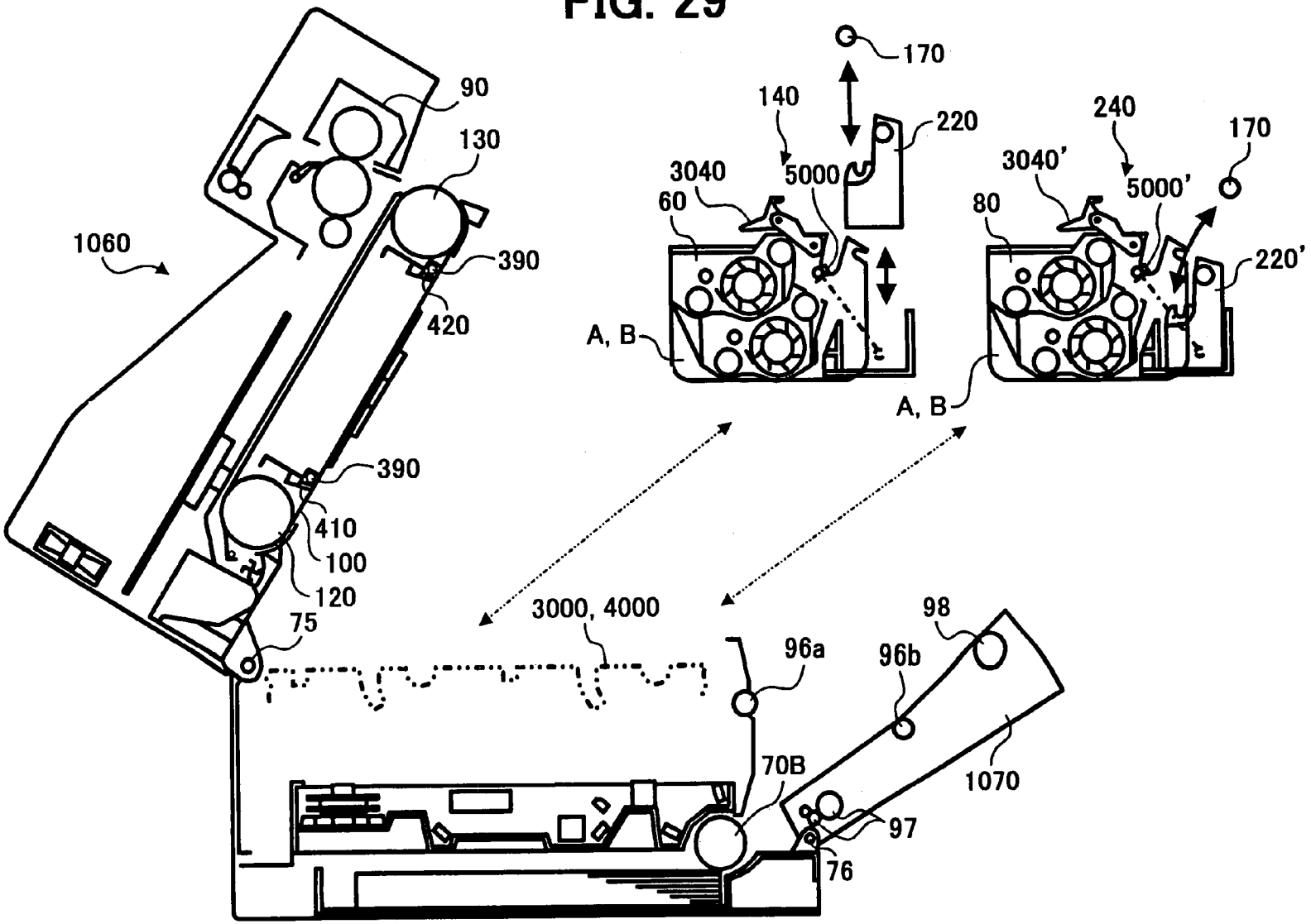
FIG. 29 shows a procedure in which the cleaning cassette, a charger and so forth are removed from the image station dismounted from the apparatus body.

In light of the above, as shown in FIG. 29, Example 4 not only allows the cleaning cassette 220 to be removed from the image station 140, but also allows the charge roller 170 to be removed from the cleaning cassette 220. If the expected life of the charge roller 170 ends and if the cleaning case 230 is about to be filled up with waste toner, then the cleaning cassette 220 should only be replaced at a preselected timing together with the charge roller 170 and cleaning case 230. Further, when the charger 170 needs replacement due to an unexpected trouble or smearing, only the charge roller 170 should be replaced. In addition, when the cleaning case 230 becomes full before the life of the charge roller 170 ends, the cleaning cassette 220 should only be replaced after the removal of the charge roller 170.

The charge roller 170 removed is used again. If desired, the charge roller 170 maybe replaced with a brush, wire, needle or similar charger contacting or not contacting the drum 160. In Example 4, the drum cassette 1400 and cleaning cassette 220 are mounted or dismounted in the same sequence as in Example 3.

EXAMPLE 5

Example 5 is identical with Example 4 except that at the image station 140 the charge roller 170 is removable from the cleaning cassette 220 after the cleaning cassette 220 has been removed from the image station 140, i.e., the subsidiary side walls A and B. Also, at the second image station 240, the charge roller 170 is shown as being removable from the cleaning cassette 220 held on the image station 240.

EXAMPLE 6

As shown in FIG. 29, at the image station 140 or 240 removable from the side walls 3000 and 4000 to allow, e.g., the inside of the apparatus body to be cleaned, the charge roller 170 can be removed from the image station 140 or 240 alone, as needed. More specifically, in Example 6, the charge roller 170 is removable from the cleaning cassette 220 or 220' after the image station 140 or 240 has been dismounted from the apparatus body.

Figure 30:
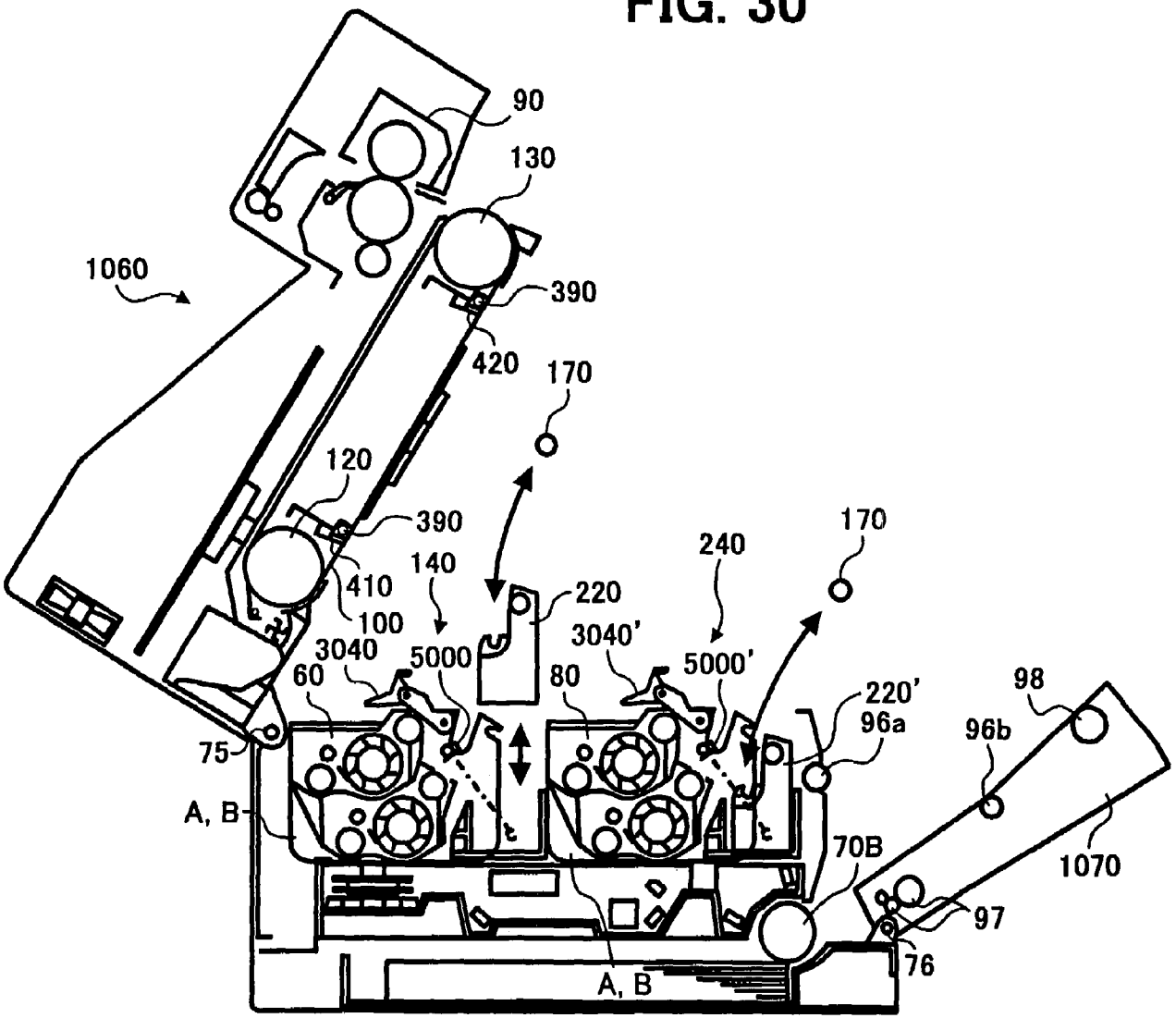
FIG. 30 shows a procedure in which the cleaning cassette, charger and so forth are dismounted from the apparatus body.

The charge roller 170 may be mounted or dismounted with or without the cleaning cassette 220 or 220' being positioned on the image station 140 or 240. Alternatively, as shown in FIG. 30, the charge roller 170 may be mounted or dismounted from the cleaning cassette 220 or 220' with the image station 140 or 240 being positioned on the apparatus body.

In FIG. 29, the image station 140 is representative of a specific sequence in which the image station 140 is removed from the apparatus body, then the cleaning cassette 220 is removed from the image station 140, and then the charge roller 170 is mounted to or dismounted from the cleaning cassette 220. The other image station 240 is representative of another specific sequence in which the charge roller 170 is mounted to or dismounted from the cleaning cassette 220 being positioned on the image station 240. FIG. 30 demonstrates the mounting or dismounting of the charge roller 170 to or from the image station 140 or 240 present on the apparatus body. Usually, the charge roller 170 is replaced more often in the condition of FIG. 23 than in the condition of FIG. 22. At this instant, whether or not the cleaning cassette 220 or 220' is present on the image station 140 or 240 is not questionable.

EXAMPLE 7

Example 7 will be described with reference to FIG. 31, taking the image station 140 as an example. In the first embodiment and Examples 1 through 6 described above, the developing device 60 is constructed integrally with the subsidiary side walls A and B and are mounted or dismounted together with the subsidiary walls A and B when the image station 140 is mounted or dismounted for the following reasons. Today, the long life of a developer and those of developing parts and the replenishment of toner from the outside have made the replacement of the developing device 60 substantially needless. It is therefore not necessary to remove the developing device 60 from the subsidiary side walls A and B. Further, the subsidiary side walls A and B play an important role in determining the positional relation between the apparatus body and the image station 140 and the positional relation between the drum cassette 1400, the cleaning cassette 220 and developing device 60. In this sense, directly mounting the developing device 60 on the subsidiary side walls A and B insures accurate positioning of the developing device 60.

On the other hand, developing devices recently put on the market are implemented by various developing methods and various developing materials that are directed toward higher image quality and higher operation speed. However, unmatured new technologies and materials still have many problems left unsolved and are likely to bring about unexpected troubles during operation. In the illustrative embodiment, although the drum cassette 1400 and cleaning cassette 220 usable despite such a trouble can be dismounted and used again, the developing device 60 must be replaced together with the subsidiary side walls A and B. Replacing even the subsidiary side walls A and B is wasteful.

Example 7 is characterized in that the developing device 60 is removable from the subsidiary side walls A and B alone. This can be done if suitable positioning means are provided on both of the subsidiary side walls A and B and developing device 60 and if a suitable locking mechanism is available.

EXAMPLE 8

Example 8 will also be described with reference to FIG. 31, taking the first image station 140 as an example. In Example 8, the image station 140 from which at least the drum cassette 1400 is removable can be removed from the apparatus body. After the image station 140 has been dismounted and put on, e.g., a table, the developing device 60 is removable from the image station 140, i.e., the subsidiary side walls A and B alone. At this instant, the cleaning cassette 220 can be mounted or dismounted also.

More specifically, the developing device 60 is dismounted from the subsidiary side walls A and B after the drum cassette 1400 or is mounted to the side walls A and B before the drum cassette 1400. It is not questionable which of the cleaning cassette 220 and developing device 60 is mounted or dismounted first.

Figure 31:
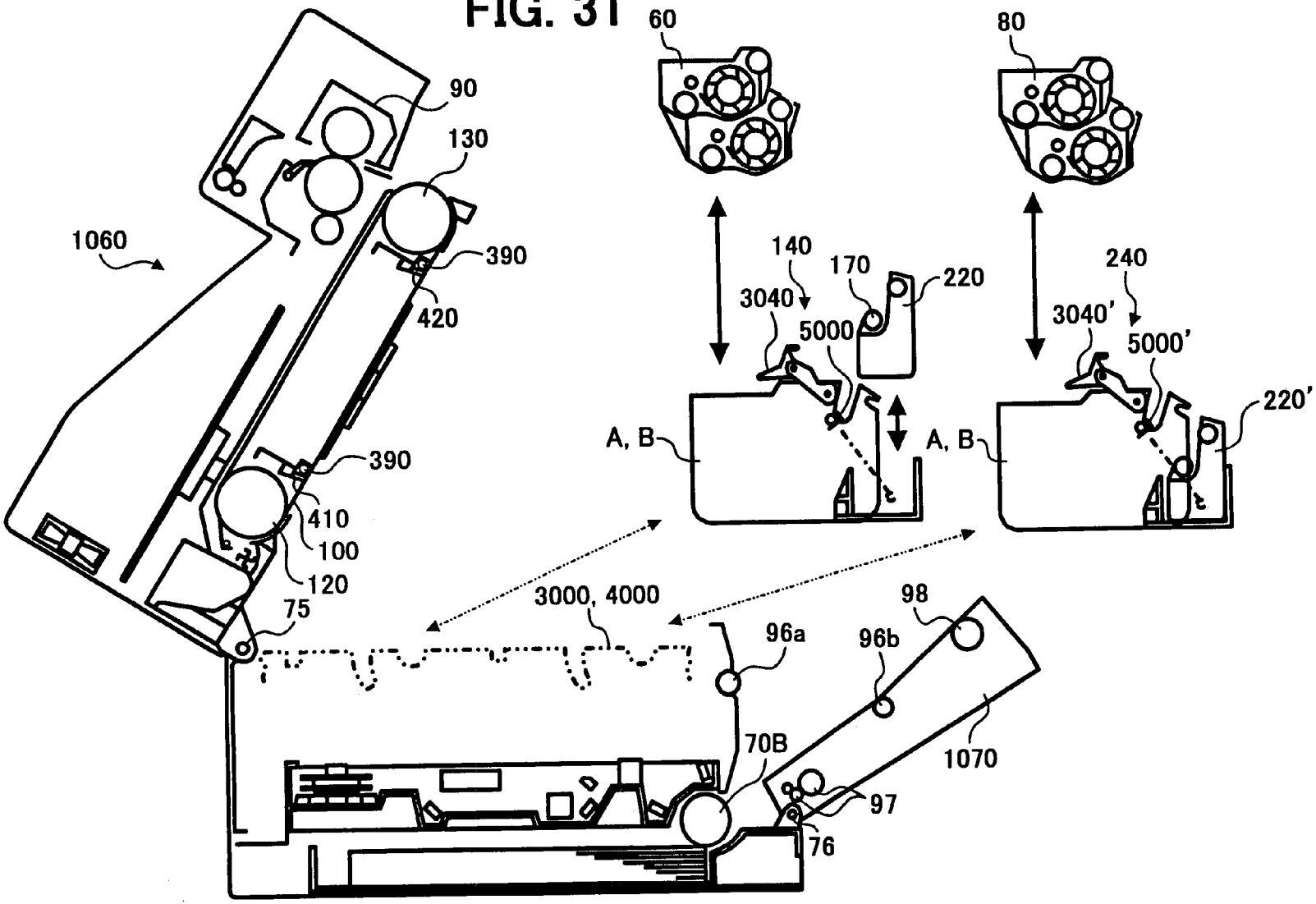
FIG. 31 shows a procedure in which the developing device and cleaning cassette are removed from the image station dismounted from the apparatus body.
Figure 32:
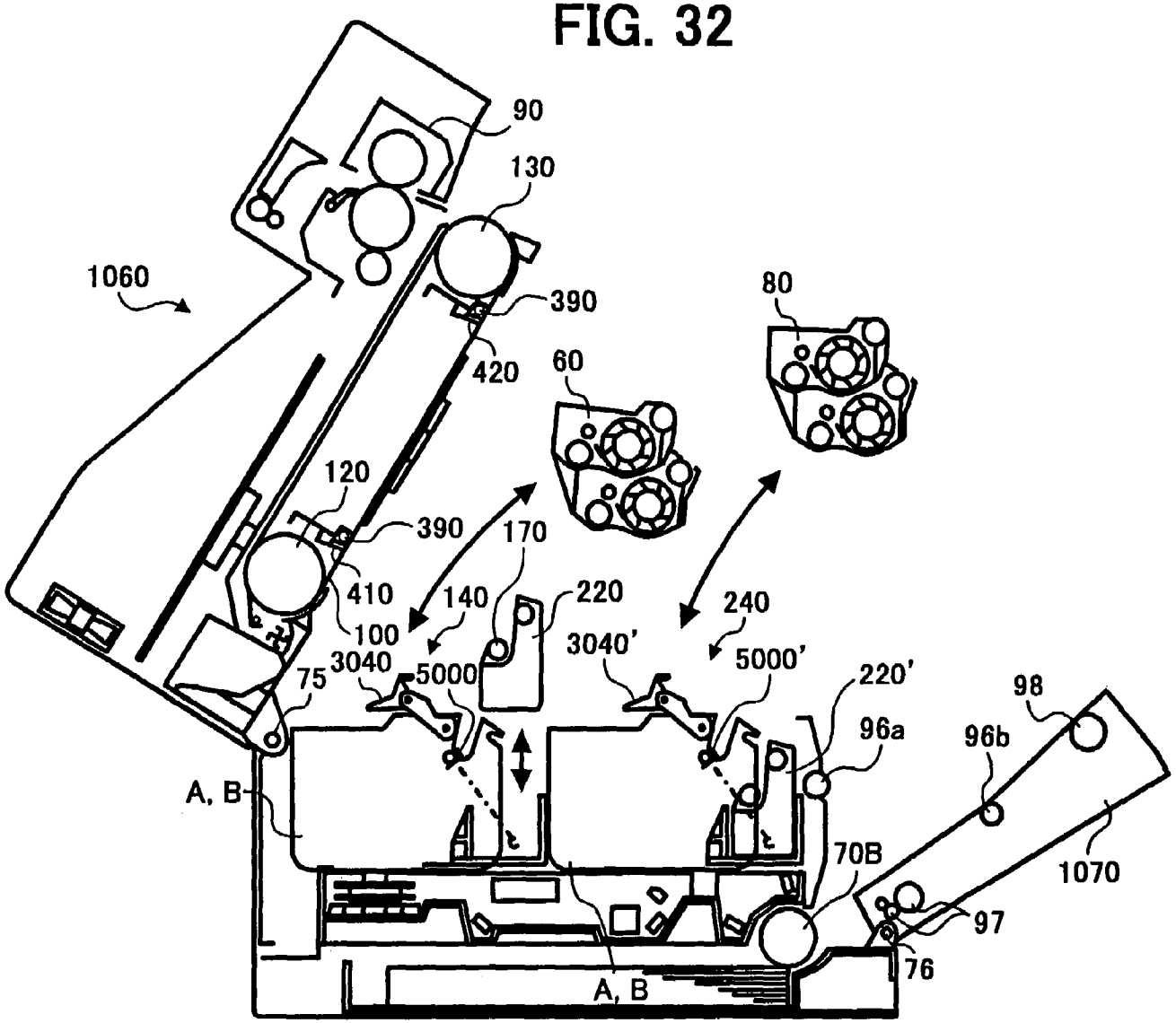
FIG. 32 shows a procedure in which the developing device and cleaning cassette are directly dismounted from the apparatus body.

FIG. 31 shows a condition wherein the drum cassette 1400 has been removed. The image station 140 is mounted to the apparatus body after the developing device 60 has been mounted to the image station 140, i.e., the subsidiary side walls A and B. Alternatively, as shown in FIG. 32, the developing device 60 may be mounted to the image station 140 after the image station 140 without the developing device 60 has been mounted to the apparatus body. The former procedure is more efficient to perform than the latter procedure. While the cleaning cassette 220 may be mounted to the image station 140 any time, the former should preferably be mounted to the latter after the mounting of the developing device 60 from the efficiency standpoint. The drum cassette 1400 is mounted last. In FIG. 32, the developing device 60 is removed from the image station 140 after the removal of the drum cassette 1400.

While Example 8 allows the drum cassette 1400 and image station 140 to be mounted or dismounted in a preselected order, it is not limited to the preselected order. For example, the drum cassette 1400 and image station 140 may be mounted or dismounted in the reverse order or may even be mounted or dismounted without any order.

EXAMPLE 9

In the first embodiment and Examples 1 through 9 described above, the charge roller 170 is mounted on the cleaning cassette 220 or 220' in consideration of its life and efficient replacement. However, charge rollers or chargers highly resistive to a low bias and ozone, i.e., durable and long life have recently been developed. These kinds of charge rollers do not need frequent replacement or do not need replacement at all. Today, therefore, the time for replacing the cleaning cassette 220 or 220' and the time for replacing the long-life charge roller 170, which have heretofore been almost coincident, are noticeably shifted from each other. It follows that constructing the cleaning cassette 220 or 220' and charge roller 170 into a unit is not desirable.

In Example 9, the charge roller 170 extending in life is mounted on the developing device 60 whose life is also extending, constituting a developing device unit. The charge roller 170 is therefore replaced together with the developing device 60. This configuration obviates the waste of parts while insuring efficient replacement and, in addition, accurately positions the charge roller 170 relative to the developing device 60. Moreover, because the developing device 60 is supported by the subsidiary side walls A and B to which the drum cassette 1400 is removably mounted, the drum 160 and charge roller 170 can also be accurately positioned relative to each other.

Figure 33:
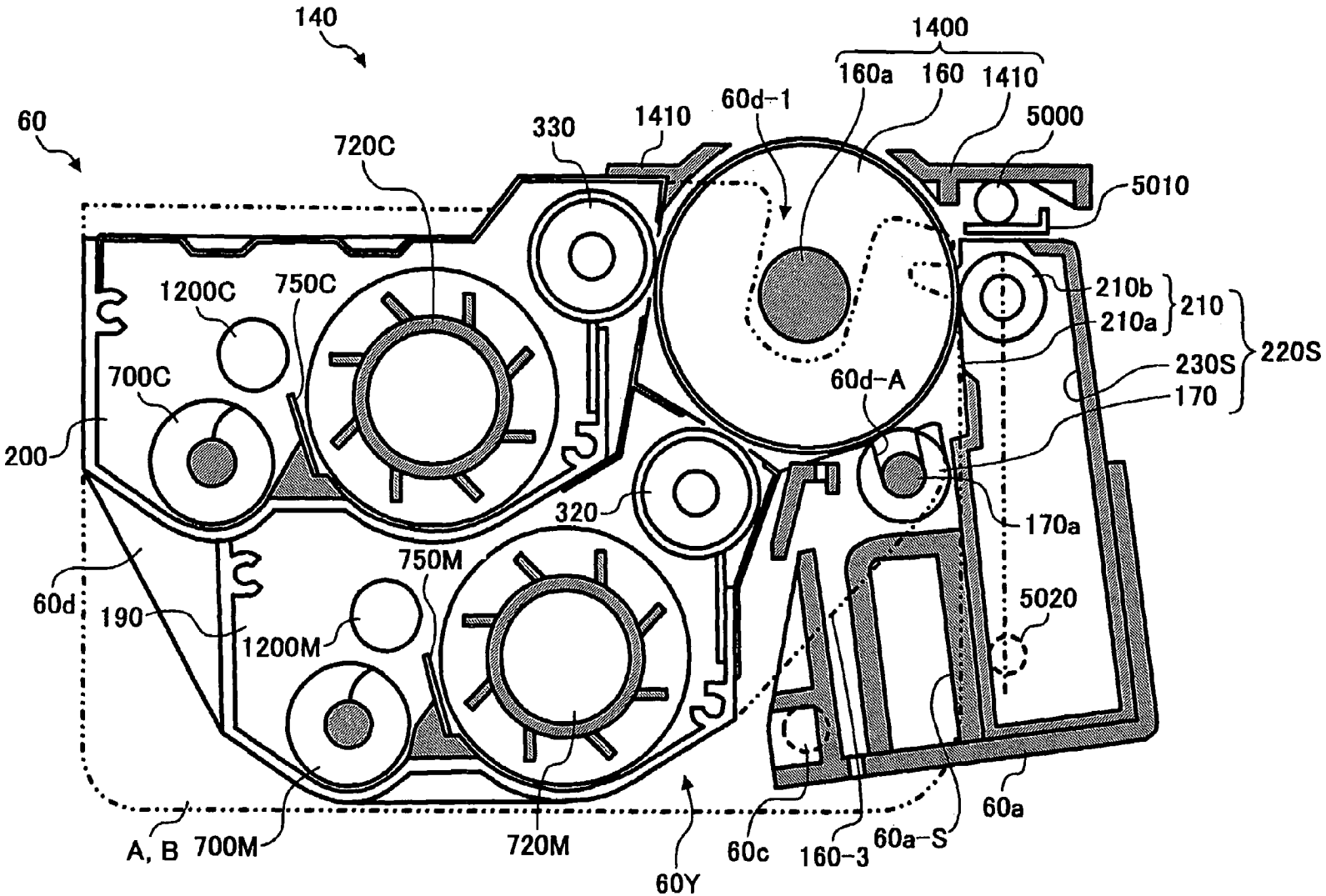
FIG. 33 is a fragmentary section showing the image station.

FIG. 33 shows a specific configuration of the developing device 60 in which the side walls 60*d* of the developing unit support the magenta developing section 190 and cyan developing section 200 at both sides thereof, i.e., at the front side and rear side in the direction perpendicular to the sheet surface of FIG. 33. An arm 160-3 extends from part of each side wall 60*d* to a position below the drum 160, i.e., to the charge roller 170 and supports the charge roller 170. The cleaning cassette, labeled 220S, therefore does not include the charge roller 170.

In the cleaning case 230 stated earlier, the bottom of the cleaning case 230 protrudes in the form of a letter L for supporting the roller 170 and interferes with the drum 160, obstructing the mounting and dismounting of the cleaning cassette 220. By contrast, in Example 9, a cleaning case 230S is sized smaller than the cleaning case 230 in the right-and-left direction, as viewed in FIG. 33, so as not to interfere with the drum 160 in the range over which the drum 160 is moved in the up-and-down direction. A guide rib 60*a*-S is formed on the inner surface of the cassette case 60*a* in accordance with the configuration of the cleaning case 2305 in order to guide the cleaning case 230S. The other image station 240 is identical in construction with the image station 140.

EXAMPLE 10

Example 10 will be described with reference also made to FIG. 33, taking the first image station 140 as an example. As shown, the charge roller 170 is rotatably supported by the arm 160-3 of the developing device 60, constituting the developing device unit 60Y (80Y at the second image station 240). The life of the charge roller 170 is substantially matched to the life of, e.g., the developer, so that the charge roller 170 and developing device 60 are replaced together. However, considering the assembly line, easy disassembly at the time of recycling and easy maintenance, it is more preferable that the charge roller 170 be usually joined with the developing device unit 60Y, but easily removable from the developing device 60 alone.

In light of the above, in Example 10, the charge roller 170 is configured to be removable from the developing device unit 60Y, i.e., the developing device 60. More specifically, the side wall 60*d* supports, at both sides thereof, the developing device 60 including the developing magenta developing section 190 and cyan developing section 200 and supports the charge roller 170, constituting the developing device unit 60Y. The developing device unit 60Y is supported by the subsidiary side walls A and B.

A generally U-shaped notch 60*d*-A is formed in the right end portion of the side wall 60*d* as viewed in FIG. 33. The shaft 170*a* of the charge roller 170 is received in the notch 60*d*-A and positioned thereby. As for the rest of the construction, Example 10 is identical with the previous examples.

In the above configuration, the charge roller 170 is removable from the notch 60*d*-A. The subsidiary side walls A and B not only support the developing device unit 60Y, but also support the cassette case 60*a* such that the cassette case 60*a* is angularly movable about the shaft 60*c*. Further, the shaft 160*a* of the drum 160 is received in the oval notch 60*d*-1 formed in the upper portion of the subsidiary side wall A (B), so that the drum cassette 1400 is removably positioned.

Figure 34:
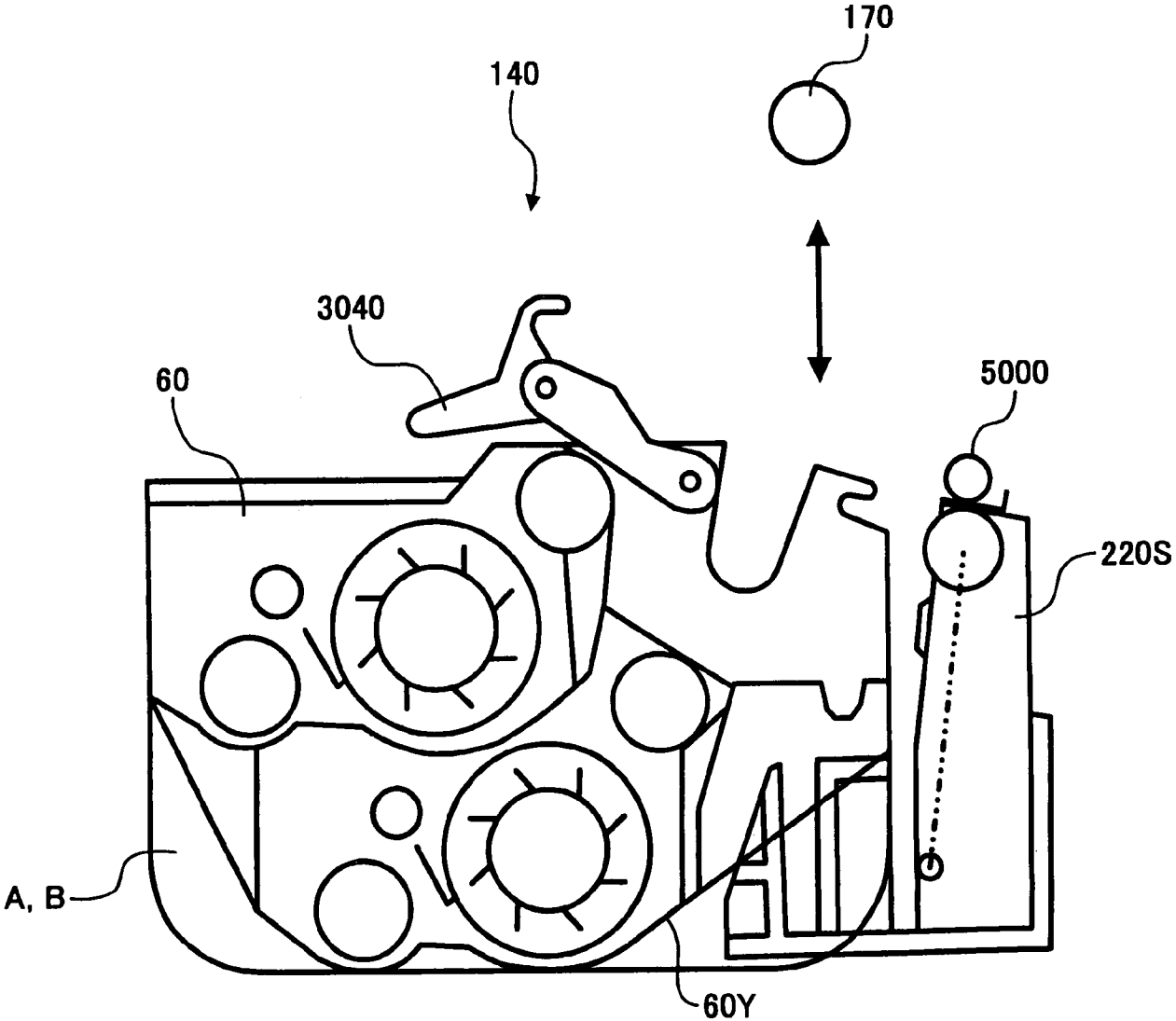
FIG. 34 shows how the charger is removed from the developing device.
Figure 35:
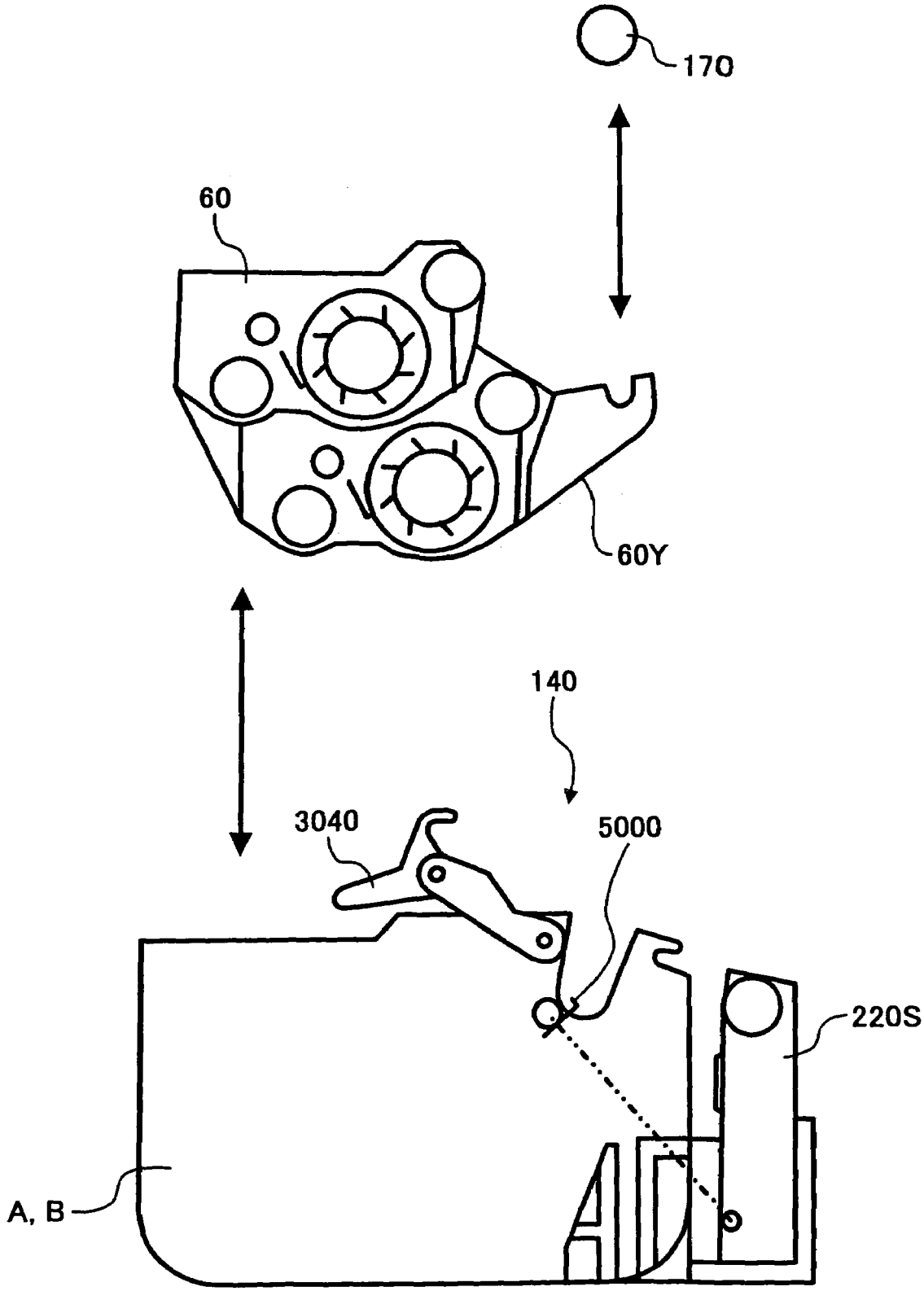
FIG. 35 shows a procedure in which the charger is removed from the developing device dismounted from the image station.

FIG. 34 shows a specific configuration in which the charge roller 170 is removable from the developing device unit 60Y supported by the subsidiary side wall A (B). FIG. 35 shows another specific configuration in which the charger roller 170 is removable from the developing device unit 60Y after the developing device unit 60Y has been removed from the subsidiary side wall A (B).

Figure 36:
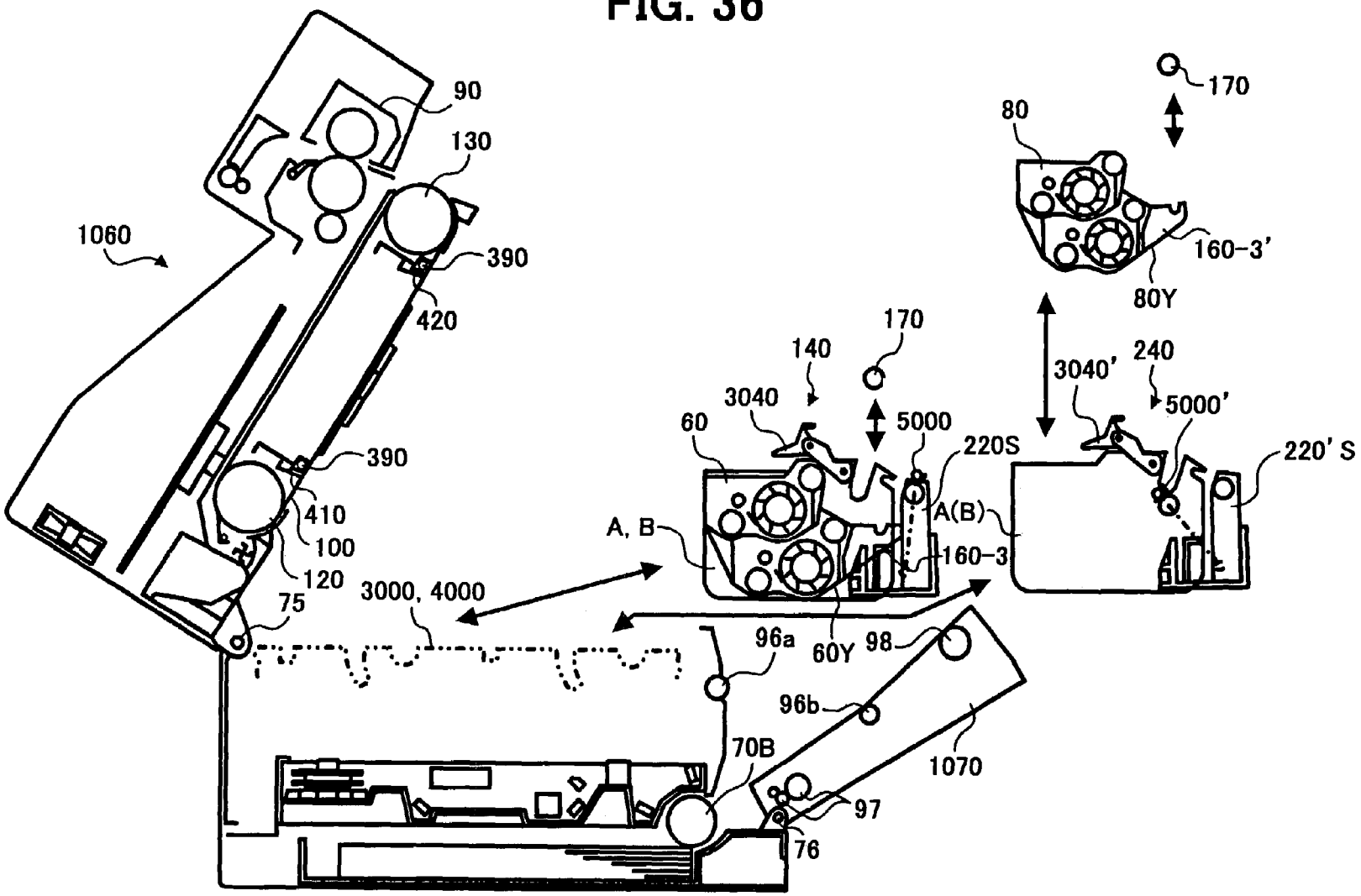
FIG. 36 shows a procedure in which the developing device and charger are removed from the image station dismounted from the apparatus body.

FIG. 36 shows the second image station 240 configured such that the charge roller 170 is removable from the developing device unit 80Y removed from the second image station 240 (subsidiary side walls A and B), which, in turn, has been removed from the apparatus body. In FIG. 36, the first image station 140 is configured such that the charge roller 170 is removed from the developing device unit 60Y held on the image station 140 (subsidiary side walls A and B), which, in turn, has been removed from the apparatus body. Whether or not the cleaning cassettes 220S and 220S' are dismounted is not questionable.

Figure 37:
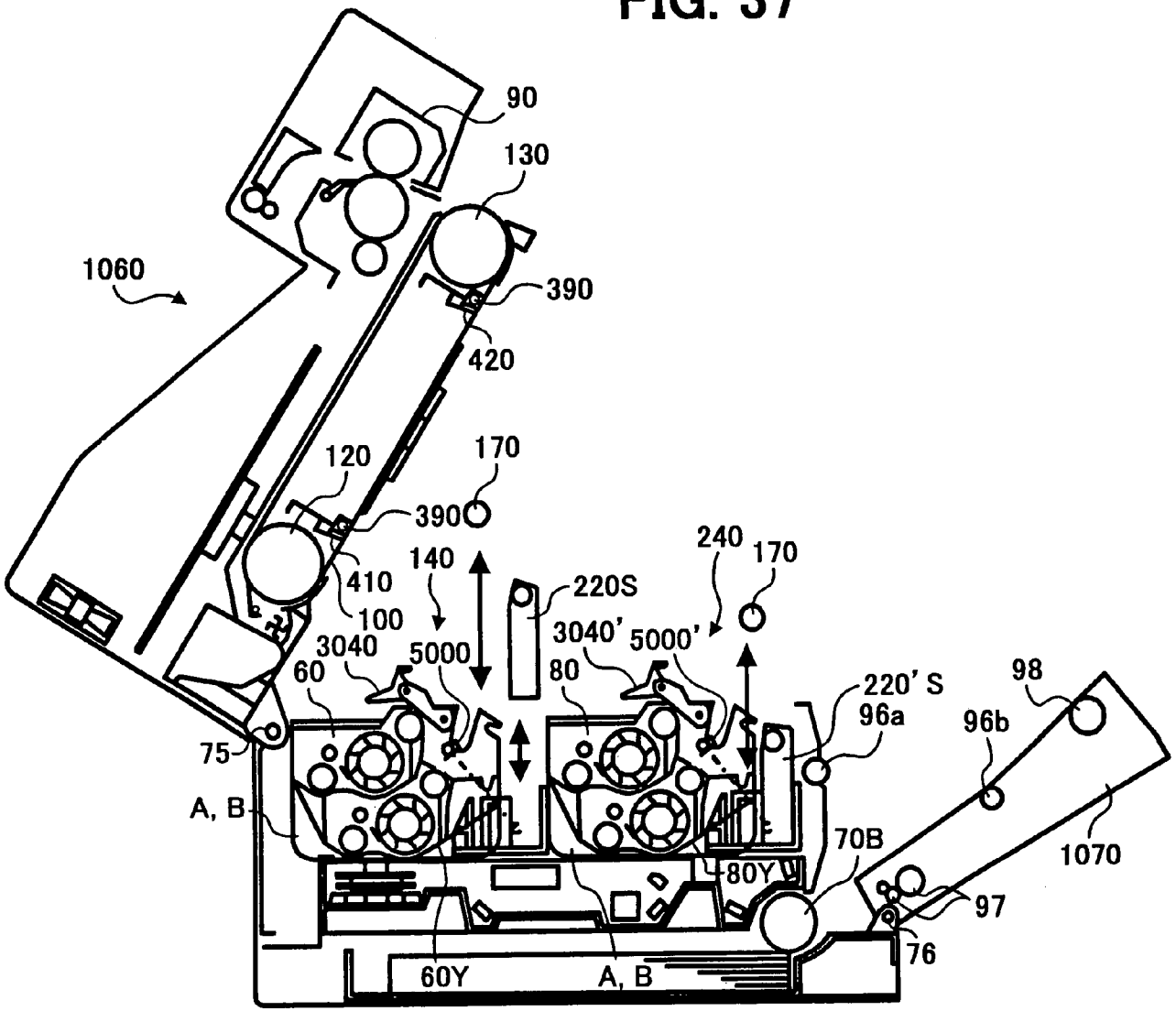
FIG. 37 shows how the cleaning cassette and charger are dismounted from the apparatus body.

FIG. 37 shows a procedure for removing the charge roller 170 from each of the first and second image stations 140 and 240 (subsidiary side walls A and B) held on the apparatus body. Usually, the procedure shown in FIG. 37 is executed more often than the procedure shown in FIG. 36. At this instant, whether or not the cleaning cassette 220S or 220S' is dismounted is not questionable.

Figure 38:
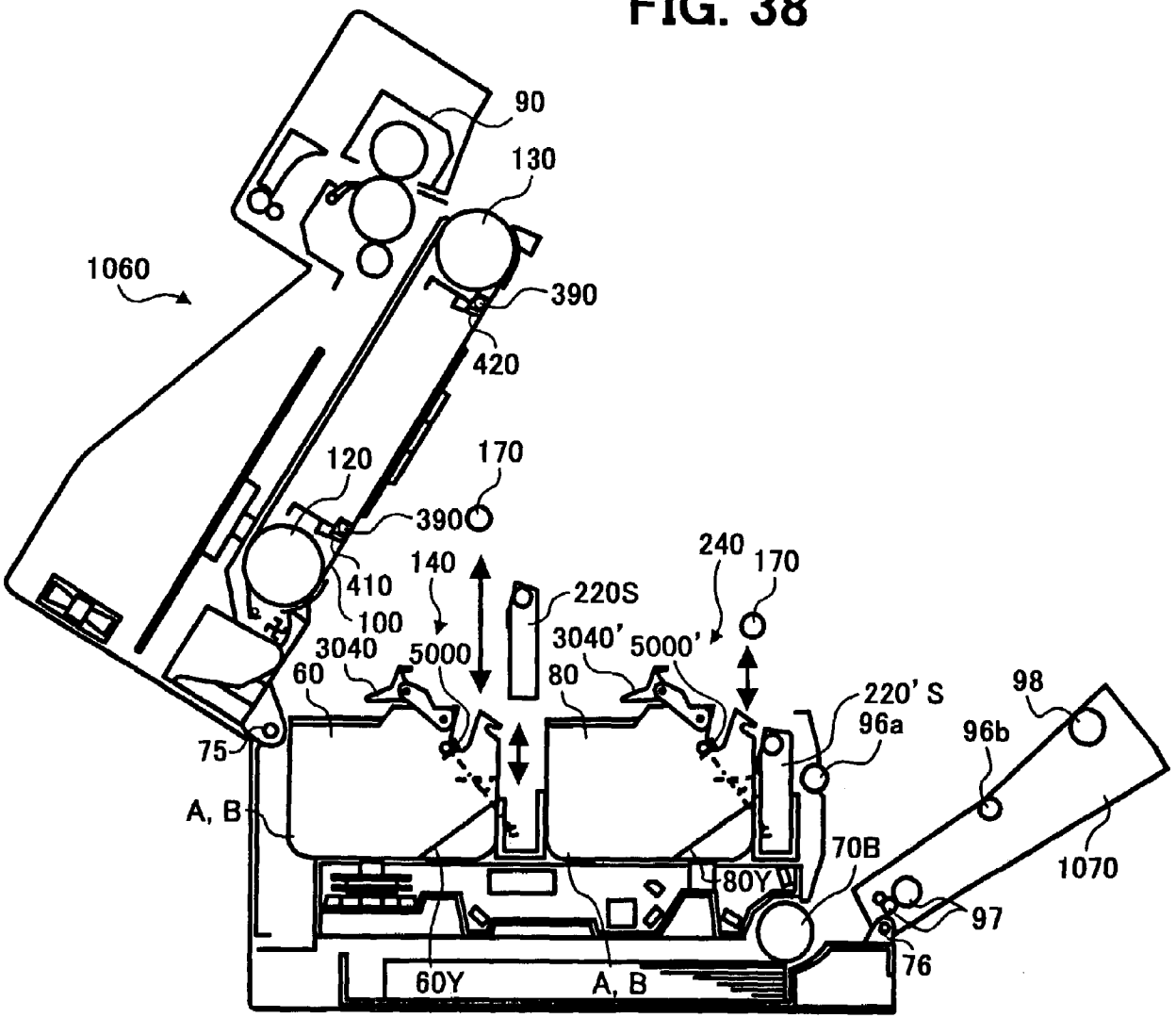
FIG. 38 shows how the cleaning cassette and charger are dismounted from the apparatus body.

FIG. 38 demonstrates a case wherein the charge roller 170 is directly mounted to the subsidiary side walls A and B at each of the image stations 140 and 240 such that the former is removable from the latter.

In summary, it will be seen that the present invention provides a two-station color image forming apparatus having various unprecedented advantages, as enumerated below.

(1) An intermediate member allows a developing device to be replaced alone, facilitates replacement when mounted as a subassembly, and protects both of the user and developing device.

(2) Drive means assigned to an image carrier and the intermediate member, which defines a reference position, are accurately positioned relative to each other on a common mount member. Therefore, by sequentially mounting the intermediate member supporting the developing device and the image carrier to the common mount member in this order, it is possible to mount the image carrier and drive means at accurate positions.

(3) A color developing device includes color switching means for selecting one of a plurality of developing means assigned to different colors at a time. The color developing device is replaceable alone and facilitates mounting work.

(4) The image carrier whose life is short can be replaced with priority. While the image carrier is replaceable alone, it may be replaced together with subsidiary members for further enhancing easy replacement.

(5) As for removal, priority is given to the image carrier because the intermediate member is not removable unless the image carrier shorter in life than the developing device, which is supported by the intermediate member, is removed.

(6) After a cleaning device, which is relatively large in size, has been removed, the intermediate member carrying mainly the developing device therewith is light weight and therefore easy to mount or dismount.

(7) Cleaning means and image carrier, which need accuracy, can be highly accurately positioned relative to each other.

(8) Charging means can be accurately positioned on the image carrier.

(9) When a waste developer case is filled up with a waste developer, the cleaning device can be bodily replaced or only the waste developer can be discarded to reuse the cleaning device.

(10) The image carrier does not interfere with the cleaning device when mounted or dismounted.

(11) The cleaning device is not removable unless the image carrier is removed, so that priority is given to the image carrier as to removal.

(12) A locking mechanism selectively locks or unlocks the image carrier to or from the intermediate member, so that the image carrier can be replaced, as needed.

(13) A simultaneous locking mechanism renders both of the image carrier and cleaning device ready to be mounted to or dismounted from the intermediate member by the user's single action.

(14) The above advantages are achievable at each of two image stations while the rigidity of each image station is enhanced.

(15) Each image station, drum cassette and cleaning cassette can be easily mounted and dismounted.

(16) A charger can be easily replaced alone, i.e., the cleaning cassette does not have to be bodily replaced, so that waste of parts is obviated.

(17) The developing device can be replaced alone in the event of an unexpected trouble, i.e., the intermediate member does not have to be bodily replaced, so that waste of parts is obviated.

(18) A support member for supporting the charger is selected in accordance with the life of the charger, which is extending. This is also successful to enhance efficient replacement and obviate waste of parts.

(19) The charger can be replaced alone without regard to the life of the other members.

(20) The image carrier is mounted after the intermediate member supporting the developing device whose life is relatively long. Such a mounting order is insured by a mechanical arrangement.

(21) The intermediate member supporting the developing device and the image carrier are sequentially mounted to a common mount member in this order, insuring the accurate positioning of the image carrier and drive means. In addition, at least an image carrier unit whose life is relatively short is mounted after the intermediate member supporting the developing device whose life is relatively long. This is also successful to provide the image carrier unit with priority as to replacement.

(22) After the cleaning device has been mounted to the intermediate member supporting the developing device, the intermediate member is mounted to the apparatus body. This implements higher efficiency and easier work than in the case wherein the structural elements are assembled one by one.

(23) A protecting portion with walls prevents toner from flying out of developing means and prevents light from leaking to portions other than an exposing portion and a discharging portion. Therefore, the image carrier that needs frequent replacement can be replaced at low cost with image forming means being held in an accurate positional relation to each other. Therefore, there can be implemented a small size, simple, easy-to-replace image carrier cassette capable of insuring high image quality.

(24) Toner and dust to deposit on a light emission window can be reduced to a level not effecting writing accuracy at all.

(25) The image carrier is prevented from contacting, e.g., the floor in a bare condition and can therefore be easily dealt with.

(26) The waste developer case is provided with a space large enough to delay the time at which the case is filled up with the waste developer, so that the image carrier needing frequent replacement can be replaced at low cost. Further, dust and disturbing light are prevented from entering a path along which a scanning light beam is propagated.

Various modifications will become possible for those skilled in the art after receiving the teachings of the present disclosure without departing from the scope thereof.

What is claimed is:

1. An image carrier cassette including an image carrier configured to carry a toner image thereon and separate from other image forming means, said image carrier cassette comprising:

said image carrier on which a toner image is to be formed;

a supporting/protecting portion for rotatably supporting said image carrier while protecting said image carrier;

a plurality of projections extending from said supporting/protecting portion radially outward from a circumference of said image carrier; and a plurality of image forming zones divided by said plurality of projections in a circumferential direction of said image carrier for forming zones in which the other image forming means are to be arranged, wherein at least one of said plurality of projections is formed with a light conduction path that allows light for exposing said image carrier in accordance with image data to be passed therethrough.

2. The cassette as claimed in claim 1, wherein said plurality of projections comprise three projections.

3. The cassette as claimed in claim 1, wherein said plurality of projections comprise partitions extending in an axial direction of said image carrier.

4. The cassette as claimed in claim 1, wherein said plurality of projections are configured such that a virtual line, connecting ends of at least two projections, is positioned outward of a circumference of said image carrier.

5. The cassette as claimed in claim 4, wherein said light conduction path is configured such that light for exposing said image carrier is incident on said image carrier from an upside or a downside.

6. An image forming apparatus comprising:

an image carrier cassette comprising an image carrier on which a toner image is to be formed, a supporting/protecting portion for rotatably supporting said image carrier while protecting said image carrier, a plurality of projections extending from said supporting/protecting portion in a radial direction of said image carrier, and a plurality of image forming zones divided by said plurality of projections in said radial direction of said image carrier for forming zones in which the other image forming means are to be arranged, at least one of said plurality of projections being formed with a light conduction path that allows light for exposing said image carrier in accordance with image data to be passed therethrough;

charging means arranged in one of said plurality of image forming zones for charging said image carrier disposed in said image carrier cassette;

latent image forming means for forming a latent image on said image carrier charged by said charging means;

developing means positioned in one of said plurality of image forming zones for developing latent images formed by said latent image forming means with toners; and image transferring means arranged in one of said plurality of image forming zones for transferring a toner image formed by said developing means to an image transfer body.

* * * * *